US009926874B2

(12) United States Patent
Kusakabe et al.

(10) Patent No.: US 9,926,874 B2
(45) Date of Patent: Mar. 27, 2018

(54) DRIVE DEVICE FOR FUEL INJECTION DEVICE, AND FUEL INJECTION SYSTEM

(71) Applicant: Hitachi Automotive Systems, Ltd., Hitachinaka-shi, Ibaraki (JP)

(72) Inventors: Ryo Kusakabe, Tokyo (JP); Motoyuki Abe, Tokyo (JP); Ayumu Hatanaka, Tokyo (JP); Toshihiro Aono, Tokyo (JP); Teppei Hirotsu, Tokyo (JP); Hideyuki Sakamoto, Hitachinaka (JP); Masahiro Toyohara, Hitachinaka (JP); Osamu Mukaihara, Hitachinaka (JP); Takao Fukuda, Hitachinaka (JP); Yoshihito Yasukawa, Tokyo (JP); Akiyasu Miyamoto, Tokyo (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 0 days.

(21) Appl. No.: 14/907,908

(22) PCT Filed: Jul. 29, 2013

(86) PCT No.: PCT/JP2013/070413

§ 371 (c)(1),
(2) Date: Jan. 27, 2016

(87) PCT Pub. No.: WO2015/015541

PCT Pub. Date: Feb. 5, 2015

(65) Prior Publication Data

US 2016/0177855 A1 Jun. 23, 2016

(51) Int. Cl.
*F02D 41/20* (2006.01)
*F02M 65/00* (2006.01)
(Continued)

(52) U.S. Cl.
CPC ..... *F02D 41/20* (2013.01); *F02M 51/0685* (2013.01); *F02M 65/005* (2013.01);
(Continued)

(58) Field of Classification Search
CPC ..... F02D 41/20; F02D 41/0085; F02D 2041/2003; F02D 2041/2037;
(Continued)

(56) References Cited

U.S. PATENT DOCUMENTS 5,216,994 A * 6/1993 Aoki ..... F02D 41/062 123/149 R
6,510,841 B1 1/2003 Stier
(Continued)

FOREIGN PATENT DOCUMENTS

DE 10 2009 047 453 A1 6/2011
EP 2 455 601 A1 5/2012
(Continued)

OTHER PUBLICATIONS

International Search Report (PCT/ISA/210) issued in PCT Application No. PCT/JP2013/070413 dated Sep. 10, 2013 with English translation (Four (4) pages).
(Continued)

*Primary Examiner* — John Kwon
*Assistant Examiner* — Johnny H Hoang
(74) *Attorney, Agent, or Firm* — Crowell & Moring LLP

(57) ABSTRACT

A drive device capable of detecting individual variations of an injection quantity of a fuel injection device of each cylinder and adjusting a current waveform provided to an injection pulse width and a solenoid such that the individual variations of the fuel injection devices are reduced. The fuel injection device in the present invention includes a valve body that closes a fuel passage by coming into contact with a valve seat and opens the fuel passage by separating from
(Continued)

the valve seat and a magnetic circuit constructed of a solenoid, a fixed core, a nozzle holder, a housing, and a needle and when a current is supplied to the solenoid, a magnetic suction force acts on the needle and the needle has a function to open the valve body by colliding against the valve body after performing a free running operation and changes of acceleration of the needle due to collision of the needle against the valve body are detected by a current flowing through the solenoid.

22 Claims, 29 Drawing Sheets

(51) Int. Cl.
*F02M 51/06* (2006.01)
*F02D 41/00* (2006.01)
*F02M 61/18* (2006.01)

(52) U.S. Cl.
CPC .. *F02D 41/0085* (2013.01); *F02D 2041/2003* (2013.01); *F02D 2041/2037* (2013.01); *F02D 2041/2055* (2013.01); *F02D 2041/2058* (2013.01); *F02D 2200/063* (2013.01); *F02M 61/1833* (2013.01)

(58) Field of Classification Search
CPC ..... F02D 2041/2055; F02D 2041/2058; F02D 2200/063; F02M 51/0685; F02M 61/1833; F02M 65/005
USPC ..... 123/472, 478, 480, 490
See application file for complete search history.

(56) References Cited

U.S. PATENT DOCUMENTS

| | | | | |
|---|---|---|---|---|
| 2005/0126535 | A1* | 6/2005 | Nishimaki | F02D 41/20 123/299 |
| 2008/0006246 | A1* | 1/2008 | Perryman | F02D 41/2096 123/480 |
| 2009/0090333 | A1* | 4/2009 | Spadafora | F02D 41/2096 123/494 |
| 2009/0289131 | A1 | 11/2009 | Shingu et al. | |
| 2011/0155097 | A1 | 6/2011 | Matsumura et al. | |
| 2012/0216783 | A1 | 8/2012 | Kusakabe et al. | |
| 2012/0318883 | A1 | 12/2012 | Kusakabe et al. | |

FOREIGN PATENT DOCUMENTS

| | | | |
|---|---|---|---|
| EP | 2 538 061 | A2 | 12/2012 |
| EP | 2 613 044 | A1 | 7/2013 |
| EP | 2 990 705 | A1 | 3/2016 |
| JP | 3-226673 | A | 10/1991 |
| JP | 2001-221121 | A | 8/2001 |
| JP | 2003-511604 | A | 3/2003 |
| JP | 2006-200378 | A | 8/2006 |
| JP | 2008-240620 | A | 10/2008 |
| JP | 2009-281293 | A | 12/2009 |
| JP | 2011-69331 | A | 4/2011 |
| JP | 2011-132898 | A | 7/2011 |
| JP | 2012-177303 | A | 9/2012 |
| JP | 2013-2400 | A | 1/2013 |
| JP | 2013-19388 | A | 1/2013 |

OTHER PUBLICATIONS

Extended European Search Report issued in counterpart European Application No. 13890691.2 dated Feb. 6, 2017 (8 pages).

* cited by examiner

FIG. 12

| LINEAR APPROXIMATION | | |
|---|---|---|
| DISPLACEMENT ⟷ | MAGNETIC FLUX | VOLTAGE |
| $x$ | $\phi$ | — |
| $\frac{dx}{dt}$ | $\frac{d\phi}{dt}$ | $V$ |
| $\frac{d^2x}{dt^2}$ | $\frac{d^2\phi}{dt^2}$ | $\frac{dV}{dt}$ |

DRIVE DEVICE FOR FUEL INJECTION DEVICE, AND FUEL INJECTION SYSTEM

TECHNICAL FIELD

The present invention relates to a drive device that drives a fuel injection device for an internal combustion engine or a fuel injection system.

BACKGROUND ART

In recent years, tightening of emission control of carbon dioxide and concern about depletion of fossil fuel demand improvements of fuel consumption (fuel consumption rate) of internal combustion engines. Thus, efforts to improve fuel consumption by reducing various losses of an internal combustion engine are under way. In general, when losses are reduced, the power output necessary for operation of an engine can be reduced so that the minimum power output of the internal combustion engine can be reduced. In such an internal combustion engine, it becomes necessary to control and supply up to a small amount of fuel corresponding to the minimum power output.

Also in recent years, a downsizing engine which reduces the size thereof by reducing the displacement and also obtains power output by a supercharger has attracted attention. The downsizing engine can reduce pumping losses and friction by reducing the displacement so that fuel consumption can be improved. On the other hand, by using a supercharger, sufficient power output can be obtained and also fuel consumption can be improved by inhibiting the degradation of the compression ratio accompanying supercharging thanks to an inlet air cooling effect by cylinder direct injection of fuel. It is necessary particularly for a fuel injection device used for the downsizing engine to be able to inject fuel in a wide range from the minimum injection quantity corresponding to the minimum power output due to a lower displacement to the maximum injection quantity corresponding to the maximum power output obtained by supercharging and an extended control range of the fuel quantity is demanded.

Also, with tightening of emission control, the inhibition of the total quantity of particulate matter (PM) during mode traveling and the particulate number (PN) as the number thereof of an engine are demanded and a fuel injection device capable of controlling a minute injection quantity is demanded. As a means of inhibiting generation of particulate matter, as described in, for example, PTL 1, it is effective to divide a spray during one intake and exhaust stroke into a plurality of times and inject (hereinafter, called divided injection). By performing divided injection, adhesion of fuel to the piston wall surface can be inhibited and thus, injected fuel is more likely to be vaporized and the total quantity of particulate matter and the particulate number as the number thereof can be inhibited. In an engine that performs divided injection, it is necessary to divide fuel to be injected at a time in the past into that to be injected a plurality of times and inject and thus, a fuel injection device needs to be able to control an injection quantity more minute than in the past.

In general, the injection quantity a fuel injection device is controlled by the pulse width of an injection pulse output from an engine control unit (ECU). The injection quantity increases with an increasing injection pulse width and decreases with a decreasing injection pulse width and the relationship thereof is substantially linear. However, the time needed for a needle to reach a valve closed position after the injection pulse is stopped varies due to a rebound phenomenon (bound behavior of the needle) that occurs when the needle collides against a fixed core or a stopper that regulates a displacement of the needle in a region where the injection pulse width is short, posing a problem that the injection quantity does not change linearly with respect to the injection pulse width and thus, a controllable minimum injection quantity of the fuel injection device increases. Also due to the rebound phenomenon of the needle, the injection quantity may not be stable from fuel injection device to fuel injection device and it is unavoidable to set an individual fuel injection device with the largest injection quantity as the controllable minimum injection quantity, leading to an increased minimum injection quantity. If the injection pulse width is further shortened from an injection pulse in a nonlinear region where the relationship between the injection pulse and the injection quantity is not linear, the region becomes a region where the needle and the fixed core do not collide, that is, an intermediate lift region where a valve body is not fully lifted. In such an intermediate lift region, even if the same injection pulse is supplied to the fuel injection device of each cylinder, the lift quantity of the fuel injection device differs immensely due to individual differences arising under the influence of dimensional tolerance, aging and the like of the fuel injection device. Then, the required injection quantity is small in an intermediate lift region and the influence of individual variations of the injection quantity on injection quantity errors becomes pronounced, which makes it difficult to use the intermediate lift region from the viewpoint of stable combustion.

As described above, it is necessary to reduce variations of the injection quantity of a fuel injection device and a controllable minimum injection quantity for the purpose of improving fuel consumption and inhibiting particulate matter and to achieve a significant reduction of the minimum injection quantity, controlling a short injection pulse region having variation characteristics in which the relationship between the injection pulse width and the injection quantity varies individually and the injection quantity in an intermediate lift region where the injection pulse is small and the valve body does not reach the target lift is demanded. To reduce variations of the injection quantity and the minimum injection quantity, it is necessary to be able to detect variations of a valve operation or variations of the injection quantity such as variations in time after an injection pulse generated by the bound phenomenon of the needle arising when the needle collides against the fixed core or the like during valve opening is stopped before the needle reaches a valve closed position for each fuel injection device of each cylinder and to correct the injection quantity of fuel individually and as a detection technology for this purpose, a fuel injection control device disclosed by PTL 2 is known as a means of detecting the collision time of the needle and the fixed core when the fuel injection device finishes valve opening. In PTL 2, the collision timing of the needle and the fixed core when the fuel injection device finishes valve opening by focusing on a phenomenon in which a magnetic material constituting a magnetic circuit is magnetically saturated by a rapidly reducing air gap between the needle and the fixed core and the inductance of the magnetic circuit changes and detecting the timing when the second differential value of the current changes from negative to positive.

PTL 3 discloses a detector of acceleration and the like that detects a movable magnetic body moving in accordance with acceleration of a needle by a differential transformer transducer and generates output in accordance with a displacement of the magnetic body on the secondary side of the transformer transducer, wherein a linear voltage is obtained in accordance with acceleration by providing in series a solenoid that adds a voltage induced by the magnetic flux of a primary solenoid to the output of a secondary solenoid in phase or reverse movement.

CITATION LIST

Patent Literatures

PTL 1: Japanese Patent Laid-Open No. 2011-132898
PTL 2: Japanese Patent Laid-Open No. 2001-221121
PTL 3: Japanese Patent Laid-Open No. Hei3-226673

SUMMARY OF INVENTION

Technical Problem

A fuel injection device performs an opening/closing operation of a valve body by supplying a drive current to a solenoid (coil) and stopping the supply and there is a time lag between the start of supplying the drive current and the valve body reaching a target opening and if the injection quantity is controlled under the condition of performing a closing operation of the valve body after reaching the target opening, constraints are placed on the minimum injection quantity that can be controlled. Therefore, to control a minute injection quantity by the fuel injection device, it is necessary to be able to correctly control the injection quantity under the condition of the valve body not reaching the target opening, that is, under the condition of intermediate lift. However, the operation of the valve body in an intermediate lift state is an uncertain operation that is not regulated and thus, a valve opening start lag time before the valve body starts to open after the injection pulse to drive the fuel injection device being turned on and a valve closing lag time before the valve body finishes closing after the injection pulse being turned off lead to increased variations among fuel injection devices of cylinders. The flow rate injected from the fuel injection device is determined by the gross-sectional area of injection holes and a valve body lift quantity integration area between the valve opening start time and valve closing finish time. Thus, to match the injection quantity of the fuel injection device of each cylinder, it is necessary to match the actual valve opening time in which the valve body is displaced by subtracting the valve opening start lag time from the valve closing lag time for each fuel injection device of each cylinder. Therefore, a technology capable of detecting the valve opening start timing and valve closing finish timing of the valve body in each fuel injection device of each cylinder by a drive device is needed.

However, the fuel injection control device described in PTL 2 does not disclose a method capable of detecting the valve opening start timing of a fuel injection device of each cylinder. That is, according to the detection method disclosed by PTL 2, the saturation magnetic flux density is not reached in the timing when a needle and a stopper collide, changes in magnetic resistance accompanying a reduced air gap can be grasped as changes in current only in the range of a low magnetic field in which the relationship between the magnetic field applied to a solenoid and the magnetic flux density is linear to some extent, and the influence of the condition under which the magnetic flux density on a suction surface is large before the needle and the stopper collide on the detection of valve opening start timing is not necessarily sufficient. In addition, the fuel injection device described in PTL 2 starts the valve opening operation gradually from the state in which the needle is at rest and thus, the change of acceleration of the needle in the valve opening start timing is small and it is difficult to grasp the change of current in the valve opening timing.

Similarly in PTL 3, no detection method of the valve opening start timing of a fuel injection device is disclosed. Further, if the detection method disclosed by PTL 3 is applied to a fuel injection device, it is necessary to arrange, in addition to a solenoid to drive a needle, a solenoid for detection and thus, the outside diameter of the fuel injection device increases for the shape of the detection coil and from the viewpoint of engine mountability, it is difficult to arrange the detection coil for a fuel difference or inside the device. In addition to the solenoid to drive the needle, three solenoids are needed for each cylinder and thus, a problem of increased costs of the fuel injection device and the drive device is posed.

An object of the present invention is to detect the timing when a valve body of a fuel injection device starts to open for each fuel injection device of each cylinder by a drive device.

Solution to Problem

A drive device of the present invention to solve the above problem is a drive device for a fuel injection device including a step-up circuit that steps up a battery voltage and a first switching element that controls passage/stop of current from the step-up circuit to a solenoid of the fuel injection device, wherein the fuel injection device includes a valve body driven by the solenoid, opened by being brought into contact with a valve seat, and closed by being separated from the valve seat, and the drive device includes a drive signal generator that drives the valve body in a valve opening direction by supplying a current to the solenoid with passage of the current to the first switching element and a valve opening start period detector that detects a valve opening start period when the valve body separates from the valve seat based on a current value flowing through the solenoid.

Advantageous Effects of Invention

According to the present invention, the valve opening start timing of a fuel injection device can be detected and therefore, individual variations of the injection quantity of the fuel injection device and variations between cylinders of the fuel injection start timing can be reduced and a fuel injection system constructed of the fuel injection device capable of reducing a controllable minimum injection quantity and a drive device can be provided.

BRIEF DESCRIPTION OF DRAWINGS

FIG. 12 is a diagram illustrating a correspondence among the displacement (called a gap x) between a needle and a fixed core according to an example of the present invention, a magnetic flux φ passing through a suction surface between the needle and the fixed core, and a terminal voltage $V_{inj}$ of the solenoid.

FIG. 37 is a diagram illustrating the relationship between the terminal voltage of the solenoid, the drive current supplied to the solenoid, a difference between a current value when the valve body does not open and a current value of each individual, and the valve displacement when the fuel injection device according to Example 6 of the present invention is used and the time after the injection pulse is turned on.

DESCRIPTION OF EMBODIMENT

Figure 1:
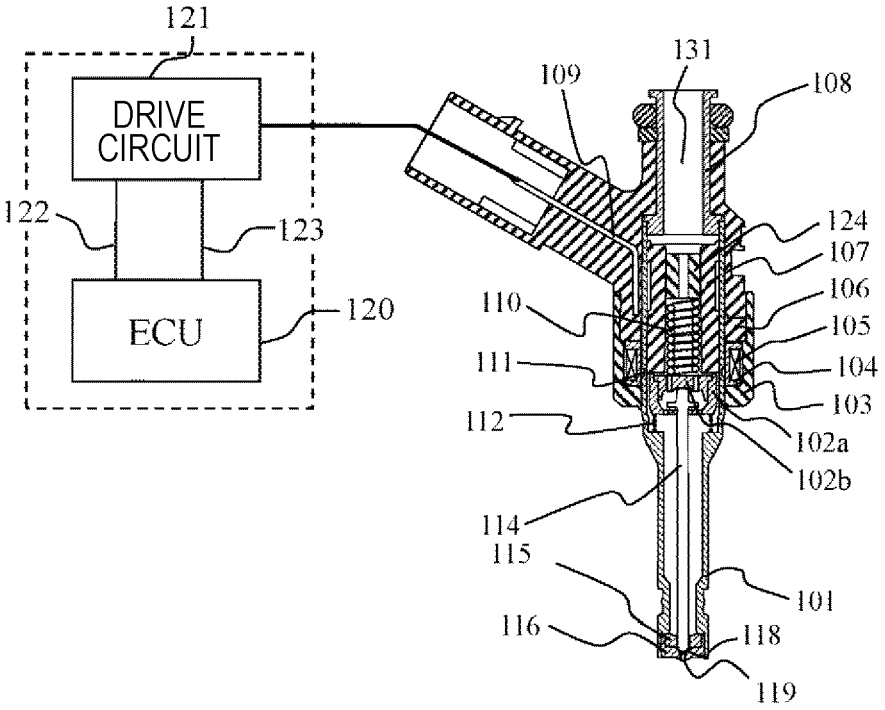
FIG. 1 is a diagram illustrating a longitudinal view of a fuel injection device according to Example 1 of the present invention and the configuration of a drive circuit and an engine control unit (ECU) connected to the fuel injection device.

The present invention is a fuel injection system constructed of a fuel injection device that switches between a valve open state and a valve closed state by driving a valve body and a drive device that supplies a drive current to a solenoid (coil) of the fuel injection device, wherein the drive device for the fuel injection device includes a first voltage source for the fuel injection device and a second voltage source that generates a higher voltage than the first voltage source, a first switching element that controls conduction/non-conduction from the first voltage source to the solenoid of the fuel injection device, a second switching element that controls conduction/non-conduction from the second voltage source to the solenoid of the fuel injection device, a third switching element that controls conduction/non-conduction between a ground potential (GND) side terminal of the solenoid and a ground potential of the fuel injection device, a ground potential side terminal of the fuel injection device, a diode arranged between the fuel injection device and a second voltage source side terminal of the second switching element from the ground potential side terminal of the fuel injection device toward the second voltage source side terminal, and a shunt resistor between the first switching element and the first voltage source, between the third switching element and the ground potential, or both, the fuel injection device includes the valve body that closes a fuel passage by coming into contact with a valve seat and opens the fuel passage moving away from the valve seat, a first needle having a magnetic circuit constructed of the solenoid, a fixed core, a nozzle holder, a housing, and a needle and which opens the valve body by colliding with the valve body after performing a free running operation with the action of the magnetic suction force on the needle when a current is supplied to the solenoid, and a second needle moving in cooperation with the first needle, and in the valve closed state in which the valve body is in contact with the valve seat, an upper end surface of the valve body is in contact with the second needle, a collar provided on the outside diameter of the second needle is in contact with the first needle, and when the first needle performs the free running operation, the first needle and the second needle cooperate to move in a valve opening direction.

To supply a current from the second voltage source to the solenoid from a state in which the valve body is closed, the drive device brings the second switching element and the third switching element into conduction and after the current reaches a setting value provided to the drive device or a predetermined time passes from the time when an injection pulse is applied, brings the second switching element and the third switching element out of conduction to attenuate the current and then, while the first switching element and the third switching element are in conduction, causes the first needle to collide against the valve body to open the valve body. While the valve body is closed, the pressure on the upstream side and the pressure on the downstream side of the first needle are equal and thus, the first needle is not subject to a fluid force generated by a differential pressure between the upstream side and the downstream side and can move at high speed due to the magnetic suction force generated by the current supplied to the solenoid by the application of the second voltage source until the collision with the valve body. Then, with the collision of the first needle with the valve body, the valve body abruptly performs a valve opening operation using an impulse during collision by kinetic energy of the needle. At this point, while the valve body is closed, a differential pressure force due to fuel pressure acts on the valve body. The differential pressure force has a value obtained by multiplying a differential pressure between the pressure at the tip of the valve body and the pressure of an upstream portion of the valve body by a seat portion area of the valve body and the valve seat as a pressure receiving area. At the instant when the needle collides against the valve body, forces received by the first needle and the second needle change due to a differential pressure force acting on the valve body. If the first needle is displaced and a magnetic gap between the first needle and the second needle, and the fixed core changes while the first switching element and the third switching element are in conduction, an induced electromotive force is generated and thus, the current value decreases or gradually increases and at the instant when the first needle collides against the valve body, the acceleration of the needle changes and the gradient of the current changes. The magnitude of the induced electromotive force during valve opening operation of the needle changes significantly depending on the setting value of the magnetic circuit of the fuel injection device, the speed of the first needle, and the current supplied to the solenoid and thus, the current may not necessarily decrease with a reduced magnetic gap between the first needle and the fixed core. In such a case, by detecting the time interval between the time when the injection pulse width is turned on and the time when the second differential value of the current reaches the maximum value, regardless of the magnitude of the induced electromotive force, the valve opening start timing when the first needle collides against the valve body can be detected as a time when the gradient of the current differential value changes. Also, the drive device is caused to store the detected valve opening start timing. The force to which the needle is subject does not change even if the pressure of fuel supplied to the fuel injection device changes and thus, the valve opening start timing is not affected by pressure changes of the fuel.

The timing when the acceleration of the needle changes, that is, the timing when the direction in which the force working on the needle is reversed due to disappearance of force in a valve closing direction to which the needle is subject via the valve body is detected by detecting the voltage across the solenoid or a potential difference between the terminal on the ground potential side of the solenoid and the ground potential by the drive device and differentiating the voltage value detected by the drive device twice to detect the timing when the second differential value of the voltage takes the maximum value as the valve closing finish timing and the drive device is caused to store the valve closing lag time between the time when the injection pulse is stopped and the time when the second differential value of the voltage takes the maximum value.

When the valve body stops the supply of current to the solenoid from a valve open state and the magnetic suction force acting on the first needle and the second needle falls below the force in a valve closing direction as a sum of a force due to the fuel pressure working on the valve body and a load due to a spring acting on the second needle, the valve body, the first needle, and the second needle perform a valve closing operation and at the instant of the valve closing finish timing when the valve body reaches the valve seat, the first needle moves away from the second needle and the valve body and the timing when the acceleration of the first needle changes, that is, the timing when the direction in which the force working on the first needle is reversed due to a load of a zero position spring energizing in the valve opening direction of the second needle after the force in the valve closing direction to which the first needle has been subject via the valve body and the second needle disappears is detected by detecting a VL voltage of a potential difference between the terminal on the ground potential side of the solenoid and ground potential or a VL1 voltage obtained by dividing the VL voltage using two resistors by the drive device and differentiating the detected voltage value twice to detect the timing when the second differential value of the voltage takes the minimum value as the valve closing finish timing and the drive device is caused to store the valve closing lag time between the time when the injection pulse is stopped and the time when the second differential value of the voltage takes the minimum value. Deviation values from the median value of the valve opening start timing and the valve closing finish timing, or the valve closing lag time provided to the drive device in advance are calculated from information of the valve opening start timing and the valve closing finish timing, or the valve closing lag time the drive device is caused to store for each cylinder and the injection quantity of each cylinder is estimated by multiplying the static flow rate per unit time at each fuel pressure when the valve body is positioned at the target lift provided to the drive device in advance to reduce variations of the injection quantity from cylinder to cylinder by correcting the injection pulse width for the next injection and onward By supplying, after an injection pulse is applied and the current reaches the target value, a voltage in the negative direction from the second voltage source to rapidly reduce the current and to decrease the magnetic suction force working on the needle, the valve body is rapidly decelerated before the valve body reaches the target lift and the valve body bound after the target lift is reached can thereby be reduced while limiting an increase of the valve opening lag time to a minimum so that nonlinearity arising in injection quantity characteristics can be improved and minute control of the injection quantity can be exerted. The amount of bound of the valve body after the valve body reaches the target lift generated by the collision of the needle and the fixed core is different from fuel injection device to fuel injection device due to variations of the dimensional tolerance of the fuel injection device and also nonlinearity arising in the injection quantity is different from individual to individual. If the same current waveform is provided to an individual in which the timing when the valve body starts to open after an injection pulse is supplied and the valve opening finish timing when the valve body reaches the target lift are earlier and an individual in which such timings are later, in the individual in which the valve opening finish timing is earlier, the deceleration of the valve body by rapidly reducing the current is not in time and the needle collides against the fixed core at a faster speed so that the bound of the valve body after reaching the target lift increases. Therefore, by stopping the application of the second voltage source based on the valve opening lag time detected in the fuel injection device of each cylinder and correcting the timing when the current is rapidly blocked by supplying a voltage in a negative direction to both sides of the solenoid of the fuel injection device, an appropriate current waveform can be supplied to the fuel injection device of each cylinder and the bound of the valve body after the target lift is reached can be limited and therefore, nonlinearity of injection quantity characteristics can be improved.

More specifically, the configuration described below may preferably be adopted.

A fuel injection system constructed of a fuel injection device that switches between a valve open state and a valve closed state by driving a valve body and a drive device that supplies a drive current to the solenoid, wherein changes of the first acceleration by collision of the first needle against the valve body after the current being supplied to the solenoid are detected by the drive device as the maximum value of the second differential value of the drive current flowing to the solenoid and after the valve body stops an instruction injection pulse from the valve open state, the valve body and the valve seat come into contact and changes of action force to which the first needle and the second needle are subject after the first needle moves away from the valve body and the second needle and the second needle comes into contact with the valve body and stands still are detected as changes of the acceleration by the minimum value or the maximum value of the second differential value of the VL voltage or the VL1 voltage and the drive device is caused to store the timing.

By matching the timing of fuel injection for each cylinder by changing the timing of supplying the drive current to the solenoid such that the valve opening start timing matches in each cylinder using information of the valve opening start timing the drive device is caused to store, changes of an air fuel mixture are inhibited for each cylinder, adhesion of fuel to the piston and engine cylinder wall surfaces can be inhibited, and the degree of homogeneity of the air fuel mixture is improved so that the total quantity of particulate matter (PM) during mode traveling and the particulate number (PN) as the number thereof can be reduced and also the homogeneous state of the air fuel mixture can be matched for each cylinder and therefore, combustion efficiency can be improved and also fuel consumption can be improved.

Hereinafter, embodiments of the present invention will be described using the drawings.

Example 1

Hereinafter, the operation of a fuel injection system including a fuel injection device and a drive device according to the present invention will be described using FIGS. 1 to 7.

First, the configuration of the fuel injection device and the drive device and the basic operation thereof will be described using FIG. 1. FIG. 1 is a diagram showing a longitudinal view of a fuel injection device and an example of the configuration of a drive circuit 121 to drive the fuel injection device and an engine control unit (ECU) 120. The ECU 120 and the drive circuit 121 are configured as separate devices in the present example, but the ECU 120 and the drive circuit 121 may also be configured as an integrated device. A device constructed of the ECU 120 and the drive circuit 121 will be described as a drive device below.

The ECU 120 fetches signals showing the state of an engine from various sensors and calculates the injection pulsed width and injection timing to control the injection quantity injected from the fuel injection device in accordance with operating conditions of an internal combustion engine. An injection pulse output from the ECU 120 is input into the drive circuit 121 of the fuel injection device through a signal line 123. The drive circuit 121 controls the voltage applied to a solenoid 105 and supplies the current. The ECU 120 communicates with the drive circuit 121 via a communication line 122 and can switch the drive current generated by the drive circuit 121 depending on the pressure of fuel supplied to the fuel injection device or operating conditions and change setting values of the current and the time. The drive circuit 121 is enabled to change control constants by communicating with the ECU 120 and can change setting values of a current waveform in accordance with control constants.

Figure 2:
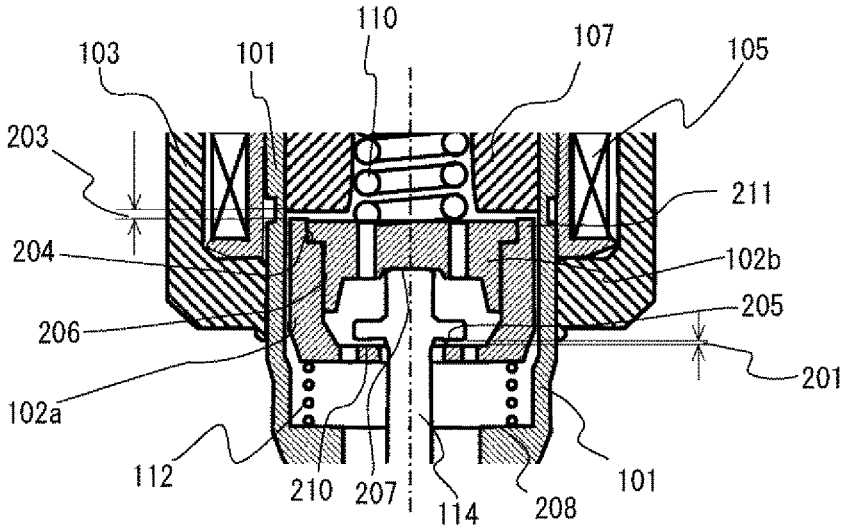
FIG. 2 is a diagram illustrating an enlarged sectional view of a drive unit structure of the fuel injection device according to Example 1 of the present invention.

Next, the configuration and operation of the fuel injection device using the longitudinal view of the fuel injection device in FIG. 1 and a sectional view enlarging the neighborhood of needles 102*a*, 102*b* and a movable member 114 in FIG. 2. Incidentally, the needle 102*a* and the needle 102*b* may be configured as an integrated component. A component constructed of the needle 102*a* and the needle 102*b* will be called a needle 102. The fuel injection device shown in FIGS. 1 and 2 is a normally closed magnetic valve (electromagnetic fuel injection device) and when no current is passed to the solenoid (coil) 105, the needle 102*b* is energized in a valve closing direction by a spring 110 as a first spring and an end face 207 of the needle 102*b* on the side of a valve body 114 and an upper end face of the valve body 114 are in contact. At this point, a load by the set spring 110 acts on the valve body 114 via the needle 102*b* and thus, the valve body 114 is energized toward a valve seat 118 and is in close contact with the valve seat 118 to create a valve closed state. In the valve closed state, a force by the spring 110 in a valve closing direction and a force by a return spring 112 as a second spring in a valve opening direction act on the needle 102. At this point, the force by the spring 110 is stronger than the force by the return spring 112 and thus, the end face 207 of the needle 102*b* is in contact with the valve body 114 and the needle 102 is at rest. Also in the valve closed state, an air gap 201 is created between an abutting surface 205 of the valve body 114 with the needle 102*a* and the needle 102*a*. Also in this state, a gap is created between the needle 102 and a fixed core 107. The valve body 114 and the needle 102 are configured to be relatively displaceable and are included in a nozzle holder 101. The nozzle holder 101 also has an end face 208 to be a spring seat of the return spring 112. The force by the spring 110 is adjusted during assembly by an indentation of a spring clamp 124 fixed to the inside diameter of the fixed core 107. Incidentally, an energizing force of the zero position spring 112 is set to be smaller than that of the spring 110.

The fuel injection device forms a magnetic circuit by the fixed core 107, the needle 102, the nozzle holder 101, and a housing 103 and has an air gap between the needle 102 and the fixed core 107. A magnetic valve 111 is formed in a portion corresponding to the air gap between the needle 102 and the fixed core 107 of the nozzle holder 101. The solenoid 105 is mounted on an outer circumferential side of the nozzle holder 101 in a state of being wound around a bobbin 104. A rod guide 115 is provided near the tip of the valve body 114 on the side of the valve seat 118 like being fixed to the nozzle holder 101. The rod guide 115 may be formed as the same component as an orifice cup 116. The valve body 114 is guided by two rod guides of a first rod guide 113 and the second rod guide 115 when moving in a valve axial direction. The orifice cup 116 in which the valve seat 118 and a combustion injection hole 119 are formed is fixed to the tip portion of the nozzle holder 101 to seal off an inner space (fuel passage) in which the needle 102 and the valve body 114 are provided.

The fuel supplied to the fuel injection device is supplied from a rail pipe provided upstream of the fuel injection device and passes through a first fuel passage hole 131 to flow up to the tip of the valve body 114 and the fuel is sealed by a seat portion formed at the end of the valve body 114 on the side of the valve seat 118 and the valve seat 118. When the valve is closed, a differential pressure arises due to fuel pressure between an upper side and a lower side of the valve body 114 and the valve body 114 is pressed in a valve closing direction by a force obtained by multiplying the fuel pressure by a pressure receiving area of the seat inside diameter in a valve seat position. In a valve closed state, the air gap 201 is created between the abutting surface 205 of the valve body 114 with the needle 102*a* and the needle 102*a*. When a current is supplied to the solenoid 105, a magnetic flux passes between the fixed core 107 and the needle 102 due to a magnetic field generated by the magnetic circuit and a magnetic suction force acts on the needle 102. The needle 102 starts to be displaced in the direction of the fixed core 107 in the timing when the magnetic suction force acting on the needle 102 exceeds the load by the set spring 110. At this point, the valve body 114 and the valve seat 118 are in contact and thus, the motion of the needle 102 is made in a state in which there is no flow of fuel and is a free running motion separately from the valve body 114 subjected to a differential pressure force by the fuel pressure and thus, the needle 102 can move at high speed without being affected by the fuel pressure and the like.

When the displacement of the needle 102 reaches the size of the air gap 201, the needle 102 transfers a force to the valve body 114 through the abutting surface 205 to lift the valve body 114 in a valve opening direction. At this point, the needle 102 makes a free running motion and collides against the valve body 114 with kinetic energy and thus, the valve body 114 receives the kinetic energy of the needle 102 and starts displacement in the valve opening direction at high speed. A differential pressure force generated due to fuel pressure acts on the valve body 114 and the differential pressure force acting on the valve body 114 is generated by a pressure fall at the tip of the valve body 114 caused by a pressure drop accompanying a static pressure fall due to the Bernoulli effect after the velocity of flow of the fuel in the seat portion increases in a range of a small channel cross section near the seat portion of the valve body 114. The differential pressure force is significantly affected by the channel cross section of the seat portion and thus, the differential pressure force increases under the condition of a small displacement of the valve body 114 and the differential pressure force decreases under the condition of a large displacement. Therefore, the valve body 114 is impulsively opened by the free running motion of the needle 102 in the timing when it becomes difficult to perform a valve opening operation with a small displacement and an increasing differential pressure force after the valve opening operation of the valve body 114 is started from the valve closed state and thus, even if a higher fuel pressure acts, the valve opening operation can still be performed. Alternatively, the spring 110 can be set to a force stronger than a fuel pressure range in which it is necessary to be operable. By setting the spring 110 to a stronger force, the time needed for a valve closing operation described below can be shortened and a minute injection quantity can effectively be controlled.

After the valve body 114 starts a valve opening operation, the needle 102 collides against the fixed core 107. When the needle 102 collides against the fixed core 107, the needle 102 performs a rebound operation, but due to the magnetic suction force acting on the needle 102, the needle 102 is attracted to a magnetic core before stopping. At this point, a force in the direction of the fixed core 107 acts on the needle 102 due to the return spring 112 and thus, the displacement caused by the rebound can be made smaller and also the time needed for the rebound to converge can be shortened. With a smaller rebound operation, the time when the gap between the needle 102 and the fixed core 107 is large is shorter and a stable operation can be performed for a smaller injection pulse width.

The needle 102 and the valve body 102 having finished the valve opening operation as described above come to rest in a valve open state. In the valve open state, a gap arises between the valve body 102 and the valve seat 101 and fuel is injected. The fuel flows downstream by passing through a center hole provided in the fixed core 107, an upper fuel passage hole provided in the needle 102, and a lower fuel passage hole provided in the needle 102.

When the passage of electric current to the solenoid 105 is cut off, the magnetic flux generated in the magnetic circuit disappears and the magnetic suction force also disappears. Due to the disappearance of the magnetic suction force acting on the needle 102, the valve body 114 is pushed back to a closing position in contact with the valve seat 118 by the load of the spring 110 and a force due to fuel pressure.

If the needle 102 is divided into the needle 102*a* and the needle 102*b*, in a valve closed state in which the valve body is in contact with the valve seat 118, the needle 102*b* is in contact with the needle 102*a* through a collar 211 provided on the outside diameter of the needle 102*b* and the needle 102*b* is in contact with the upper end face of the valve body 114 through a contact surface 210. When the needle 102*a* performs a valve opening operation from the initial position, the needle 102*b* is configured to perform a valve opening operation in cooperation.

The needle 102*a* and the needle 102*b* are configured to be able to slide on a sliding surface 206 and when the valve body 114 closes from a valve open state, the valve body 114 comes into contact with valve seat 118 and then, the needle 102*a* separates from the valve body 114 and the needle 102*b* and moves in a valve closing direction to make a motion for a fixed time before being brought back to the initial position of the valve closed state by the return spring 112.

By separating the needle 102*a* from needle 102*b* and the valve body 114 at the instant when the valve body 114 finishes the valve opening operation, the mass of the needle 102 can be reduced and thus, collision energy during collision against the valve seat 118 can be decreased so that the bound of the valve body 114 generated when the valve body 114 collides against the valve seat 118 can be inhibited.

When the valve body 114 is at rest in the target lift position, that is, in a valve open state, a protruding portion of a collision portion of one or both of the needle 102 and the fixed core 107 are provided on a circular end face where the needle 102 and the fixed core 107 are opposed to each other. Due to the protruding portion, an air gap is created in a valve open state between a portion excluding the protruding portion of the needle 102 or the fixed core 107 and the surface on the side of the needle 102 or the fixed core 107 and one or more fuel passages through which a fluid can move in an outside diameter direction and an inside diameter direction of the protruding portion in a valve open state are provided. Due to the effect of the protruding portion and the fuel passage described above, a squeezing force generated in a direction preventing the movement of the needle 102 by pressure changes of a minute gap between the needle 102 and the fixed core 107 can be reduced so that an effect of being able to reduce the valve closing lag time after the injection pulse is stopped before the valve body 114 is closed is achieved. In general, martensitic or ferritic stainless steel with good magnetic characteristics has low hardness and strength as a material and if martensitic stainless steel is heat-treated to increase hardness, magnetic characteristics may be degraded. To prevent abrasion of the protruding portion due to collision of the needle 102 and the fixed core 107, the end face where the protruding portion is provided may be plated with hard chromium or the like. In the operation in which the valve body 114 is pushed back to the closed position, the needle 102 moves together with a regulating unit 114*a* of the valve body 114 while being engaged therewith.

In the fuel injection device according to the present example, the valve body 114 and the needle 102 achieve an effect of inhibiting the bound of the needle 102 with respect to the fixed core 107 and the bound of the valve body 114 with respect to the valve seat 118 by causing a relative displacement in a very short time at the instant when the needle 102 collides against the fixed core 107 during valve opening and at the instant when the valve body 114 collides against the valve seat 118 during valve closing.

When configured as described above, the spring 110 energizes the valve body 114 in a direction opposite to a driving force by the magnetic suction force and the return spring 112 energizes the needle 102 in a direction opposite to the energizing force of the spring 110.

Next, the relationship (FIG. 3) among an injection pulse output from the drive device 121 driving a fuel injection device according to the present invention, a drive voltage across the solenoid 105 of the fuel injection device, a drive current (exciting current), and a displacement (valve body behavior) of the valve body 114 of the fuel injection device and the relationship (FIG. 4) between the injection pulse and a fuel injection quantity will be described.

When an injection pulse is input into the drive circuit 121, the drive circuit 121 applies a high voltage 301 to the solenoid 105 from a high voltage source stepped up to a voltage higher than a battery voltage to start the supply of current to the solenoid 105. When the current value reaches a peak current $I_{peak}$ preset for the ECU 120, the application of the high voltage 301 is stopped. Then, the voltage value to be applied is set to 0 V or below to decrease the current value like a current 202. When the current value falls below a predetermined current value 304, the drive circuit 121 applies the battery voltage VB by switching to exercise control so that a predetermined current 303 is maintained.

Using the profile of the supplied current as described above, the fuel injection device is driven. Before the peak current value $I_{peak}$ is reached after the application of the high voltage 301, the needle 102 starts to be displaced in timing $t_{31}$ and in timing $t_{32}$ when the displacement reaches the air gap 201, the needle 102 collides against the valve body 114 and using the impact thereof, the displacement of the valve body 114 increases rapidly and then, the valve body 114 reaches the position of the target lift before the transition to a holding current 303. After the target lift position is reached, the needle 102 performs a bound operation due to the collision of the needle 102 and the fixed core 107 and the valve body 114 is configured to be able to be relatively displaced from the needle 102 and thus, the valve body 114 separates from the anchor 102 and the valve body 114 is displaced beyond the target lift position. Then, due to the magnetic suction force generated by the holding current 303 and a force in a valve opening direction of the return spring 112, the needle 102 comes to rest in the predetermined target lift position and also the valve body 114 comes to rest in the target lift position and thus, a stable valve open state is created.

In the case of a fuel injection device having a movable valve in which the valve body 114 and the needle 102 are integrated, the displacement of the valve body 114 does not increase beyond the target lift position and displacements of the needle 102 and the valve body 114 after reaching the target lift are equal. In the case of an fuel injection device in which the needle 102 and the valve body 114 are integrated, the integrated component (hereinafter, called the movable valve) has two functions of opening/closing the valve with respect to the valve seat 117 by generating a magnetic suction force as a component of the magnetic circuit. If the needle 102 is divided into the needle 102*a* and the needle 102*b*, the needle 102*b* comes into contact with the upper end face of the valve body 114 and rests after the valve body 114 reaches the valve closed position, but the needle 102*a* separates from the valve body 114 and moves in a valve closing direction. After a motion for a fixed time, the needle 102*a* is brought back to the initial position in the valve closed state by the return spring 112. By separating the needle 102*a* from the needle 102*b* and the valve body 114 at the instant when the valve body 114 finishes the valve opening operation, the mass of the needle 102 can be reduced and thus, collision energy during collision against the valve seat 118 can be decreased so that the bound of the valve body 114 generated when the valve body 114 collides against the valve seat 118 can be inhibited. The needle 102*b* may preferably be configured to have a mass smaller than that of the needle 102*a*. An impact force due to collision of the valve body 114 against the valve seat 118 can be made smaller by this effect and thus, the bound of the valve body 114 caused by the collision of the valve body 114 against the valve seat 118 can be inhibited and unintended injection after the valve body 114 and the valve seat 118 comes into contact can be inhibited. Next, the relationship between the injection pulse width Ti and the fuel injection quantity will be described using FIG. 4. Under the condition that the injection pulse width Ti does not reach a fixed time, the magnetic suction force acting on the needle 102 does not exceed a force by the set spring 110 acting on the needle 102 and thus, the valve body 114 is not opened and no fuel is injected. Even if the magnetic suction force acting on the needle 102 exceeds the load of the set spring, the injection pulse is stopped before the needle 102 moves across the air gap 201 as an approach run interval and no fuel is injected even if the magnetic suction force acting on the needle 102 and an inertial force of the needle 102 in the valve opening direction fall below the force by the set spring 110. Under the condition of the short injection pulse width Ti like, for example, point 401, the valve body 114 separates from the valve seat 118 and starts to lift, but the valve closing operation is started before the valve body 114 reaches the target lift position and thus, the injection quantity is less than the case of an alternate long and short dash line 330 extrapolated from a linear region 320. With the pulse with at point 402, the valve closing operation is started immediately after the target lift position is reached and the trajectory of the valve body 114 becomes a parabolic motion. Under this condition, kinetic energy of the valve body 114 in the valve opening direction is large and also the magnetic suction force acting on the needle 102 is large and thus, the ratio of the time needed for closing increases and the injection quantity is more than the case of an alternate long and short dash line 430. With the pulse with at point 403, the valve closing operation is started in timing $t_{343}$ when the amount of bound of the needle 102 after reaching the target lift is the largest. At this point, a repulsive force during collision of the needle 102 and the fixed core 107 acts on the needle 102 and the valve closing lag time after the injection pulse is turned off until the valve body 114 is closed is shortened and as a result, the injection quantity is less than the case of the alternate long and short dash line 330. Point 404 is a state in which the valve closing operation is started in timing $t_{35}$ immediately after the bound of the needle 102 and the bound of the valve body 114 converge and under the condition of the injection pulse width Ti larger than point 404, the valve closing lag time increases substantially linearly in accordance with an increase of the injection pulse width Ti and thus, the injection quantity of fuel increases linearly. In a region up to the pulse width Ti indicated by point 404 after starting the injection of fuel, the injection quantity varies because the valve body 114 does not reach the target lift or the bound of the valve body 114 is unstable even if the valve body 114 reaches the target lift.

Figure 3:
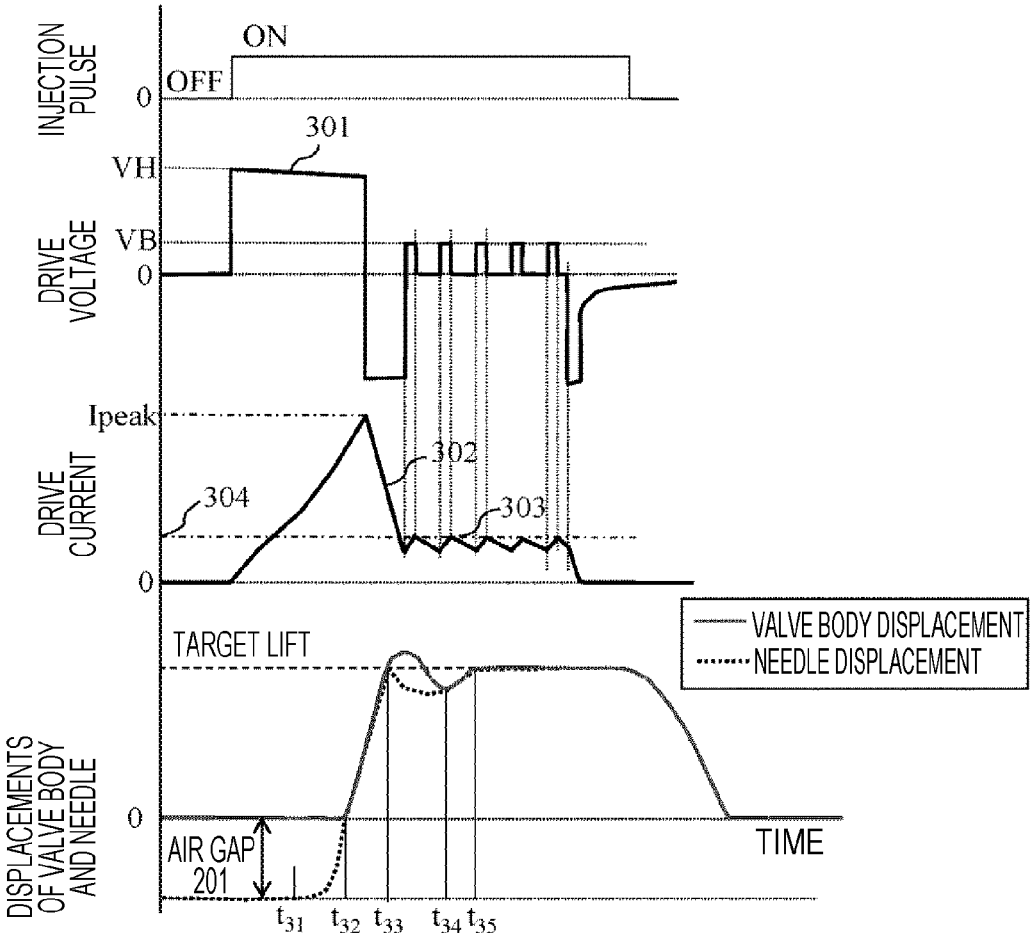
FIG. 3 is a diagram illustrating the relationship between an injection pulse that drives the fuel injection device according to Example 1 of the present invention, a terminal voltage applied to a solenoid of the fuel injection device, a drive current, and valve body and needle displacements and the time.
Figure 4:
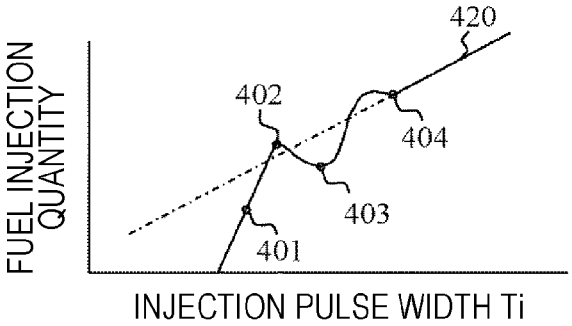
FIG. 4 is a diagram illustrating the relationship between an injection pulse width Ti output from the ECU in FIG. 3 and a fuel injection quantity injected from the fuel injection device.
Figure 5:
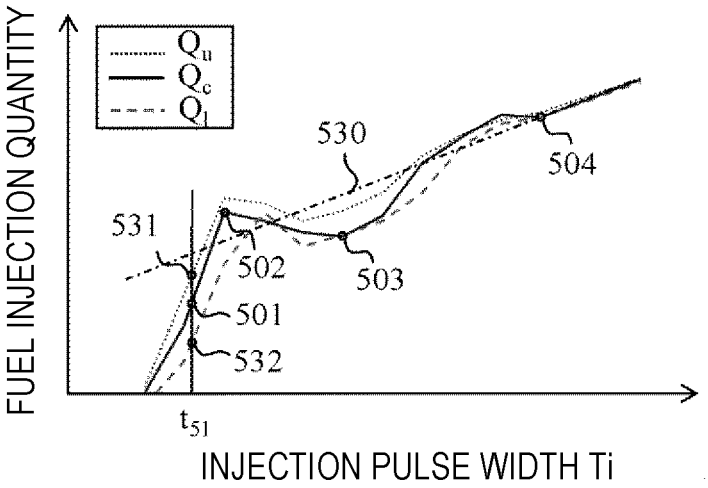
FIG. 5 is a diagram illustrating the relationship between the injection pulse width Ti and the fuel injection quantity of a fuel injection device having individual variations in injection quantity characteristics.
Figure 6:
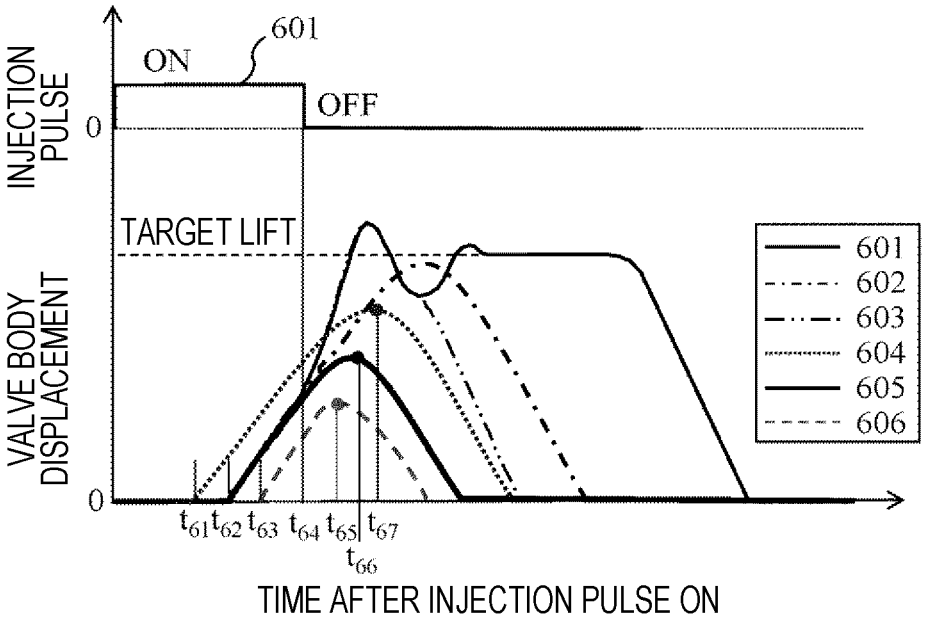
FIG. 6 is a diagram illustrating valve behavior at points 501, 502, 503, 531, 532 in FIG. 5.
Figure 7:
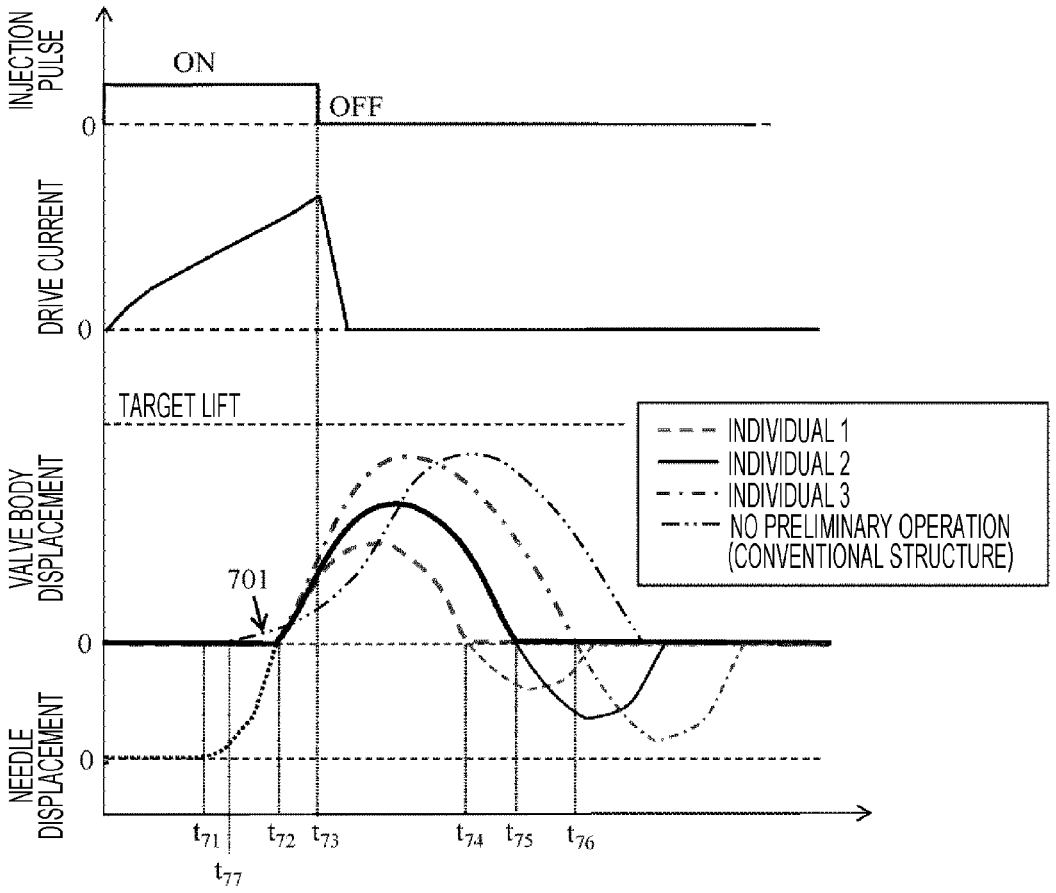
FIG. 7 is a diagram illustrating the relationship between the injection pulse width Ti output from a drive device, the drive current, the displacement of the valve body, and the needle displacement and the time.
Figure 8:
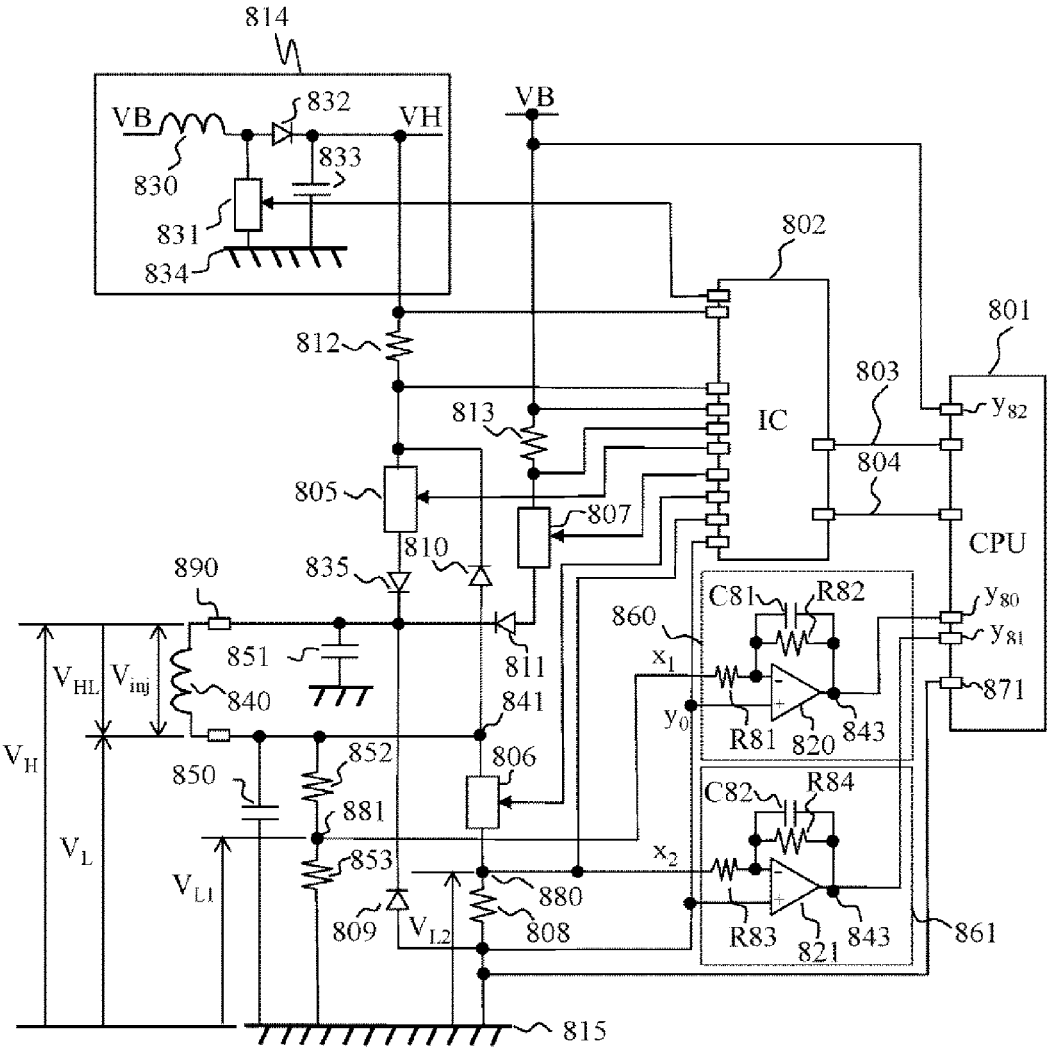
FIG. 8 is a diagram illustrating details of the drive device and ECU (engine control unit) of the fuel injection device.
Figure 9:
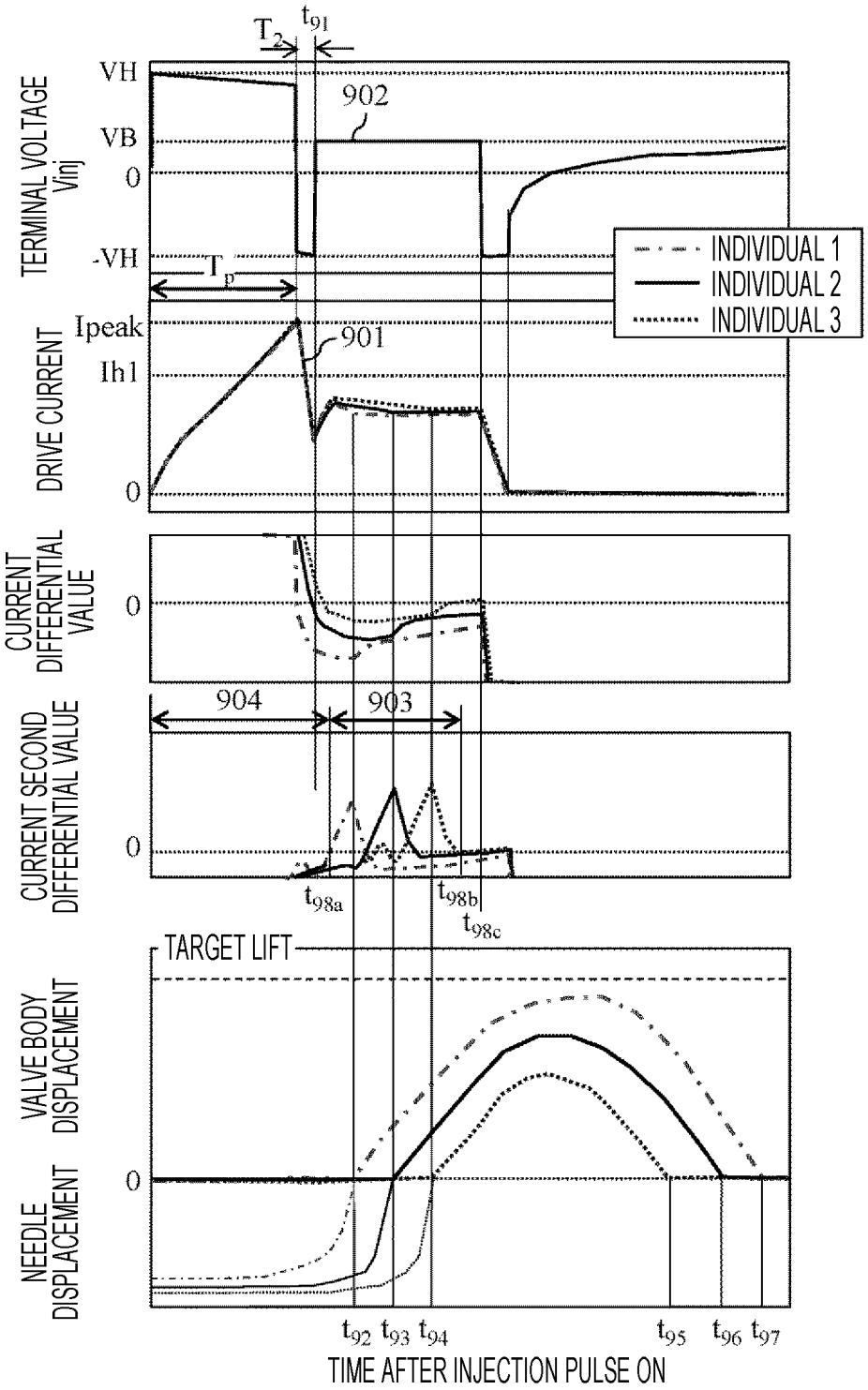
FIG. 9 is a diagram illustrating the relationship between the injection pulse width Ti, the drive current, a current differential value, a current second differential value, the valve body displacement, and the needle displacement of three fuel injection devices having different operation timing of the valve body due to variations in dimensional tolerance in an example of the present invention and the time.
Figure 10:
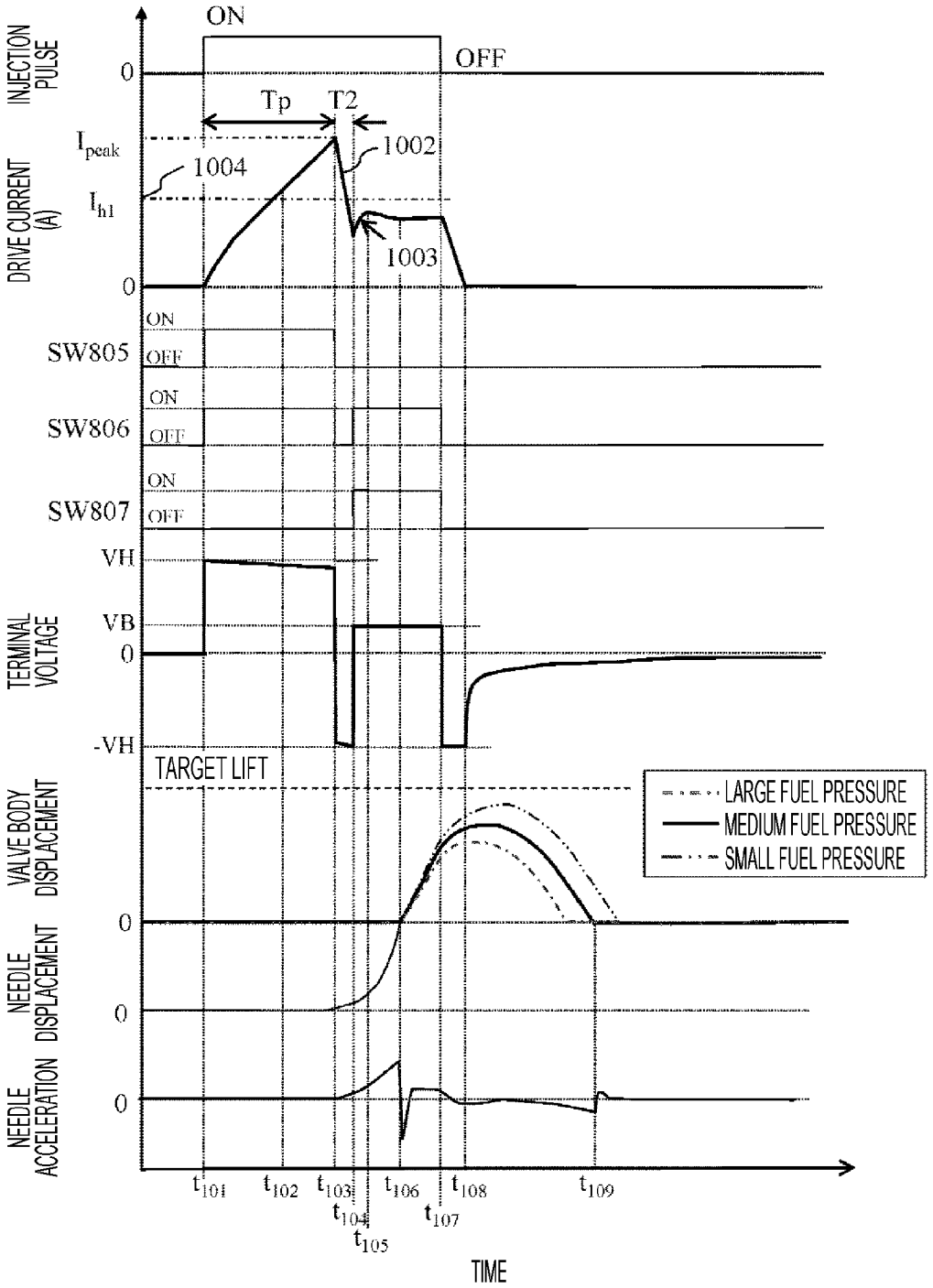
FIG. 10 is a diagram illustrating the relationship between the injection pulse Ti, the drive current supplied to the fuel injection device, operation timing of a switching element of the drive device, a terminal voltage $V_{inj}$ of the solenoid, the valve body and needle displacements, and needle acceleration in an example of the present invention and the time.
Figure 11:
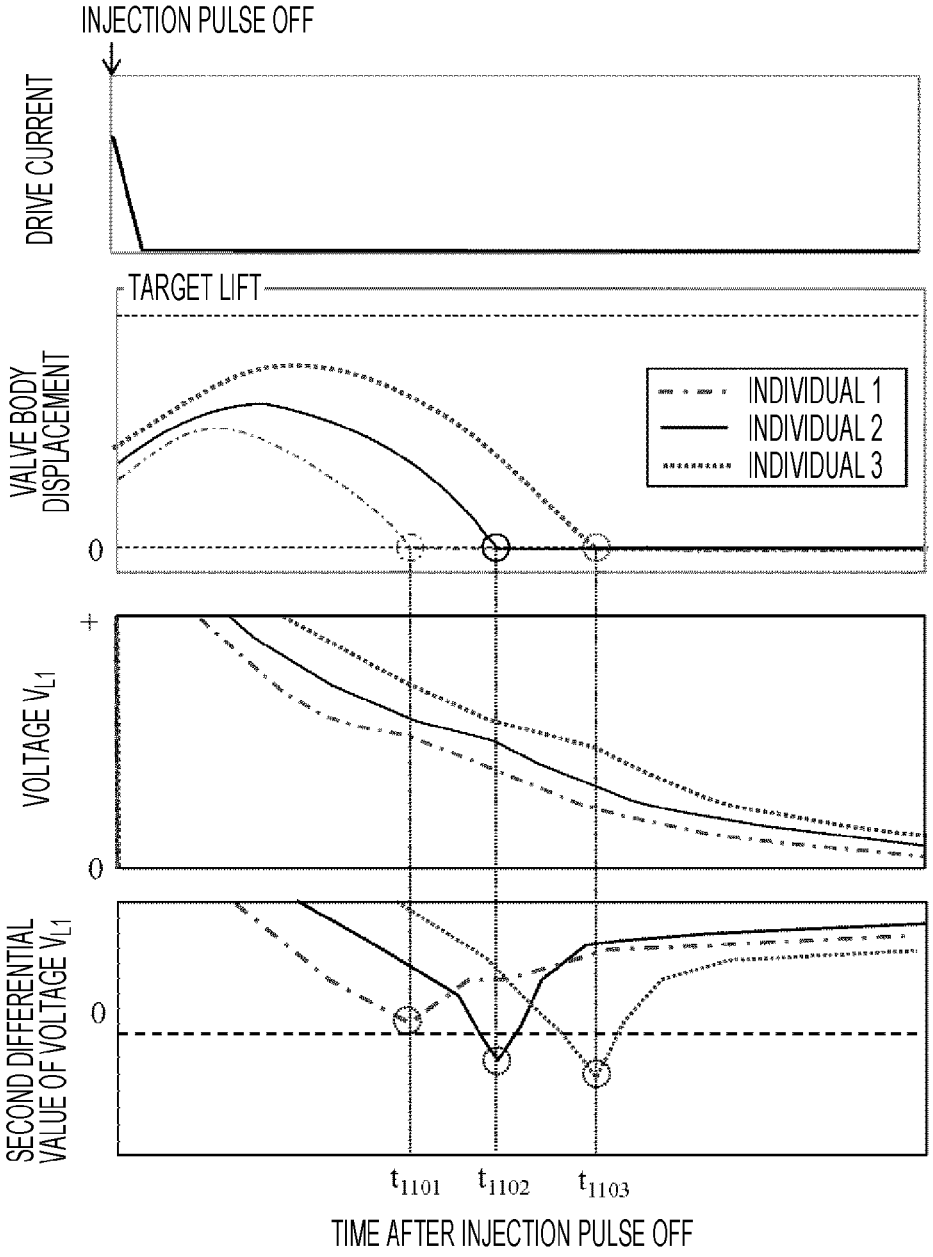
FIG. 11 is a diagram illustrating the drive current supplied to a solenoid 105 according to Example 1 of the present invention and the relationship among the displacement of three individual valve bodies of different valve closing behavior due to variations in dimensional tolerance of the fuel injection device, an enlarged view of a voltage $V_{L1}$, and a second differential value of the voltage $V_{L1}$.
Figure 13:
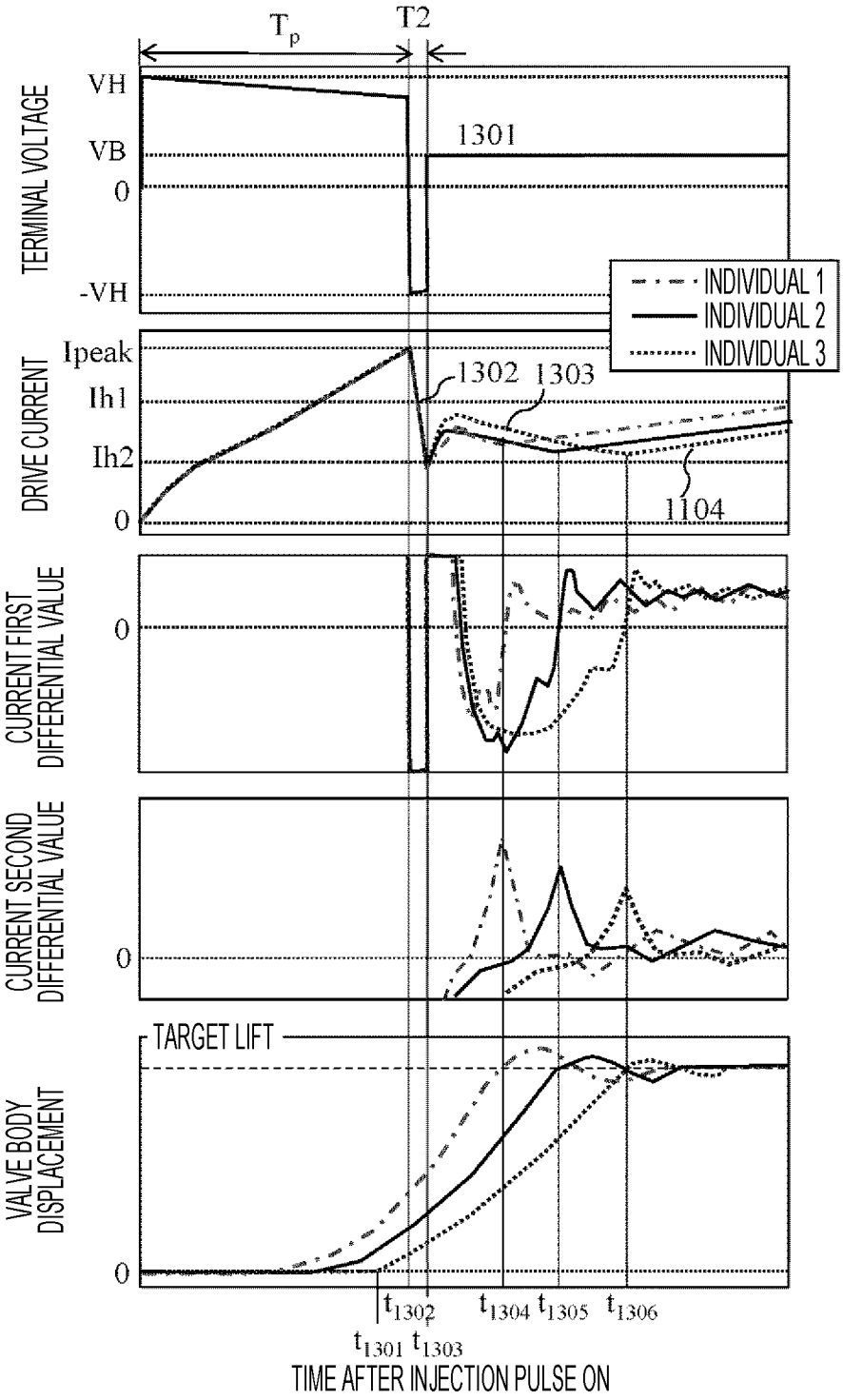
FIG. 13 is a diagram illustrating the relationship between the terminal voltage $V_{inj}$, the drive current, a first differential value of current, the second differential value of current, and the valve body displacement of three fuel injection devices of different valve opening start and valve opening finish timings under the condition that the valve body according to an example of the present invention reaches the target lift and the time.
Figure 14:
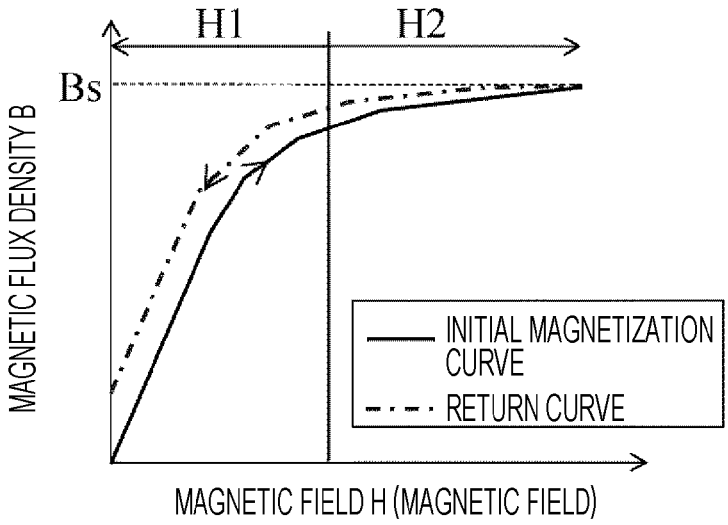
FIG. 14 is a diagram illustrating an initial magnetization curve and a return curve of magnetization curves (BH curves) of a magnetic material used in a magnetic circuit in Example 1.
Figure 15:
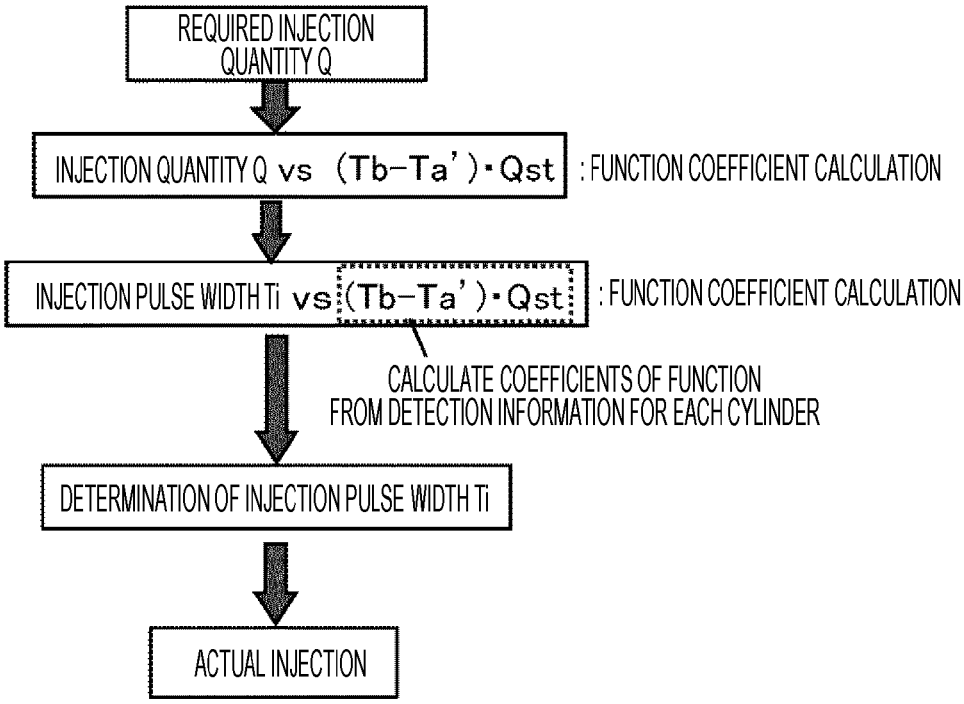
FIG. 15 is a diagram illustrating a flow chart of a correction method of the injection quantity of each cylinder in a region of a small injection pulse width Ti to be an intermediate lift region where the valve body according to Example 1 of the present invention does not reach the target lift.
Figure 16:
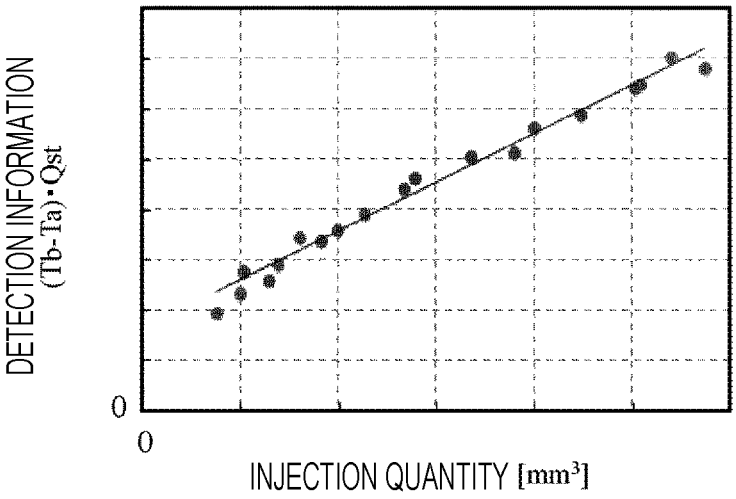
FIG. 16 is a diagram illustrating the relationship between the detection information (Tb−Ta')·Qst determined from the injection quantity of each cylinder and the valve closing finish timing Tb, valve opening start timing Ta', and a flow rate Qst (hereinafter, called a static flow) per unit time injected from the fuel injection device when the injection pulse width Ti is changed under the condition of a certain fuel pressure in Example 1 of the present invention.
Figure 17:
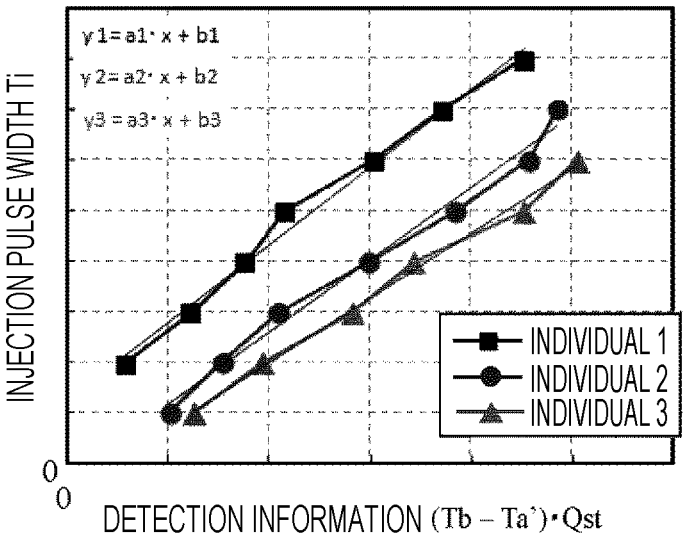
FIG. 17 is a diagram illustrating the relationship between the detection information and the injection pulse width Ti of individual fuel injection devices 1, 2, 3 of each cylinder according to Example 1 of the present invention.
Figure 18:
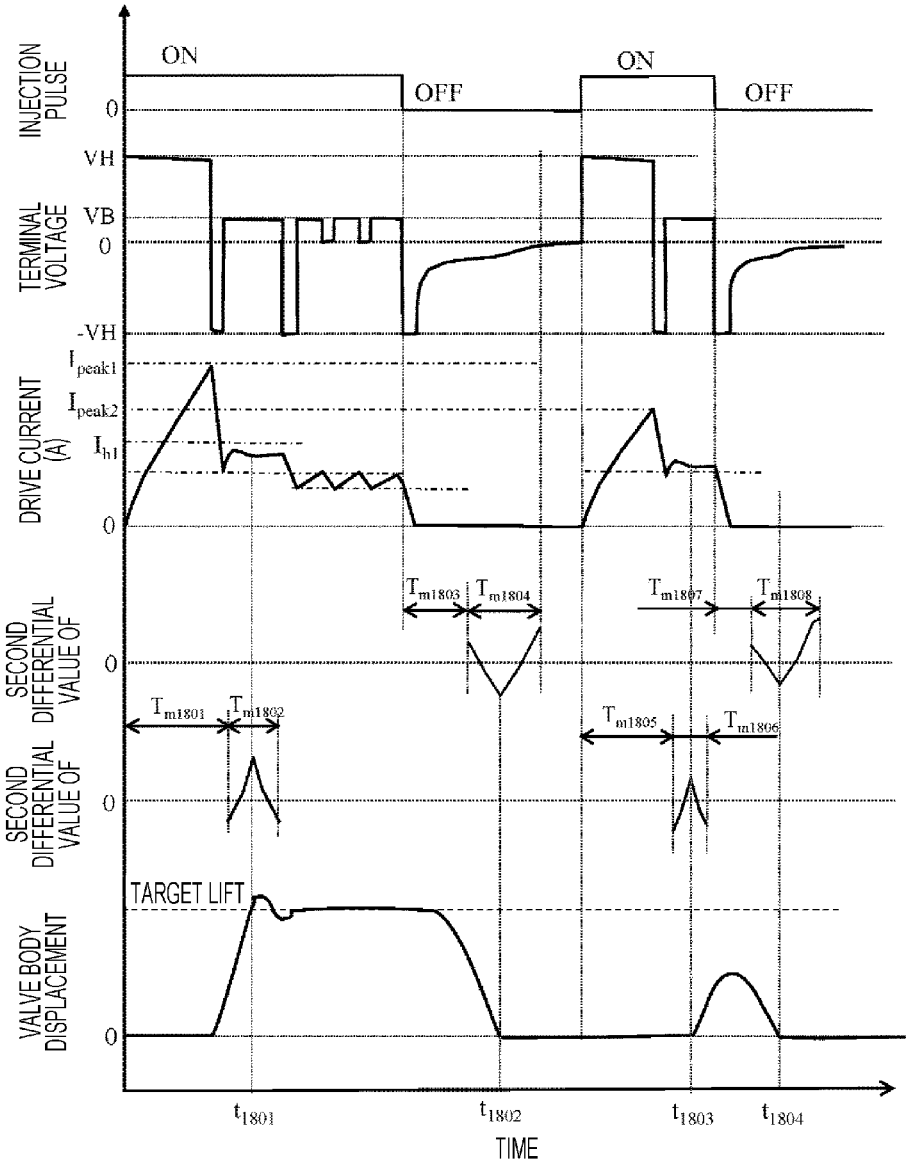
FIG. 18 is a diagram illustrating the relationship between the injection pulse width Ti, the drive current, the terminal voltage $V_{inj}$, a second differential value of the voltage $V_{L1}$, a current, that is, a second differential value of a voltage $V_{L2}$, and the valve body displacement under the condition that the injection performed during one intake and exhaust stroke in Example 1 of the present invention is divided and the time.

To decrease the minimum injection quantity that can be controlled by the ECU 120, it is necessary to increase the region where the injection quantity of fuel increases linearly with an increasing injection pulse width Ti or to correct the injection quantity of a nonlinear region where the relationship between the injection pulse width Ti smaller than point 404 and the injection quantity is not linear. With the general drive current waveform as illustrated in FIG. 3, the bound of the valve body 114 caused by collision of the needle 102 and the fixed core 107 is large and nonlinearity is generated in a short injection pulse width Ti region up to point 404 by starting a valve closing operation while the valve body 114 bounds and the nonlinearity leads to worsening of the minimum injection quantity. Therefore, to improve nonlinearity of injection quantity characteristics under the condition that the valve body 114 reaches the target lift, it is necessary to reduce the bound of the valve body 114 generated after the target lift position is reached. Because of variations of behavior of the valve body 114 due to dimensional tolerance, the timing when the needle 102 and the fixed core 107 come into contact is different from fuel injection device to fuel injection device and the collision speed of the needle 102 and the fixed core 107 varies and thus, the bound of the valve body 114 varies from fuel injection device to fuel injection device, increasing individual variations of the injection quantity. Subsequently, FIGS. 5 to 13 will be described. FIG. 5 is a diagram showing the relationship between the injection pulse width Ti and individual variations of the injection quantity caused by component tolerance of the fuel injection device. FIG. 6 is a diagram showing the relationship of displacements of the valve body 114 in individual variations of the injection quantity in FIG. 5 and the relationship between the displacement of the valve body 114 and the time for each injection pulse width. FIG. 7 is a diagram showing the relationship of the injection pulse width output from the drive device, the drive current, the displacement of the valve body 114, and the needle displacement and the relationship of the time. In the diagram of the displacement of the valve body in FIG. 7, individuals of the same valve opening start timing and different valve closing finish timing and the displacement of the valve body in a conventional fuel injection device that does not perform a preliminary operation are recorded. FIG. 8 is a diagram showing details of the drive device 121 and ECU (engine control unit) 120 of the fuel injection device. FIG. 9 is a diagram showing the relationship between the injection pulse width Ti, the drive current, a current differential value, a current second differential value, the valve body displacement, and the needle displacement of three fuel injection devices having different operation timing of the valve body 114 due to variations in dimensional tolerance in an example of the present invention and the time. FIG. 10 is a diagram showing the relationship between the injection pulse, the drive current supplied to the fuel injection device, operation timing of switching elements 805, 806, 807 of the drive device, a terminal voltage of the solenoid 105, the displacements of the valve body 114 and the needle 102, and needle acceleration in an example of the present invention and the time. FIG. 11 is a diagram showing the drive current supplied to the solenoid 105 and the relationship among the displacements of three individual valve bodies 1, 2, 3 of different valve closing behavior due to variations in dimensional tolerance of a fuel injection device 840, an enlarged view of a voltage $V_{L1}$, and a second differential value of the voltage $V_{L1}$. FIG. 12 is a diagram showing a correspondence among the displacement (called a gap x) between the needle 102 and the fixed core 107 according to an example of the present invention, a magnetic flux φ passing through a suction surface between the needle 102 and the fixed core 107, and a terminal voltage Vin of the solenoid 105. FIG. 13 is a diagram showing the relationship between the terminal voltage $V_{inj}$, the drive current, a current first differential value, the current second differential value, and the valve body displacement of three fuel injection devices of different valve opening start and valve opening finish timings under the condition that the valve body according to an example of the present invention reaches the target lift and the time. FIG. 14 is a diagram showing an initial magnetization curve and a return curve of magnetization curves (BH curves) of a magnetic material used in a magnetic circuit in Example 1. FIG. 15 is a diagram showing a flow chart of a correction method of the injection quantity of each cylinder in a region of a small injection pulse width Ti to be an intermediate lift region where the valve body does not reach the target lift. FIG. 16 is a graph showing detection information (Tb−Ta')·Qst determined from the injection quantity of each cylinder, valve closing finish timing Tb, valve opening start timing Ta', and a flow rate Qst (hereinafter, called a static flow) per unit time injected from the fuel injection device 840 when the injection pulse width Ti is changed under the condition of a certain fuel pressure. FIG. 17 is a diagram showing the relationship between the detection information and the injection pulse width Ti of individual fuel injection devices 1, 2, 3 of each cylinder. FIG. 18 is a graph showing the relationship between the injection pulse width Ti, the drive current, the terminal voltage $V_{inj}$, a second differential value of the voltage $V_{L1}$, a current, that is, a second differential value of a voltage $V_{L2}$, and the displacement of the valve body 114 under the condition that the injection performed during one intake and exhaust stroke is divided and the time.

First, using FIGS. 5 and 6, the relationship between the injection quantity of each injection pulse width Ti and the displacement of the valve body 114 and the relationship between individual variations of the injection quantity and the displacement of the valve body 114 will be described. Individual variations of the injection quantity are caused by the influence of dimensional variations due to component tolerance of a fuel injection device, aging, variations of environmental conditions, that is, variations of the current value supplied to the solenoid 105 caused by individual variations of the fuel pressure supplied to the fuel injection device, the battery voltage source of a drive device, and the voltage value of a step-up voltage source, changes of the resistance value of the solenoid 105 with temperature changes and the like. If the total cross section of a plurality of injection holes determined by the diameter of the injection hole 119 and the pressure loss from the seat portion of the valve body 114 to the injection hole entrance are equal, the injection quantity of fuel injected from the injection hole 119 of the fuel injection device is determined by the cross section of the channel between the valve body 114 and the valve seat 118 through which fuel in the fuel seat portion determined by the displacement of the valve body 114 flows. FIG. 5 is a diagram showing an individual $Q_u$ of a larger injection quantity and an individual $Q_l$ of a smaller injection quantity for an individual $Q_c$ having the design median value of the injection quantity in a region of a small injection pulse width when a fixed fuel pressure is supplied to the fuel injection device.

Using FIGS. 5 and 6, the relationship between the injection quantity in each injection pulse width Ti of the individual $Q_c$ having the design median value of the injection quantity under the condition of a certain injection pulse width $t_{51}$ and the displacement of the valve body 114 will be described. The displacement of the valve body 114 under the condition of point 501 of a small injection pulse width Ti is a solid line 501, the injection pulse width Ti is turned off before the valve body 114 reaches the target lift, the valve body 114 starts to close, and the trajectory of the valve body 114 is a parabolic motion. Next, at point 502 where the injection quantity is larger than an alternate long and short dash line 530 extrapolated from a linear region where the relationship between the injection pulse width Ti and the injection quantity is substantially linear, the displacement of the valve body 114 is larger than a solid line 601 and as indicated by an alternate long and short dash line 602, a valve closing operation is started before the valve body 114 reaches the target lift position and like the solid line 601, a trajectory of a parabolic motion is obtained. Compared with the solid line 601, energy supplied to the solenoid 105 is larger for the alternate long and short dash line 602 and thus, the valve closing lag time increases and as a result, the injection quantity also increases. Next, at point 503 where the injection quantity is smaller than the alternate long and short dash line 530, the valve body 114 starts to close in the timing when the bound of the needle is the largest after the needle 102 collides against the fixed core 107 and thus, a trajectory shown as an alternate long and two short dashes line 603 is obtained and the valve closing lag time is shorter than the condition of the alternate long and short dash line 602 and as a result, compared with point 502, the injection quantity at point is 503 is smaller. Also, the displacements of the valve body 114 at points 532, 501, 531 of the individuals $Q_u$, $Q_c$, $Q_l$ in the injection pulse width Ti at $t_{51}$ in FIG. 5 are shown as lines 606, 605, 604 respectively. If the injection pulse width 601 in the timing $t_{51}$ is input into the drive circuit, the timing when the needle 102 collides against the valve body 114 after the injection pulse is turned on, that is, the valve opening start timing of the valve body 114 varies like $t_{61}$, $t_{62}$, $t_{53}$ under the influence of individual differences of dimensional tolerance of the fuel injection device 640. If the same injection pulse width is provided to each cylinder, the individual 604 of earlier valve opening start timing has the largest displacement of the valve body 114 in the timing $t_{64}$ when the injection pulse width is turned off. Even after the injection pulse width is turned off, the valve body 114 continues to be displaced by kinetic energy of the needle 102 and a residual magnetic suction force due to a residual magnetic flux under the influence of an eddy current and the valve body 114 starts to close in the timing $t_{67}$ when the force in the valve opening direction by kinetic energy of the needle 102 and the magnetic suction force falls below the force in the valve closing direction. As shown in the displacements 604, 605, 606 of the valve body, individuals having later valve opening start timing have a larger lift quantity of the valve body 114 and the valve closing lag time after the injection pulse width is turned off until the valve body 114 finishes closing increases. Therefore, in an intermediate lift region where the valve body 114 does not reach the target lift, the injection quantity is determined by the valve opening start timing of the valve body 114 and the valve closing finish timing of the valve body 114 and thus, if individual variations of the valve opening start timing and the valve closing finish timing of the fuel injection device of each cylinder can be detected or estimated by the drive device, the lift quantity of the intermediate lift can be controlled and the injection quantity can be controlled in a stable manner even in an intermediate lift region by reducing individual variations of the injection quantity.

Next, the valve operation of individual fuel injection devices having equal valve opening start timing and different valve closing finish timing will be described using FIG. 7. FIG. 7 is a diagram showing the relationship of the injection pulse width output from the drive device, the drive current, the displacement of the valve body 114, and the needle displacement and the relationship of the time. Valve body displacements in FIG. 7 show individuals having the same valve opening start timing and different valve closing finish timing.

From FIG. 7, as shown in individuals 1, 2, 3 of the valve body displacements, due to individual variations of the fuel injection device, even if the valve opening start timing $t_{73}$ is the same, a differential pressure force acting on the valve body 114 and a load by the set spring 110 change from individual to individual under the influence of component tolerance and the maximum value of the displacement of the valve body 114 and valve closing finish timing change from individual to individual. In the individual 3 in which the differential pressure force acting on the valve body 114 is small, the displacement of the valve body 114 is large because the force in the valve closing direction is smaller than the individual 2 whose differential pressure force has a median value. As a result, the magnetic gap between the needle 102 and the fixed core 107 is small and even if the same current value is supplied, the magnetic suction force as a force in the valve opening direction increases and the valve closing finish timing is later, compared with $t_{75}$ of the individual 2, like $t_{76}$. On the other hand, in the individual 1 in which the differential pressure force is larger than in the individual 2, the displacement of the valve body 114 is small and the magnetic gap between the needle 102 and the fixed core 107 is large and thus, the magnetic suction force acting on the needle 102 decreases and the valve closing finish timing is earlier, compared with $t_{75}$ of the individual 2, like $t_{74}$. The influence of individual variations of the differential pressure force and magnetic suction force manifests itself in the valve closing finish timing and thus, by detecting, in addition to the valve opening start timing, the valve closing finish timing for each fuel injection device of each cylinder by the drive device, individual variations of the injection quantity can be detected.

In a conventional fuel injection device in which the needle 102 does not perform any preliminary operation before the valve body 114 starts to open, the valve body 114 starts to open in the timing $t_{77}$ when the difference between the magnetic suction force acting on the needle as a force in the valve opening direction and the sum of a load by the spring 110 and a differential pressure force due to fuel pressure acting on the valve body 114 as a force in the valve closing direction is small and then, as indicated by reference numeral 701, the displacement of the valve body 114 gradually increases. In a region where the displacement of the valve body 114 is small, the channel cross section of the seat portion of the valve body 114 is small and thus, the velocity of flow of fuel flowing through the seat portion becomes faster and the pressure loss of the fuel by passing through the seat portion is large. If the pressure loss of fuel near the seat portion is large, the velocity of flow of the fuel injected from the injection hole 119 slows down and thus, shearing resistance between the injected fuel and the air decreases and atomization of droplets of injected fuel is less likely to be promoted so that coarse particle sizes in which the particle size of injected fuel is large are more likely to be generated. According to a fuel injection device in Example 1 of the present invention, a region where the displacement of the valve body 114 can be reduced by valve opening being started by the valve body 114 after the collision of the needle 102 against the valve body 114 and therefore, the particle size of injected fuel can be decreased and coarse particle sizes are less likely to be generated. As a result, mixing of the injected fuel with the air is more likely to be promoted and coarse particle sizes are less likely and thus, the degree of homogeneity of the air fuel mixture in ignition timing is improved and further, adhesion of fuel to the piston and cylinder wall surfaces can be inhibited so that exhaust performance can be improved and particularly particulate matter (PM) and the number thereof (PN) can be inhibited. In addition, fuel consumption can be improved by being able to form an air fuel mixture of a high degree of homogeneity.

Next, using FIGS. 8, 9, and 10, the configuration of a drive device for a fuel injection device in Example 1 of the present invention and a detection method of the operation of the valve body 114 as a factor of individual variations of the injection quantity by the drive device for each fuel information device of each cylinder will be described. FIG. 8 is a diagram showing the configuration of the drive device to drive the fuel injection device. A CPU 801 is contained in, for example, the ECU 120 and fetches signals of a pressure sensor mounted on a fuel pipe upstream of the fuel injection device, an A/F sensor that measures an inflow air quantity into an engine cylinder, an oxygen sensor to detect the oxygen concentration in an exhaust gas discharged from an engine cylinder, a crank angle sensor and the like showing the state of an engine from various aforementioned sensors and calculates the width of the injection pulse to control the injection quantity injected from the fuel injection device and the injection timing in accordance with operating states of an internal combustion engine.

The CPU 801 also calculates the pulse width (that is, the injection quantity) of an appropriate injection pulse width Ti and the injection timing in accordance with operating conditions of an internal combustion engine and outputs the injection pulse width Ti to a drive IC 802 of the fuel injection device via a communication line 804. Then, the passage of current and the stop of current of switching elements 805, 806, 807 are switched by the drive IC 802 to supply a drive current to the fuel injection device 840.

The switching element 805 is connected between a high voltage source higher than a voltage source VB input into the drive circuit and the terminal on the high-voltage side of the fuel injection device 840. The switching elements 805, 806, 807 are constructed of, for example, FET or a transistor and can switch the passage/stop of current to the fuel injection device 840. A step-up voltage VH as a voltage value of the high voltage source is, for example, 60 V and is generated by stepping up the battery voltage by a step-up circuit 814. The step-up circuit 814 is constructed of, for example, a DC/DC converter or a coil 830, a switching element 831, a diode 732, and a capacitor 833. The switching element 831 is, for example, a transistor. A diode 835 is provided between a power supply side, terminal 890 of the solenoid 105 and the switching element 805 so that a current flows in a direction from the second voltage source to the solenoid 105 and an installation potential 815 and also a diode 811 is provided between the power supply side terminal 890 of the solenoid 105 and the switching element 807 so that a current flows in a direction from the battery voltage source to the solenoid 105 and the installation potential 815 so that while the current is passed to a switching element 808, no current flows from the ground potential 815 to the solenoid 105, the battery voltage source, and the second voltage source.

If the step-up circuit 814 is constructed of the coil 830, the switching element 831, the diode 832, and the capacitor 833, when the current is passed to the transistor 831, the battery voltage VB flows to the side of a ground potential 834, but if no current is passed to the transistor 831, a high voltage generated in the coil 830 is rectified through the diode 832 and a charge is accumulated in the capacitor 833. The voltage of the capacitor 833 is increased by repeating the passage/stop of current to the switching element 831 until the step-up voltage VH is reached. The passage/stop of current to the switching element 831 may preferably be configured to be controlled by the IC 802 or the CPU 801.

The switching element 807 is connected between the low voltage source VB and a high-voltage terminal of the fuel injection device. The low voltage source VB is, for example, a battery voltage and the voltage value thereof is about 12 to 14 V. The switching element 806 is connected between a terminal on the low voltage side of the fuel injection device 840 and the ground potential 815. The drive IC 802 detects the current value flowing to the fuel injection device 840 by resistors 808, 812, 813 for current detection and based on the detected current value, switches the passage/stop of current to the switching elements 805, 806, 807 to generate a desired drive current. From the viewpoint of improvement and reliability of current detection precision and heat generation inhibition, a shunt resistor as a high-precision resistor having a low resistance value and small individual variations of resistance value may preferably be used for the resistors 808, 812, 813 for current detection. Particularly compared with the resistance value of the solenoid 105 of the fuel injection device 840, the resistance value of the resistors 808, 812, 813 is sufficiently small and thus, the influence of losses generated in the resistors 808, 812, 813 on the current of the solenoid 105 is small. Diodes 809, 810 are provided to rapidly decrease the current supplied to the solenoid 105 by applying a reverse voltage to the solenoid 105 of the fuel injection device. The CPU 801 communicates with the drive IC 802 via the communication line 803 and can switch the pressure of fuel supplied to the fuel injection device 840 and the drive current generated by the drive IC 802 depending on operational conditions. Both ends of the resistors 808, 812, 813 are connected to A/D conversion ports of the IC 802 so that the voltage applied to both ends of the resistors 808, 812, 813 can be detected by the IC 802. Capacitors 850, 851 to protect signals of the input voltage and output voltage from a surge voltage or noise may preferably be provided on each of the Hi side (voltage side) and the ground potential (GND) side of the fuel injection device 840 and also a resistor 852 and a resistor 853 may preferably be provided downstream of the fuel injection device 840 in parallel with the capacitor 850.

Also, an active low-pass filter 861 constructed of an operational amplifier 821, resistors R83, R84, and a capacitor C82 is provided between a terminal 808 between the switching element 806 and the resistor 808 and the CPU 801 or the IC 802. An active low-pass filter 860 constructed of an operational amplifier 820, resistors R81, R82, and a capacitor C81 is provided between a terminal 881 between the resistor 852 and the resistor 853 provided downstream of the fuel injection device 840 and the CPU 801 or the IC 802. The CPU 801 or the IC 802 is provided with a terminal 871 connected to the ground potential 815 and a terminal y80 is provided to be able to detect the potential difference VL1 between the terminal 881 and the ground potential 815 by the CPU 801 or the IC 802 through the active low-pass filter 860. By setting the resistance value of the resistor 852 and the resistor 853 larger than that of the solenoid 105 of the fuel injection device 840, a current is efficiently supplied to the solenoid 105 when a voltage is applied to the fuel injection device 840. By setting the resistance value of the resistor 852 larger than that of the resistor 853, the voltage VL between the ground potential (GND) side terminal of the fuel injection device 840 and the ground potential can be divided. As a result, the detected voltage can be set to VL1 and the withstand voltage of the operational amplifier 821 and the A/D conversion port of the CPU 801 can be reduced and thus, the time of the voltage arising in the terminal voltage $V_{inj}$ and the voltage $V_L$ can be detected without needing a circuit necessary to input a high voltage.

Also, a terminal y81 may be provided to be able to detect the potential difference VL2 between a terminal 880 of the resistor 808 on the side of the fuel injection device 840 and the ground potential 815 by the CPU 801 or the IC 802 through the active low-pass filter 861. The CPU 801 is provided with a terminal y82 connected to the battery voltage VB so that the battery voltage VB can be monitored by the CPU 801.

Next, the detection method of the valve opening start timing of the valve body 114 in Example 1 of the present invention using FIG. 9. FIG. 9 is a diagram showing the relationship between the terminal voltage $V_{inj}$ of the solenoid 105 after the injection pulse width Ti of the three fuel injection devices 840 having different valve opening start timing and valve closing finish timing of the valve body 114 in an example of the present invention under the influence of variations of dimensional tolerance or the like, the current supplied to the solenoid 105, the current differential value, the current second differential value, the displacement of the valve body 114, and the displacement of the needle 102 and the time after the injection pulse is turned on. Changes of the current flowing through the solenoid 105 can be detected by the drive device by detecting the voltage $V_{L2}$.

From FIG. 9, the step-up voltage VH is applied to the solenoid 105 of the fuel injection device 840 until the current supplied to the solenoid 105 reaches the peak current $I_{peak}$. Then, the current value decreases like 901 by applying the step-up voltage VH in a negative direction or the voltage of 0 V to provide a voltage cutoff period T2 in which the current decreases for a fixed time. When, after the step-up VH is applied to the solenoid 105, the magnetic suction force acting on the needle 102 as a force in the valve opening direction exceeds a force by the spring 110 acting on the needle 102 as a force in the valve closing direction, the needle 102 is displaced in the valve opening direction to make a free running motion. Then, the valve body 114 starts to be displaced in timings $t_{91}$, $t_{92}$, $t_{93}$ when the needle 102 of each individual of the fuel injection devices 840 comes into contact with the valve body 114 and fuel is injected from the injection hole 119. The peak current $I_{peak}$ or the step-up voltage application time Tp and the voltage cutoff period T2 may be adjusted such that timing $t_{91}$ when a fixed voltage is supplied from the battery voltage source is before the time when the valve body 114 starts to open. In the fuel injection device 840 in the present invention, the force by the fuel pressure acting heretofore on only the valve body 114 now acts also on the needle 102 via the valve body 114 after the needle 102 collides against the valve body 114 after a free running operation and thus, the acceleration of the needle 102 changes significantly depending on the valve opening start timing of the valve body 114. The space between the needle 102 and the fixed core 107 is a main pathway through which a magnetic flux of a magnetic circuit constructed of the fixed core 107, the needle 102, the nozzle holder 101, the housing 103, and the solenoid 105 passes and thus, with changes in acceleration of the needle 102, the magnetic flux passing between the needle 102 and the fixed core 107 changes and also the induced electromotive force changes and the gradient of the current value changes. By detecting the timing when the second differential value of current takes the maximum value by ECU to detect the timing when the gradient of current, that is, the differential value of current changes, the valve opening start timing can be detected for the fuel injection devices 840 of each cylinder. In an interval from the timing $t_{91}$ when a fixed voltage is supplied from the battery voltage source to the valve opening start timing of the valve body 114, changes of the current over time are made smaller by not switching the passage/stop of current to the switching elements 805, 806, 807 to eliminate electrical changes of the drive current so that an effect of facilitating detection of acceleration changes caused by the collision of the needle 102 against the valve body 114 and detection precision of the valve opening start timing can be improved. Here, the terminal y81 to measure the voltage $V_{L2}$ may be provided in the CPU 801 to detect changes over time of the current flowing through the solenoid 105 by the drive device. The resistance value of the resistor 808 is known and based on the relation of the Ohm's law V=R·I (the voltage V is the product of the resistance R and the current I) the current flowing through the solenoid 105 can be detected by detecting the voltage $V_L$. Even if the resistance value of the resistor 808 changes due to individual variations or changes of the resistor temperature, according to the method of detecting the timing when the second differential value of current takes the maximum value, even if the value of the maximum value of the second differential value of the voltage $V_{L2}$ changes, the time when the voltage $V_{L2}$ is converted into a second differential value does not change and thus, the valve opening start timing can be detected more precisely and robustness of detection is high. The voltage $V_{L2}$ is connected to the A/D conversion port of the CPU 801 via the active low-pass filter 861. The valve opening start timing of the valve body 114 can be detected by detecting the time when the second differential value of current takes the maximum value by digital differentiation processing or digital filtering processing by the CPU 801 of a digital signal obtained by A/D conversion of the voltage $V_{L2}$. The drive device may preferably be caused to store the time after the injection pulse is turned on until the valve opening start timing is reached as a valve opening start lag time. In the valve opening start timing, if the current on the decrease changes to increase, the valve opening start timing can be detected as the time when the differential value of current exceeds a certain threshold. However, due to the configuration of the fuel injection device 840 and the drive device, even if the current on the decrease does not change to increase in the valve opening start timing, the valve opening start timing can precisely be detected by detecting the valve opening start lag time after the injection pulse is turned on until the second differential value of current takes the maximum value.

Though the voltage cutoff period T2 is not required, for the reason described below, changes of the current flowing through the solenoid 105 can be detected more easily by applying the step-up voltage VH in a negative direction or the voltage of 0 V.

If the voltage VL2 in a period when the injection pulse is turned on is detected exclusively by the drive device, an arrangement point of current caused by the passage/stop of current to the switching elements 805, 806, 807 may erroneously be detected as a second differential value of the voltage VL2. In such a case, the valve opening start timing when the needle 102 collides against the valve body 114 can be detected with precision by setting an acquisition period of the voltage $V_{L2}$ to a period 903 when a switching operation of the passage/stop of current to the switching elements 805, 806, 807 is not performed. Time t98*a* when the data acquisition of the period 903 is started may preferably be set later than a time t91 as the finish timing of the voltage cutoff period T2 and a time 98*b* when the data acquisition of the period 903 is stopped may be set earlier than a time t98 when the injection pulse is turned off. As a trigger to start the time t98*a*, the start of the injection pulse or the timing of the passage/stop of current to the switching elements 805, 806 may preferably be used. When the timing of the passage/stop of current to the switching elements 805, 806 is used as a trigger of the time t98*a*, information of the passage/stop of current to the switching elements 805, 806 may preferably be transmitted to the CPU 801 via the communication line 803.

When the start of the injection pulse is used as a trigger, the injection pulse is generated inside the CPU 801 and thus, the time of t98*a* can correctly be controlled. On the other hand, when the timing when the stop of current to the switching elements 805, 806 is used as a trigger of the time t98*a*, the period of valve opening start timing can reliably be acquired even if the resistance of the solenoid 105 changes due to changes of temperature thereof or a step-up voltage application time Tp until the peak current value $I_{peak}$ is reached varies due to variations of the step-up voltage VH and therefore, detection precision of the valve opening start timing can be improved.

To detect the valve opening start timing of the valve body 114, as described above, it is desirable to detect the second differential value of the voltage $V_{L2}$ to detect the current flowing to the solenoid 105 by the drive device. When second differentiation processing of a high degree of differentiation processing is performed, if noise or the like is superimposed on the voltage $V_{L2}$ before the processing is performed, the differential value may diverge when the differentiation processing is performed so that the timing of the maximum value after the second differentiation processing may erroneously be detected. To cope with this problem, the active low-pass filter 861 constructed of the operational amplifier 821, the resistors R83, R84, and the capacitor C82 may preferably be configured between the terminal 880 of the fuel injection device 840 and the terminal y81 of the CPU 801. Compared with noise superimposed on a voltage signal, changes of the current and the voltage $V_L$ of the solenoid 105 generated by changes of acceleration of the needle 102*a* after the needle 102*a* collides against the valve body 114 and the valve body 114 starts to open have lower frequencies. Therefore, by interposing the active low-pass filter 861 between the terminal 880 to measure the voltage $V_{L2}$ and the CPU 801, high-frequency noise generated in the current and the voltage $V_{L2}$ can be reduced so that the detection precision of the valve opening start timing can be improved.

A cutoff frequency $f_{c1}$ of the active low-pass filter 861 can be expressed as Formula (1) below using the values of the resistor R82 and the capacitor C81. Depending on the configuration of the fuel injection device and the drive device, the switching timing of the switching elements 805, 806, 807 and the switching element 831 to construct the second voltage source and the value of the second voltage source are different and as a result, the frequency of noise generated in the voltage is different. Therefore, the design values of the resistor R82 and the capacitor C81 may preferably be changed for each specification of the fuel injection device 840 and the drive device. When a low-pass filter is constructed of an analog circuit, there is no need for the CPU 801 to perform filtering processing to digitally remove high-frequency noise and thus, calculation loads of the CPU 801 can be reduced. Alternatively, a signal of the voltage $V_{L1}$ may directly be input into the CPU 601 or the IC 602 to digitally perform filtering processing. In this case, there is no need to use the operational amplifier 820, the resistor R81, the resistor R82, and the capacitor C81 as components of the analog low-pass filter and thus, the cost of the drive device can be reduced. As the low-pass filter described above, a primary low-pass filter made of a resistor connected to the terminal 880 and a capacitor arranged in parallel with the resistor may be used. When the primary low-pass filter is used, compared with the configuration using an active low-pass filter, two components of a resistor and the operational amplifier can be reduced and the cost of the drive device can be reduced. As a calculation method of the cutoff frequency of a primary low-pass filter, Formula (1) when an active low-pass filter is used can be used for calculation. As the configuration of a low-pass filter, a low-pass filter whose degree is secondary or more can be configured using coils and capacitors. In such a case, a low-pass filter can be configured without using any resistor and thus, compared with a case when an active low-pass filter or a primary low-pass filter is used, power consumption is advantageously lower.

$$f_{c1} = \frac{1}{2\pi R_{84} C_{82}} \tag{1}$$

For the detection of the current of the solenoid 105 to detect the valve opening start timing, the voltage across the resistor 813 may be measured. However, when the voltage across the resistor 813 is measured, compared with the voltage VL2 to measure the potential difference from the ground potential 815, the number of terminals to measure the voltage increases and also necessary A/D conversion ports increase, which leads to a cost increase of the drive device and increased processing loads of the CPU 801 or the IC 802 for A/D conversion of a voltage signal. As for the voltage $V_{L2}$, when the operation of the passage/stop of current to the switching element 831 is repeated at high speed for charge accumulation in the capacitor 833 to restore the voltage value of the step-up voltage VH as the output of the step-up circuit 814, high-frequency noise components may be superimposed on the voltage across the resistor 813 as a pathway on the power supply side of the fuel injection device 840. By setting the voltage $V_{L2}$ positioned on the ground potential side of the solenoid 105 of the fuel injection device 840 as the measuring point of the current, high-frequency noise generated upstream of the fuel injection device 840 is attenuated by the coil of the solenoid 105 so that the valve opening start timing can be detected with precision by using the maximum value of the second differential value of the voltage $V_{L2}$.

Next, using FIGS. 2, 8, and 10, the configuration of the drive circuit in Example 1 and the switching timing of a switching element to generate a drive current flowing to the fuel injection device under the condition to detecting the valve opening start timing will be described. FIG. 10 is a diagram showing the relationship between the injection pulse width output from the drive device, the drive current supplied to the solenoid 105, the operation timing of the passage (ON)/stop (OFF) of current to the switching elements 805, 806, 807 of the drive device, the terminal voltage $V_{inj}$ of the solenoid 105, the displacement of the valve body 114, the displacement of the needle 102, and the acceleration of the needle 102 and the time.

First, when the injection pulse width Ti is input into the drive IC 802 from the CPU 801 via the communication line 804 in timing t101, a current is passed to the switching elements 805, 806 and the step-up voltage VH is applied to both ends of the solenoid 105 to supply a drive current to the solenoid 105 so that the current increases rapidly. Then, a magnetic flux is formed inside the magnetic circuit following disappearance of an eddy current generated inside the magnetic circuit and a magnetic suction force acting on the needle 102 increases with the passage of the magnetic flux between the fixed core 107 and the needle 102. The needle 102 starts to lift in timing $t_{102}$ when the sum of the magnetic suction force acting on the needle 102 and a force of the return spring 112 as a force in the valve opening direction exceeds the load of the spring 110 as a force in the valve closing direction. At this point, with the movement of the needle 102 in the valve opening direction, shearing resistance (viscosity resistance) is generated between the needle 102 and the nozzle holder 101 and a shearing resistance force acts on the needle 102 in the valve closing direction, which is opposite to the direction of motion. However, the shearing resistance force acting on the needle 102 can be reduced by securing the passage cross section between the needle 102 and the nozzle holder 101. In addition, compared with the magnetic suction force acting on the needle 102 as a force in the valve opening direction, the shearing resistance force acting on the needle 102 is sufficiently smaller and thus, after the needle 102 starts to lift, the acceleration of the needle increases. If the passage of the current having been passed to the switching elements 805, 806 is stopped in timing $t_{103}$ when the drive current reaches the peak current value $I_{peak}$ provided to the ECU in advance, the current having flown on the pathway from the step-up voltage VH to the solenoid 105 and ground potential 815 no longer flows and thus, the voltage on the ground potential (GND) side of the fuel injection device 840 increases due to a back electromotive force caused by inductance of the fuel injection device 840 and a pathway of current is formed by the ground potential (GND) 815 of the drive device, the diode 809, the fuel injection device 840, the diode 810, the resistor 812, and the step-up voltage VH so that the current is fed back to the step-up voltage VH side of the step-up circuit 814, the step-up voltage VH in a negative direction is applied to both sides of the solenoid 105 of the drive device 840, and the drive current supplied to the solenoid 105 decreases rapidly like 1002.

By setting the timing t103 when the passage of current to the switching elements 805, 806 is stopped as the timing when the drive current exceeds the peak current value $I_{peak}$, even if the resistance value of the solenoid 105 changes due to temperature changes or the voltage value of the step-up voltage VH changes, energy needed to open the valve body 114 can be secured in a stable manner and changes of the valve opening start timing caused by variations of the time needed to reach the peak current value $I_{peak}$ accompanying environmental conditions changes can be converted into components of translation so that changes of the current waveform and valve operation timing can be inhibited.

The timing t103 when the passage of current to the switching elements 805, 806 is stopped may be set based on the step-up voltage application time Tp after the injection pulse Ti is turned on. The set resolution of the peak current $I_{peak}$ is determined by the resistance value and precision of the resistors 808, 813 used for current detection and thus, the minimum value of the resolution of $I_{peak}$ that can be set for the drive device is restricted by the resistance of the drive device. In contrast, when the timing t103 when the passage of current to the switching elements 805, 806 is stopped is controlled by the step-up voltage application time Tp, the set resolution of the step-up voltage application time Tp is not subject to restrictions of the resistance of the drive device and can be set in accordance with the clock frequency of the CPU 801 and thus, compared with a case when set based on the peak current $I_{peak}$, the time resolution can be made smaller and the timing when the step-up voltage application time Tp or the peak current value $I_{peak}$ is stopped can be corrected more precisely and therefore, the precision with which the injection quantity of the fuel injection device of each cylinder can be improved.

The drive device may be caused to store the time of the voltage cutoff period T2 in which the passage of current to the switching element 805, 806 is stopped in advance so that the time can be changed in accordance with operating conditions such as the fuel pressure. When the voltage cutoff period T2 ends, the current is passed to the switching elements 806, 807 and the battery voltage VB is applied to the solenoid 105. At this point, by setting the current value of a target value $I_{h1}$ of the drive current to a value larger than the current when the voltage cutoff period T2 ends like 1004, the switching element 806 continues to be turned on until the target current is reached. At this point, the drive current increases like 1003 by charges accumulated in the capacitors 851, 852 being discharged after the timing t105 when the current is passed to the switching elements 806, 807. Then, the current is supplied to the solenoid 105 by applying the battery voltage and the displacement of the needle 102 increases and then the current starts to decrease in timing t105 due to an induced electromotive force generated by the reduction of a magnetic gap and in timing t106, the needle 102 collides against the valve body 114. At this point, with the collision of the needle 102 against the valve body 114, a differential pressure force due to fuel pressure acting on the valve body 114 works on the needle 102 via the valve body 114 and thus, the acceleration of the needle 102 changes significantly. The induced electromotive force changes with the changing acceleration of the needle 102 and thus, the gradient of the drive current changes. In the timing when the valve body 114 starts to open after the collision of the needle 102 and the valve body 114, the switching elements 806, 807 are ON and thus, changes of the terminal voltage value $V_{inj}$ are small and the battery voltage VB lower than the step-up voltage VH is applied and so changes of the current accompanying the application of voltage are smooth and therefore, a slight change of the induced electromotive force caused by the collision of the needle 102 and the valve body 114 can be detected by the drive device as a change of the drive current. By rapidly decreasing the current from the peak current value $I_{peak}$ to make the current value in the valve opening start timing of the valve body 114 small, the magnetic field generated inside the magnetic circuit decreases and also the magnetic flux density decreases and thus, the magnetic flux density on the end face of the needle 102 on the fixed core 107 side is less likely to be saturated and as a result, changes of the acceleration of the needle 102 caused by the valve body 114 being started to open after the needle 102 collides against the valve body 114 can more easily be detected as current changes over time, that is, as changes of the gradient of the current. By setting the values of the peak current $I_{Peak}$ and the voltage cutoff period T2 such that the current is passed to the switching elements 806, 807 and the valve body 114 starts to open in a period in which the battery voltage VH is applied to the solenoid 105, the valve opening start timing of the valve body 114 can be detected with precision.

The displacements of the valve body 114 shown in FIG. 10 include profiles of displacement of the valve body 114 in cases when the fuel pressure supplied to the fuel injection device 840 is small, medium, and large. In the fuel injection device 840 in Example 1, the needle 102 is not subject to a force due to fuel pressure acting on the valve body 114 until the valve body 114 starts to open and thus, even if the condition of fuel pressure is different, the profile of the needle 102 before the needle 102 collides against the valve body 114 does not change and also the valve opening start timing $t_{106}$ of the valve body 114 does not change. Therefore, by detecting the valve opening start timing $t_{106}$ of the valve body 114 under certain conditions such as when the engine is started or during idling and causing the drive device to store detection information, the detection information of each cylinder stored in the drive device can be used even if operating conditions such as the fuel pressure changes. Therefore, the frequency of using the A/D conversion port of the drive device to convert an analog voltage signal of the voltage across the resistor 813 for drive current detection to detect the valve opening start timing or the potential difference VL2 between the resistor 808 and the ground potential 815 into a digital signal can be reduced and therefore, processing loads of the CPU 801 or the IC 802 can be reduced. By detecting the valve opening start timing under certain conditions of the fuel injection device 840 of each cylinder, as described above, detection precision can be secured even of operation conditions such as the fuel pressure change.

The CPU 801 is provided with the terminal y82 as an A/D conversion port to detect the voltage as a digital signal by the drive device after A/D conversion to monitor the voltage value of the battery voltage VB of the battery voltage source. The battery voltage VB drops due to operations of on-board devices connected to the battery voltage source and variations thereof are large. On-board devices include, for example, a cell motor used to start an engine, an air conditioning system such as an air conditioner, lights (head lights, brake lamps), and electric power steering. An alternator is configured to be started to charge the battery voltage source after the voltage drop. Therefore, the valve opening start timing may be detected by detecting the voltage VL2 or the voltage across the resistor 813 when the battery voltage VB monitored by the CPU 801 falls to a certain variation range or less of a certain voltage value set to the drive device. By adopting the above configuration, if the battery voltage VB changes due to operations of on-board devices and the timing when the battery voltage changes is close to the valve opening start timing under the condition of detecting the valve opening start timing, the possibility that the time when the second differential value of current takes the maximum value is shifted after the current is affected and varied can be inhibited so that the valve opening start timing can be detected in a stable manner.

The median value of the voltage value under the condition of detecting the valve opening start timing also changes due to degradation of the battery voltage source and thus, any voltage value may be configured to be settable by the CPU 801. Accordingly, even if the median value of the battery voltage VB may deteriorate with age when the battery voltage source is not used, the valve opening start timing can be detected with precision.

Compared with austenitic metals, ferritic magnetic materials used for members of the magnetic circuit of the fuel injection device 840 in Example 1 of the present invention and having a high saturation magnetic flux density have lower hardness and, thus the collision surface of the needle 102 against the valve body 114 and the collision surface of the needle 102 against the fixed core 107 may be plated. The need 102 collides against the valve body 114 after performing a valve operating operation at high speed without being subject to a force due to the fuel pressure and thus, if the total number of revolutions increases and the number of times of driving the fuel injection device 840 increases, the collision surface 210 of needle 102 and the valve body 114 may worn out. Particularly, if the degree of homogeneity of an air fuel mixture should be improved to inhibit the total amount of particulate matter (PM) containing soot and the number thereof (particulate number: PN), the method of dividing the fuel injection of one intake and exhaust stroke into a plurality of portions, but for the divided injection, compared with a case when the divided injection is not performed, the number of times of injection increases even if the traveling distance is the same and thus, the collision surface 210 is more likely to wear out. If worn out, the air gap 201 between the abutting surface 205 of the valve body 114 on the needle 102*a* and the collision surface 210 of the needle 102*a* increases and the moving distance necessary for the needle 102 to collide against the valve body 114 increases so that the valve opening start timing of the valve body 114 is later. By re-detecting the valve opening start timing for each predetermined period in accordance with the number of times of driving the fuel injection device 840, the time, or the value of a travel distance recorder mounted on a vehicle and updating information of the valve opening start timing of the fuel injection device 840 for each cylinder the drive device is caused to store, changes of the valve opening start timing due to wearing out of the collision surface can be coped with even if the number of times of driving the fuel injection device 840 is increased by performing the divided injection so that the injection quantity can be controlled with precision.

Under the condition that the current is passed to the switching elements 805, 806 and a step-up voltage VH in a positive direction is applied to the solenoid 105, using the step-up voltage VH, charges accumulated in the capacitor 833 decrease and the voltage value of the step-up voltage VH falls. At this point, an operation to restore the voltage value of the step-up voltage VH may be performed by repeating the passage/stop of current to the switching element 831 of the step-up circuit 814 at high frequencies for charge accumulation in the capacitor 833 may be performed to restore the voltage of the step-up voltage VH to the initial voltage value preset to the CPU 801 or the IC 802 when the voltage value of the step-up voltage VH falls below a set threshold voltage, but compared with the above changes of the voltage value, an influence of changes of an induced electromotive force caused by acceleration changes of the needle 102 caused by the start of the valve body 114 to open after the collision of the needle 102 against valve body 114 on the voltage VL2 and the voltage across the resistor 812 are smaller and thus, under the condition of applying the step-up voltage VH, it is difficult to detect acceleration changes of the needle 102 accompanying the start of the valve body 114 to open based on the voltage $V_{L2}$ or the voltage across the resistor 812. When an operation to restore the voltage value of the step-up voltage VH is performed, it is necessary repeat the passage/stop of current to the switching element 831 of the step-up circuit 814 at high frequencies and thus, high-frequency noise is generated by switching and noise is superimposed on the voltage VL2 or the voltage across the resistor 812 to detect the valve opening start timing of the valve body 114, which may adversely affecting the detection precision of the valve opening start timing.

From FIG. 9, the configuration in which the current is passed to the switching elements 805, 806 after supplying the injection pulse width Ti, the step-up voltage VH is applied to the solenoid 105, the step-up voltage VH in a negative direction is applied for a fixed time after the peak current value $I_{peak}$ is reached to cause the current value to fall rapidly like 901, a fixed voltage to the battery voltage VB is applied from the battery voltage source, and the valve body 114 reaches the target lift in the timing when the fixed voltage is supplied from the battery voltage VB may preferably be adopted.

Next, the detection method of a valve closing lag time as a time after the injection pulse is turned off until the valve body 114 is closed will be described.

To detect voltages changes over time generated in the voltage VL as a potential difference between the ground potential (GND) side terminal of the fuel injection device 840 and the ground potential 815 when the valve body 114 and the needle 102 close from a valve open state by the CPU 801 or the IC 802, the resistors 852, 853 are provided between the ground potential (GND) side terminal of the fuel injection device 840 and the ground potential 815. By setting the resistance value of the resistors 852, 853 larger than that of the solenoid 105, a current can flow to the solenoid 105 efficiently when the battery voltage VB or the step-up voltage VH is applied. Also, by setting the resistance value of the resistor 852 larger than that of the resistor 853, the voltage of VL1 as a potential difference between the resistor 853 and the ground potential 815 can be made smaller and the voltage value of the withstand voltage needed for the operational amplifier 821 and the A/D conversion port of the CPU 801 can be reduced and thus, voltages generated in the terminal voltage $V_{inj}$ and the voltage $V_L$ can be detected without needing circuits or elements needed for inputting a high voltage. The voltage VL1 obtained by dividing the voltage VL is input into the A/D conversion port provided with the CPU 801 or the IC 802 via the active low-pass filter 860. High-frequency noise components generated in the voltage VL1 can be reduced by passing a signal of the voltage VL1 through the active low-pass filter 860 and acceleration changes of the needle 102 generated at the instant when the valve body 114 comes into contact with the valve seat 117 after starting to close from a valve open state are detected as changes of the induced electromotive force through the voltage VL1, which is detected by the IC 802 or the CPU 802 as a digital signal. As a result, differentiation processing can be performed easily. At this point, a potential difference between the terminal y80 input into the A/D conversion port of the CPU 801 by passing through the active low-pass filter 860 and the ground potential 815 is called a voltage VL3.

Next, using FIGS. 2, 8, 11, and 12, the operation of the drive circuit in Example 1 and the detection principle of the valve closing finish timing to calculate the valve closing lag time as a time after the injection pulse is turned off until the valve body 114 comes into contact with the valve seat 118 as a factor of individual variations of the injection quantity of the fuel injection device 840 together with individual variations of the valve opening start timing of the valve body.

FIG. 11 is a diagram showing the drive current supplied to a solenoid 105 and the relationship among the displacement of the valve body 114 of three individuals 1, 2, 3 of different valve closing behavior due to variations in dimensional tolerance of the fuel injection device 840, an enlarged view of the voltage $V_{L1}$, and the second differential value of the voltage $V_{L1}$. FIG. 12 is a diagram showing a correspondence among the displacement (called a gap x) between the needle 102 and the fixed core 107, a magnetic flux φ passing through a suction surface between the needle 102 and the fixed core 107, and the terminal voltage $V_{inj}$ of the solenoid 105. Changes of the terminal voltage $V_{inj}$ over time also occur in the voltage $V_L$ and the voltage $V_{L1}$ and thus, changes of the voltage in FIG. 11 are equivalent to changes of the voltage $V_{L1}$ over time detected by the CPU 801. The needle 102*b* is in contact with the needle 102*a* on an end face 204 provided on the needle 102*a* and the needle 102*a* and the needle 102*b* can relatively be displaced.

From FIG. 11, when the injection pulse width Ti is turned off, the magnetic flux starts to disappear from the neighborhood of the solenoid 105 under the influence of an eddy current generated inside the magnetic material of the magnetic circuit and the magnetic suction force generated in the needle 102*a* and the needle 102*b* decreases and in the timing when the magnetic suction force falls below forces in the valve closing direction acting on the valve body 114, the needle 102*a*, and the needle 102*b*, the valve body 114 starts to close. The magnitude of the magnetic resistance of a magnetic circuit is inversely proportional to the cross section in each path through which a magnetic flux passes and permeability of a material and proportional to the length of a magnetic path through which a magnetic flux passes. Compared with magnetic material metals having a high saturation magnetic flux density, the permeability of the gap between the needle 102 and the fixed core 107 is that of the vacuum $\mu 0=4\pi\times 10-7$ [H/m] and is extremely smaller than that of magnetic material metals and thus, the magnetic resistance increases. Based on the relation B=μH, the permeability μ of a magnetic material is determined BH curve (magnetization curve) characteristics of the magnetic material and changes depending on the magnitude of an internal magnetic field of the magnetic circuit, but a low magnetic field in general leads to a low permeability and has a profile that the permeability increases with an increasing magnetic field and then decreases when a certain magnetic field is exceeded. When the valve body 114 is displaced from a valve open position, the gap x arises between the needle 102 and the fixed core 107 and thus, the magnetic resistance of the magnetic circuit increases, the magnetic flux that can be generated in the magnetic circuit decreases, and the magnetic flux that passes through the suction surface on the end face of the needle 102 on the fixed core 107 side also decreases. If the magnetic flux generated inside the magnetic circuit of the solenoid 105 changes, an induced electromotive force by the Lenz's law is generated. In general, the magnitude of the induced electromotive force in a magnetic circuit is proportional to the rate of change (first differential value of the magnetic flux) of the magnetic flux flowing through the magnetic circuit. If the number of windings of the solenoid 105 is N and the magnetic flux generated in the magnetic circuit is φ, as shown in Formula (2), the terminal voltage $V_{inj}$ of the fuel injection device is represented as the sum of a term of the induced electromotive force −Ndφ/dt and the product of a resistance component R of the solenoid 105 generated by the Ohm's law and a current i flowing to the solenoid 105.

$$V_{inj} = -N\frac{d\phi}{dt} + R \cdot i \tag{2}$$

When the valve body 114 comes into contact with the valve seat 118, the needle 102*a* separates from the needle 102*b* and the valve body 114 and a load by the spring 110 having acted on the needle 102*a* via the valve body 114 and the needle 102*b* and a force in the valve closing direction as a force due to fuel pressure acting on the valve body 114 no longer act and the needle 102*a* is energized in the valve opening direction by the force of the return spring 112. That is, the direction of the force acting on the needle 102*a* changes from the valve closing direction to the valve opening direction at the instant when valve closing of the valve body 114 is finished and the acceleration of the needle 102*a* changes.

The relationship between the gap x generated between the needle 102 and the fixed core 107 and the magnetic flux φ passing through the suction surface can be regarded as an approximately linear relation in an infinitesimal time. If the gap x increases, the distance between the needle 102 and the fixed core 107 increases and the magnetic resistance increases, but the magnetic flux that can pass through the end face of the needle 102 on the fixed core 107 side decreases and also the magnetic suction force decreases. The suction force working on the needle 102 can theoretically be derived by Formula (3). From Formula (3), the suction force working on the needle 102 is proportional to the square of a magnetic flux density B on the suction surface of the needle 102 and proportional to a suction area S of the needle 102.

$$F_{mag} = \frac{B^2 \cdot S}{2 \cdot \mu_0} \tag{3}$$

From Formula (2) and FIG. 12, there is a correspondence between the terminal voltage $V_{inj}$ of the solenoid 105 and the first differential value of the magnetic flux φ passing through the suction surface of the needle 102. The area of a space between the needle 102 and the fixed core 107 increases with changes of the gap x as a distance between the end face of the needle 102 on the fixed core 107 side and the end face of the fixed core 107 on the needle 102 side and thus, the magnetic resistance of the magnetic circuit changes and as a result, the magnetic flux that can pass through the suction surface of the needle 102 changes and therefore, the gap x and the magnetic flux φ can be considered to be in an approximately linear relation in an infinitesimal time. The area of the space between the needle 102 and the fixed core 107 is small under the condition that the gap x is small and thus, the magnetic resistance of the magnetic circuit is small and the magnetic flux that can pass through the suction surface of the needle 102 increases. On the other hand, the area of the space between the needle 102 and the fixed core 107 is large under the condition that the gap x is large and thus, the magnetic resistance of the magnetic circuit is large and the magnetic flux that can pass through the suction surface of the needle 102 decreases. From FIG. 12, the first differential value of the magnetic flux is in a correspondence with the first differential value of the gap x. Further, the terminal voltage $V_{inj}$ and the first differential value of the voltage $V_{L2}$ correspond to the second differential value of the magnetic flux φ and the second differential value of the magnetic flux 9 corresponds to the second differential value of the gap x, that is, the acceleration of the needle 102. Therefore, it is necessary to detect the second differential value of the terminal voltage $V_{inj}$ or the voltage $V_L$ to detect acceleration changes of the needle 102 and for this purpose, the voltage $V_L$ may be divided to input the voltage $V_{L2}$ into the A/D conversion port of the CPU 801.

From FIG. 11, if the injection pulse width Ti is stopped, that is, the passage of current to the solenoid 105 is stopped and the valve body 114 starts to be displaced from the maximum displacement position, the profile of the voltage $V_{L2}$ changes. In addition, the voltage VL2 changes in accordance with the displacement of the needle 102 moving by being linked to the valve body 114. The magnetic resistance increases with an increasing gap x between the needle 102 and the fixed core 107 and thus, a residual magnetic flux decreases and as a result, the voltage $V_{L2}$ asymptotically approaches 0 V.

With the needle 102*a* separating from the needle 102*b* and the valve body 114 at the instant when the valve body 114 comes into contact with the valve seat 118, a force in the valve closing direction having acted on the needle 102*a* via the needle 102*b* and the valve body 114 no longer acts and the needle 102*a* receives a force in the valve opening direction of the return spring 112 and the direction of the force acting on the needle 102*a* changes from the valve closing direction to the valve opening direction. Therefore, acceleration changes of the needle 102*a* can be detected by the minimum value of the second differential value of the voltage VL2.

After the injection pulse width Ti is stopped, the needle 102*a* and the needle 102*b* are displaced from the target lift position by being linked to the valve body 114 and the voltage $V_L$ at this point asymptotically approaches 0 V gradually from the value of the positive step-up voltage VH. When the needle 102*a* separates from the valve body 114 and the needle 102*b* after the valve body 114 is closed, a force in the valve closing direction having worked on the needle 102*a* via the valve body 114 and the needle 102*b*, that is, a load by the spring 110 and a force due to the fuel pressure disappear and a load of the return spring 112 works on the needle 102*a* as a force in the valve opening direction. When the valve body 114 reaches the valve closed position and the direction of the force acting on the needle 102*a* changes from the valve closing direction to the valve opening direction, the second differential value of the voltage VL having gradually decreased changes to increase. By detecting the minimum value of the second differential value of the voltage VL by the drive circuit, individual variations of the displacement of the valve body 114 can be detected with precision. The value of the voltage VL by the displacement of the needle 102*a* and the needle 102*b* from the valve open position changes depending on the resistance value determined by the wire diameter of the winding wire of the solenoid 105 and the number of windings, specifications of the magnetic circuit, the inductance determined by the quality of material (electric resistivity and BH curves) of the magnetic material, design value of the target lift of the valve body 114, and the current value in the timing when the injection pulse width Ti is stopped and so is subject to tolerance variations of the dimensions and setting values described above. The point of change of the acceleration of the needle 102*a* and the needle 102*b* as a physical quantity is detected in the detection method of the valve closing lag time based on the second differential value of the voltage $V_L$ and thus, the valve closing finish timing can be detected with precision without being subject to variations of the design value and tolerance and environmental conditions (current value) so that the valve closing lag time as a time after the injection pulse is turned off until the valve body 114 is closed can be detected.

To detect the time after the injection pulse width Ti is stopped until closing of the valve body 114 is finished, the terminal voltage $V_{inj}$ input into the IC 802 or the CPU 801 or the voltage $V_{L1}$ obtained by dividing the voltage VL is twice differentiated and the timing when the second differential value takes the minimum value is detected as the time when the valve body 114 finishes closing so that the correct valve closing finish timing can be detected. In the preprocessing of detecting the terminal voltage $V_{inj}$ or the voltage VL1 obtained by dividing the voltage VL, the active low-pass filter 860 constructed of the operational amplifier 820, the resistor R81, the resistor R82, and the capacitor C81 may preferably be configured between the terminal 881 of the fuel injection device 840 and the terminal y80 of the CPU 801. Changes of the terminal voltage $V_{inj}$, the voltage $V_L$, and the voltage $V_{L1}$ caused by changes of the acceleration of the needle 102*a* accompanying finishing of the closing of the valve body 114 have lower frequencies than noise superimposed on a voltage signal. Therefore, by interposing the active low-pass filter between the terminal 881 to measure the voltage $V_{L1}$ and the CPU 801, high-frequency noise generated in the terminal voltage $V_{inj}$, the voltage VL, and the voltage VL1 can be reduced so that the precision of detecting the valve closing finish timing can be improved.

A cutoff frequency $f_{c2}$ of the active low-pass filter 860 can be expressed like Formula (4) below using the values of the resistor R84 and the capacitor C82. Depending on the configuration of the fuel injection device and the drive device, the switching timing of the switching elements 805, 806, 807 and the switching element 831 to construct the second voltage source and the value of the second voltage source are different and as a result, the frequency of noise generated in the voltage is different. Thus, the design values of the resistor R84 and the capacitor C82 may preferably be changed for each specification of the fuel injection device 840 and the drive circuit. If the low-pass filter is configured as an analog circuit, there is no need for the CPU 801 to digitally perform filtering processing and thus, calculation loads of the CPU 801 can be reduced. Alternatively, a signal of the voltage $V_{L1}$ may directly be input into the CPU 601 or the IC 602 to digitally perform filtering processing. In this case, there is no need to use the operational amplifier 820, the resistor R81, the resistor R82, and the capacitor C81 as components of the analog low-pass filter and thus, the cost of the drive device can be reduced. As the low-pass filter described above, a primary low-pass filter made of a resistor arranged in series to the terminal 853 and a capacitor arranged in parallel with the resistor may be used. When the primary low-pass filter is used, compared with the configuration using an active low-pass filter, two components of a resistor and the operational amplifier can be reduced and the cost of the drive device can be reduced. As a calculation method of the cutoff frequency of a primary low-pass filter, Formula (4) when the active low-pass filter 860 is used can be used for calculation. The cutoff frequency fc2 may be configured to be different from the value of the active low-pass filter fc1 to detect the valve opening start timing.

As the configuration of a low-pass filter, a low-pass filter whose degree is secondary or more can be configured using coils and capacitors. In such a case, a low-pass filter can be configured without using any resistor and thus, compared with a case when an active low-pass filter or a primary low-pass filter is used, power consumption is advantageously lower.

$$f_{c2} = \frac{1}{2\pi R_{82} C_{81}} \tag{4}$$

The terminal voltage $V_{inj}$ may be used as a measuring point of the voltage to detect the valve closing finish timing, but high-frequency noise is generated in the terminal voltage Vi j by the switching element 831 of the step-up circuit of the fuel injection device 840. In the terminal voltage $V_{inj}$, the profile of the voltage after the injection pulse Ti is stopped is reversed in polarity from the voltage VL and the voltage 0 V is asymptotically approached from the step-up voltage VH in the negative direction. Therefore, to detect the valve closing finish timing, it is necessary to detect the maximum value of the second differential value of the terminal voltage $V_{inj}$ and for the purpose of precise detection thereof, the time constant of the low-pass filter needs to set large to reduce switching noise thus, an error may arise in the valve closing finish timing detected based on the second differential value of the terminal voltage $V_{inj}$ detected in the timing when the valve body 114 and the valve seat 118 come into contact. The error could lead to detection variations and constraints may be imposed to exert control of a minute injection quantity and therefore, as a location to measure the valve closing finish timing, it is desirable to measure, instead of the terminal voltage $V_{inj}$, the voltage $V_L$ as a potential difference between the ground potential side terminal of the fuel injection device 840 and the ground potential (GND).

A signal of the voltage $V_{L2}$ input into the CPU 801 or the IC 802 may be fetched by using the injection pulse width Ti as a trigger for a preset time after a fixed time passes from the stop of the injection pulse width Ti. By adopting such a configuration, a data point sequence of the voltage $V_{L2}$ input into the CPU 801 or the IC 802 can be reduced to a minimum necessary for detection of the valve closing finish timing so that the storage capacity of memory and calculation loads of the CPU 801 and the IC 802 can be reduced. If differential processing of voltage is performed in the timing when switched from the step-up voltage VH to the battery voltage VB or in the timing when the passage/stop of current to the switching elements 805, 806, 807 is repeated, that is, the timing when the voltage changes steeply, a high-frequency noise arises in processed data and thus, the valve closing finish timing may erroneously be detected if the valve closing finish timing when the valve body 114 and the valve seat 118 come into contact is detected based on the second differential value of the voltage $V_{L2}$ and the erroneous detection of the valve opening finish timing can be prevented by determining the period in which the voltage is detected by the CPU 801 or the IC 802.

A shunt resistor having a high-precision resistance value may preferably be used for a resistor 816 for voltage detection. In the drive device of the fuel injection device 840, the voltage across the resistors for voltage detection 812, 813, 808, 816 provided in the drive circuit is diagnosed by the IC 802 or the CPU 801 to measure the current or voltage, but if the resistance value is different from individual to individual from the resistance value preset to the IC 802 or the CPU 801, an error arises in the voltage value estimated by the IC 802 and the drive current supplied to the solenoid 105 of the fuel injection device 840 for the fuel injection device 840 of each cylinder, leading to increased variations of the injection quantity. If the terminal voltage $V_{inj}$ of the fuel injection device 840 is small in the valve closed position where the valve body 114 and the valve seat 118 are in contact, changes of the voltage value caused by acceleration changes of the needle 102 become relatively small and thus, a method of reducing the valve closing lag time by increasing the load of the spring 110 so that the valve closed position is reached under the condition of the high terminal voltage $V_{inj}$ of the solenoid 105 is effective. The force due to fuel pressure working on the valve body 114 and the needle 102 increases with the increasing fuel pressure supplied to the fuel injection device 840 and the valve closing lag time decreases. Individual variations of each cylinder of the valve closing finish timing when the valve body 114 and the valve seat 118 come into contact may preferably be detected, for example, under the operating condition of the same fuel pressure supplied to the fuel injection device 840 in each cylinder under a high fuel pressure. Due to the above effect, compared with a case of the condition of low fuel pressure, the residual magnetic flux generated in the magnetic circuit in the valve closing finish timing increases, the speed when the valve body 114 collides against the valve seat 118 increases, acceleration changes of the needle 102 caused by separation of the needle 102 from the valve body 114 at the instant when the valve body 114 and the valve seat 118 come into contact increase, and also changes of the induced electromotive force increase and thus, the valve closing finish timing can be detected more easily based on the second differential value of the terminal voltage $V_{inj}$ or the voltage $V_L$. Under the condition of a high fuel pressure supplied to the fuel injection device 840 and high engine loads, the injection quantity injected in one intake and exhaust stroke increases and the fuel pressure supplied to the fuel injection device 840 may vary under the influence of pressure pulsation of a pipe mounted upstream of the fuel injection device 840. In such a case, the valve closing finish timing may preferably be detected under the condition of low engine loads and the same injection quantity of each cylinder.

In addition to the CPU 801 and the IC 802, a microcomputer to detect the voltage $V_{L2}$ and perform data processing may be provided. When the voltage $V_{L1}$ and the voltage $V_{L2}$ are detected and data processing is performed by the CPU 801, it is necessary to A/D-convert data at a high sampling rate and perform differentiation processing and it may be difficult to detect the voltage VL1 or the voltage $V_{L2}$ and perform differentiation processing if interrupt processing when a signal is fetched from other sensors arises or under the condition of high calculation loads of the CPU 801. Therefore, by adding functions to perform masking processing and differentiation processing by detecting the voltage $V_{L1}$ and the voltage $V_{L2}$, calculate second differential values of the voltage $V_{L1}$ and the voltage $V_{L2}$, detect the timing when the second differential value of the voltage takes the minimum value and the maximum value as the valve closing finish timing and the valve opening start timing respectively, and store such information to a microcomputer provided in addition to the CPU 801, calculation loads of the CPU 801 and the IC 802 can be reduced and the valve opening finish timing can reliably be detected and thus, the correction precision of the injection quantity can be improved. The microcomputer is provided with a communication line that can mutually communicate with the CPU 801 or the IC 802 and the CPU 801 may be configured to be caused to store information of fuel pressure fetched by the CPU 801 from a pressure sensor and detection information of the valve closing finish timing sent from the microcomputer. By adopting such a configuration, the valve opening start/valve closing finish timing can be detected more reliably so that the injection quantity of each cylinder can be controlled more correctly.

As a first alternative means that detects the valve closing finish timing, a method of detecting an arrangement point of a leak current flowing to the coil 105 after the injection pulse Ti is stopped can be considered. If the injection pulse Ti is stopped from a state in which the drive current is supplied to the coil 105, no current is passed to the switching elements 805, 806, 807 and the step-up voltage VH in the negative direction is applied to the coil 105 so that the drive current decreases rapidly. The voltage having been generated by a back electromotive force disappears in the timing when the drive current reaches almost 0 A and no current flows to the pathway returning to the step-up voltage VH side so that the application of the step-up voltage in the negative direction automatically stops, but a slight leak current flows to the coil 105. At this point, the switching elements 805, 806, 807 are all turned off and thus, the leak current flows from the coil 107 to the ground potential 815 side via the resistor 852 and the resistor 853. To detect the leak current, therefore, a method of measuring the voltage across the resistor 852 or the resistor 853 or providing a shunt resistor on a pathway from the coil 107 to the ground potential 810 to measure the voltage across the shunt resistor can be considered. By passing a leak current from the resistor 808 to the ground potential 815 side by turning on the switching element 806 in the timing when the current reaches almost 0 A and the application of the step-up voltage VH in the negative direction is stopped, the voltage across the resistance 808, which is a shunt resistor of a high-precision resistance value, is measured and the arrangement point of the leak current can be detected by differentiating the voltage so that the valve closing finish timing of the valve body 114 can be detected.

As a second alternative means that detects the valve closing finish timing as the instant when the valve body 114 comes into contact with the valve seat 118, a method of detecting the valve closing finish timing by mounting an acceleration pickup on the injector of each cylinder or on the engine side fixing the injector and detecting an impact when the valve body 114 collides against the valve seat 118 or vibration caused by a water hammer generated by a sudden stop of the injection of fuel can be considered. In this case, as the mounting position of the acceleration pickup for detection of the valve closing finish timing of each cylinder with precision, a flat portion is provided in a housing-side surface cylindrical portion of the injector and the acceleration pickup is fixed thereto by pressing against the housing using mounting screws or the like so that vibration of the injector accompanying the valve closing finish timing can easily be detected. In the method using the acceleration pickup, while valve opening finish timing when the needle 102 collides against the fixed core 107 can simultaneously be detected, the acceleration pickup, an amplifier to amplify the output voltage thereof, and two wires of a voltage signal and a GND wire are needed for each injector. Also, for high-precision detection, it is necessary to increase the sampling rate to correctly perform data processing of high-frequency vibration waveforms obtained by the acceleration pickup and so a high-performance A/D converter is needed.

As a third alternative means that detects the valve closing finish timing as the instant when the valve body 114 comes into contact with the valve seat 118, a method of a using a pressure sensor provided on a rail pipe upstream of the injector for knocking detection or a sensor for knocking detection mounted on the engine can be considered. While fuel is injected from an injector, the pressure of the rail pipe decreases and a pump mounted upstream performs a pressurizing operation for a decrease in pressure to achieve the target fuel pressure. When the valve closing finish timing is reached after valve body 114 collides against the valve seat 118 from a valve open state, the pressure decrease of the fuel pipe upstream of the injector stops and thus, a method of detecting the valve closing finish timing by detecting an arrangement point of the pressure can be considered. The sensor for knocking detection is generally a vibration pickup that detects vibration and can detect vibration during valve closing accompanying the valve closing finish timing of the injector and caused by the collision of the valve body 114 against the valve seat 118 and vibration during valve opening caused by the collision of the needle 102 against the fixed core 107 so that the valve opening/closing finish timing can be detected. When the above method is used, the valve opening finish timing and the valve closing finish timing may be detected under the condition of low rpm of the engine and low loads such as during idling so that the valve opening/closing finish timing of other cylinders and the valve opening finish timing and the valve closing finish timing detected as vibration during combustion should not match.

In an engine, command values from an A/F sensor (air fuel ratio sensor) are normally detected by the CPU 801 and the injection pulse width is fine-tuned for each fuel injection device of each cylinder even under the same operating conditions. Under the condition of detecting the valve closing finish timing, fine-tuning of the injection pulse width based on command values from the A/F sensor may preferably be stopped to detect the valve opening start and valve closing finish timing under the condition that the same injection pulse width is supplied. In this manner, the influence of variations other than individual variations accompanying the valve operation of the fuel injection device 840 such as variations of inflow air when the valve closing start timing or the valve closing finish timing can be reduced so that variations of the valve opening start timing and the valve closing finish timing of the fuel injection device 840 can be detected for the fuel injection device of each cylinder with precision.

When the valve body 114 is closed from a valve open state by stopping the injection pulse width Ti, the switching operation of the drive device may preferably be controlled such that the passage/stop of current to the switching elements 805, 806, 807 of the drive device is not switched during a period from the start of closing by the valve body 114 or the needle 102 to the finish of closing by the contact of the valve body 114 with the valve seat 118. By adopting the above configuration, high-frequency measurement noise generated by switching of the switching elements 805, 806, 807 to the terminal voltage $V_{inj}$ or the voltage $V_L$ can be prevented from being superimposed on the terminal voltage $V_{inj}$ or the voltage $V_L$ of the fuel injection device 840 and thus, the precision of detecting the valve closing finish timing can be improved.

Next, the detection method of the valve opening finish timing as the timing when the valve body 114 reaches the target lift will be described using FIG. 13. FIG. 13 is a diagram showing the relationship between the terminal voltage $V_{inj}$, the drive current, the first differential value of current, the second differential value of current, and the displacement of the valve body 114 and the time after the injection pulse is turned on. In the drive current, the first differential value of current, the second differential value of current, and the displacement of the valve body 114 in FIG. 13, three profiles of each individual of the fuel injection devices 840 having different operation timing of the valve body due to variations of the force acting on the needle 102 and the valve body 114 caused by dimensional tolerance are recorded. From FIG. 13, the current is rapidly increased first by applying the step-up voltage VH to the solenoid 105 to increase the magnetic suction force acting on the needle 102. Then, the peak current value $I_{peak}$ or the peak current arrival time Tp and the voltage cutoff period T2 may be set such that the valve opening start timing of valve body 114 of each of the individuals 1, 2, 3 of the fuel injection device of each cylinder comes before timing t1303 when the drive current reaches the peak current value $I_{peak}$ and the voltage cutoff period T2 ends. Under the condition that the application of the battery voltage VB is continued and a fixed voltage value 1301 is applied, changes of the applied voltage to the solenoid 105 are small and thus, changes of the magnetic resistance accompanying a reduced gap between the needle 102 and the fixed core 107 after the needle 102 starts to lift from a valve closed state can be detected as changes of the induced electromotive force. When the valve body 114 and the needle 102 start to lift, the gap between the needle 102 and the fixed core 107 decreases and thus, the induced electromotive force increases and the current supplied to the solenoid 105 decreases gradually like 1303. Changes of the induced electromotive force accompanying gap changes decrease in the timing when the needle 102 reaches the fixed core 107, that is, in the timing when the valve body 114 reaches the target lift (hereinafter, called the valve opening finish timing) and the current value gradually increases like 1304. The magnitude of the induced electromotive force is affected by, in addition to the gap, the current value, but under the condition that a voltage lower than the step-up voltage VH like the battery voltage VB is applied, current changes are small and changes of the induced electromotive force due to gap changes can easily be detected based on the current.

To detect the timing when the valve body 114 reaches the target lift for the individuals 1, 2, 3 of each cylinder of the fuel injection device 840 described above as a point where the drive current starts to increase after decreasing, the current may be differentiated once to detect timings $t_{113}$, $t_{114}$, $t_{115}$ when the first differential value of current is zero as the timing of the finish of valve opening.

In a configuration of the drive unit and the magnetic circuit in which the induced electromotive force generated nu gap changes is small, the current may not necessarily decrease with gap changes, but the gradient of current, that is, the differential value of current changes when the valve opening finish timing is reached and thus, by detecting the maximum value of the second differential value of current detected by the drive device, the valve opening finish timing can be detected and therefore, the valve opening finish timing can be detected in a stable manner without being restricted by the magnetic circuit, inductance, resistance value, and current so that the precision of correction of the injection quantity can be improved.

In a configuration in which the valve body 114 and the needle 102 are integrated, the valve opening finish timing can be detected based on the same principle as that used for detection of the valve opening finish timing described for a structure in which the valve body 114 and the needle 102 are separate.

Here, BH characteristics of the magnetic material used for the magnetic circuit of the fuel injection device 840 in Example 1 are shown in FIG. 14. From FIG. 14, the BH curve of the magnetic material has a nonlinear relation of the magnetic field as an input value and the magnetic flux density and if an increasing magnetic field is applied to a magnetic material that is not magnetized, the magnetic material starts to be magnetized and the magnetic flux density increases until the saturation magnetic flux density Bs is reached. In this process, a region H1 where inclinations of the magnetic field and the magnetic flux density are large and a region H2 where inclinations of the magnetic field and the magnetic flux density are small exist. If the magnetic field is decreased after the saturation magnetic flux density Bs is reached, a curve different from the initial magnetization curve is drawn because a phenomenon in which the magnetic material is magnetized is temporally delayed. In the fuel injection device 840, magnetic fields in the positive direction are repeatedly provided in most cases and thus, a minor loop of hysteresis is frequently drawn between the initial magnetization curve and a return curve. Under the condition of detecting the valve opening start and valve opening finish timing, the needle 102 is caused to generate the magnetic suction force needed for the valve body 114 to be displaced by increasing the current until the peak current $I_{peak}$ is reached and then, the magnetic suction force working on the needle 102 may preferably be decreased by providing the period T2 in which the drive current is rapidly reduced before the valve opening start timing and the valve opening finish timing. Under the condition that the drive current supplied to the solenoid 105 of the fuel injection device 840 is, like the peak current value $I_{peak}$, higher than the current value needed to hold the valve body 114 in a valve open state, the current value supplied to the solenoid 105 increases and as shown in FIG. 14, the magnetic field and the magnetic flux density are frequently positioned in the region H2 with small inclinations and the magnetic flux density is close to saturation. In Example 1, the drive current in the valve opening start timing and the valve opening finish timing is decreased by causing the needle 102 to generate the magnetic suction force needed to open the valve and then applying the step-up voltage VH in the negative direction for the period T2 to rapidly decrease the current and thereby, compared with the inclinations of the magnetic field and the magnetic flux density under the condition of the peak current value $I_{peak}$, the inclinations of the magnetic field and the magnetic flux density can be made larger so that acceleration changes of the needle 102 in the timing when the valve body 114 starts to open can be made more conspicuous and easier to detect as the maximum value of the second differential value of the voltage VL2. In the valve opening finish timing, similarly, after the valve body 114 starts to be displaced, changes of the magnetic resistance accompanying a reduced gap between the needle 102 and the fixed core 107 can be made more conspicuous and easier to detect as changes of the induced electromotive force.

Thus, when the valve opening start or finish timing is detected, applying the step-up voltage VH in the negative direction or 0 V after increasing the current up to the peak current $I_{peak}$ is not required, but by doing so, the valve opening start or finish timing can be detected with higher precision.

When detecting the valve opening finish timing, only the current value in a certain period after a fixed time provided to the drive device passes from the time when the peak current value $I_{peak}$ is reached or the application of the step-up voltage VH in the negative direction ends may preferably be detected to perform the first differentiation processing of the current value. By adopting such a configuration, the current value changes rapidly in the timing when the step-up voltage VH is turned on or off and thus, erroneous detection in which the first differential value of current exceeds the threshold provided to the drive device in advance at a time that is not the valve opening finish timing can be inhibited so that the detection precision of the valve opening finish timing can be improved. Incidentally, the peak current value $I_{peak}$ and the period $T_{hb}$ in which the step-up voltage VH is applied may preferably be adjusted such that after the application of the step-up voltage VH in the negative direction is stopped, the target current value Ih1 preset to the IC 802 is not reached in a period in which a voltage value 1301 is supplied from the battery voltage source VB. Due to the above effect, if the drive current reaches the target current value Ih1 before the valve body 114 reaches the target lift, the drive device is controlled to maintain the current Ih1 constant and thus, the first differential value of current passes through the zero point repeatedly and the problem of being unable to detect changes of the induced electromotive force by the drive current can be solved.

Also, the switching elements 605, 606, 607 are controlled such that the current value is caused to reach a current 704 in FIG. 7 by applying the step-up voltage VH in the negative direction or stopping the application of voltage (application of 0 V) from a state in which a constant voltage value 1102 is applied and then, ON/OFF of the battery voltage VB is repeated to reach a current 703. The time after the injection pulse width Ti is turned on until the current value Ih1 is reached is different due to individual differences of the valve body 114 and variations of the valve opening finish timing accompanying changes of the fuel pressure. The magnetic suction force when the injection pulse width Ti is stopped depends heavily on the value of the drive current when the injection pulse width Ti is turned off and with an increasing drive current, the magnetic suction force increases and the valve closing lag time increases. Conversely, if the drive current when the injection pulse width Ti is turned off is small, the suction force decreases and the valve closing lag time decreases. Under the condition of detecting the valve opening finish, as described above, the current value in the timing when the injection pulse width Ti is turned off is desirably the same current 703 for each individual and thus, the timing when the step-up voltage VH in the negative direction is applied from the constant voltage value 1102 or the application of voltage is stopped may preferably be controlled by the time elapsed after the injection pulse width Ti is turned on or the time elapsed after the peak current value $I_{peak}$ is reached.

In the detection and estimation methods of variations of the injection quantity of each cylinder in Example 1, the drive device is caused to store the time after the injection pulse width Ti is applied until valve opening is finished as the valve opening lag time for the fuel injection device 840 of each cylinder, a deviation value from the median value of the valve opening lag time provided to the CPU 801 in advance is calculated, correction values of the injection pulse width Ti in the next injection and thereafter are calculated in accordance with the deviation value, and based on detection information of the valve opening lag time, the injection pulse width Ti is corrected for the fuel injection device 640 of each cylinder. By correcting the injection pulse width Ti based on the detection information of the valve opening lag time, individual variations of the injection quantity generated by variations of the valve opening lag time accompanying variations of tolerance can be reduced.

Subsequently, the control method when an intermediate lift operation is performed using information of the valve opening finish timing of the fuel injection device 840 detected in the present example will be described. Under the condition that the valve body 114 does not reach the target lift and an intermediate lift operation is performed, individual variations of the injection quantity are determined by variations of the valve opening start/valve closing finish timing. However, when the drive device and the fuel injection device are connected and the fuel injection device is not driven, an intermediate lift operation is not yet performed to detect the valve opening start timing and the valve closing finish timing and thus, if an intermediate lift operation is performed by outputting the injection pulse width to obtain the injection quantity calculated by the drive device, variations of the injection quantity relative to the assumed injection quantity may be too large for some fuel injection device of each cylinder so that fuel of the air fuel mixture may be in a rich or lean state and depending on the circumstances, there is the possibility of misfire. Therefore, before performing the intermediate lift operation at first, it is necessary to estimate the valve opening start timing by detecting the valve opening finish timing under the condition that the valve body 114 reaches the target lift. In such a case, the valve operating start timing may preferably be estimated by using the detection waveform of the valve opening finish timing for detection and multiplying the valve opening lag time for each fuel injection device of each cylinder the drive device is caused to store by a correction coefficient. To estimate the valve opening start timing with precision, it is necessary for the valve opening finish timing and the valve opening start timing to be highly correlated and the valve opening start timing may be estimated from information of the valve opening lag time under the condition of low fuel pressure under which a differential pressure force by the fuel pressure acting on the valve body 114 affecting the valve opening finish timing is small.

Next, the correction method of the injection quantity in an intermediate lift will be described using FIGS. 4, 15, 16, and 17. FIG. 15 is a diagram showing a flow chart of an injection quantity correction in a region of the injection pulse width smaller than point 402 in FIG. 4. FIG. 16 is a diagram showing the relationship between the injection quantity of each cylinder and detection information (Tb−Ta')·Qst determined from the valve closing finish timing Tb, valve opening start timing Ta', and a flow rate Qst (hereinafter, called a static flow) per unit time injected from the fuel injection device 840 when the injection pulse width Ti is changed under the condition of a certain fuel pressure. FIG. 17 is a diagram showing the relationship between detection information of the individuals 1, 2, 3 of the fuel information devices of each cylinder and the injection pulse width Ti.

When the intermediate lift operation is performed at first, the drive device has not yet obtained detection information of the valve opening start and valve opening finish timing during intermediate lift operation of each cylinder and thus, the valve closing finish timing and the valve opening start timing are estimated by multiplying the valve opening lag time and the valve closing lag time detected for the fuel injection device 840 of each cylinder under the condition that the valve body 114 reaches the target lift by the correction coefficient provided to the CPU 801 in advance, an actual injection period (Tb−Ta') in the intermediate lift calculated from the estimated valve opening start timing Ta' and valve closing finish timing Tb is calculated, and the injection pulse width Ti is corrected by a deviation value of the setting value provided to the CPU 801 in advance from the actual injection period (Tb−Ta') to perform the intermediate lift operation. From FIG. 15, under the condition of the actual injection period (Tb−Ta') as detection information and the valve body 114 at rest in the target lift position, the relation between the value (Tb−Ta')·Qst obtained by multiplying the flow rate Qst (hereinafter, called the static flow) per unit time injected from the fuel injection device 840 and the injection quantity is determined as a function and the function is preset to the CPU 801 of the drive device. From FIG. 16, the relation between the injection quantity and (Tb−Ta')·Qst can be determined as an approximately linear relation. From FIG. 17, detection information (Tb−Ta')·Qst in each injection pulse width is acquired and the coefficient of each cylinder is determined from the detection information based on the relation between the injection pulse width Ti and the detection information (Tb−Ta')·Qst. The relation between the detection information (Tb−Ta')·Qst and the injection pulse width Ti can be expressed as, for example, an approximately linear relation and coefficients a1, b1, a2, b2, a3, b3 of the functions of the individuals 1, 2, 3 can be calculated from the detection information. Coefficients can be calculated by detecting detection information of two points of different injection pulse widths Ti by the CPU 801. If the required injection quantity is calculated by the CPU 801 following the above flow chart, the injection quantity in an intermediate lift can be corrected by correcting the injection pulse width Ti for each cylinder so that a precise and minute injection quantity can be controlled.

Next, the control method of the fuel injection device 840 to obtain detection information in an intermediate lift will be described using FIG. 18. FIG. 18 is a diagram showing the relationship between the injection pulse width Ti, the drive current, the terminal voltage $V_{inj}$, the second differential value of the voltage $V_{L1}$, a current, that is, the second differential value of the voltage $V_{L2}$, and the displacement of the valve body 114 under the condition that the injection performed during one intake and exhaust stroke is divided into a plurality of times and the time. In a fuel injection system constructed of a fuel injection device and a drive device in Example 1 of the present invention, it is necessary to obtain the valve opening start timing and the valve closing finish timing under an intermediate lift condition a plurality of times under different fuel pressures and injection pulses Ti supplied to the fuel injection device. However, if detection information in an intermediate lift is not obtained, it is necessary to perform an intermediate lift operation by estimating the injection quantity in an intermediate lift from the valve opening finish timing and the valve closing finish timing under the condition that the valve body 114 reaches the target lift. In such a case, the deviation value from the target injection quantity increases, the ratio of sucked air and fuel (air fuel ratio) becomes a rich or lean state, a large quantity of unburned substance is emitted, exhaust performance deteriorates, and depending on the circumstances, there is the possibility of misfire. From FIG. 18, by dividing injection in one intake and exhaust stroke into a plurality of times to inject a fixed quantity under the condition that the valve body 114 for which variations of the injection quantity of each cylinder are known reaches the target lift and subsequent thereto or prior thereto injecting in an intermediate lift, the valve opening start timing and the valve closing finish timing during intermediate lift operation can be detected. At this point, an integral value of the displacement of the valve body 114 corresponds to the injection quantity and the injection quantity in an intermediate lift may be set to be smaller than the injection quantity under the condition that the valve body 114 reaches the target lift. Accordingly, most of the injection quantity in one intake and exhaust stroke is determined by the injection quantity under the condition that the valve body 114 reaches the target lift and thus, even if the injection quantity in an intermediate lift deviates from the target value, an effect of being able to inhibit misfire can be achieved.

Under the condition of an intermediate lift, injection to obtain detection information of the valve closing finish timing may be performed once or a plurality of times during one intake and exhaust stroke. By performing an intermediate lift operation a plurality of times in one intake and exhaust stroke and using different injection pulse widths Ti in the first intermediate lift operation and the second intermediate lift operation, a plurality of pieces of detection information of the valve closing finish timing to correct the injection quantity can be obtained at the same time. If detection information of the valve opening start timing is already obtained, there is no need to use the second injection waveform shown in FIG. 15 for the drive waveform in an intermediate lift and a current waveform appropriate for actual injection of the intermediate lift operation may preferably be used. According to the above method, detection information of the valve closing finish timing in an intermediate lift can be obtained while maintaining combustion stability and therefore, individual variations of the fuel injection device of each cylinder can be corrected under the intermediate lift condition in a short time and minute fuel injection can be performed.

According to a technique in Example 1, in addition to individual variations in an intermediate lift, when driven under the condition that the valve body 114 reaches the target lift, variations of the injection quantity of the injector of each cylinder generated by individual variations of the valve closing finish timing can be reduced. Individual variations of the valve opening finish timing after the injection pulse Ti is stopped and valve closing being started by the valve body 114 are caused by set spring loads and dimensional tolerance variations that determine the magnetic suction force. Thus, individuals whose valve closing finish timing is earlier have earlier valve closing start timing when the needle 102 separates from the fixed core 107 and the valve body 114 starts to close. The value obtained by integrating the flow rate per unit time in full lift during variation time of the valve closing finish timing corresponds to a variation quantity of the injection quantity due to individual variations of the valve closing finish timing and therefore, by detecting the valve closing finish timing, variations of the injection quantity from the valve open state until the valve body 114 reaches the valve closing finish timing can be derived by ECU. Also, the injection quantity injected until the valve body 114 reaches the target lift can be derived from the gradient of the valve body 114 estimated from information of the valve opening start timing and valve opening finish timing of the injector of each cylinder detected by ECU and therefore, together with variations of the injection quantity estimated from the valve closing finish timing, variations of the injection quantity of the injector of each cylinder can be detected by ECU and the injection quantity under the condition that the valve body 114 reaches the target lift can be corrected by correcting the injection pulse width Ti and the current setting value.

Further as shown in FIG. 18, after acquiring information of the valve opening start timing and the valve closing finish timing in the intermediate lift operation, divided injection in one intake and exhaust stroke may preferably be performed in the intermediate lift operation. If performed in the intermediate lift operation, compared with a case in which the valve body 114 reaches the target lift, the time after the injection pulse Ti is stopped until the valve body 114, the needle 102*a*, and the needle 102*b* are accelerated in the valve closing direction is short. Thus, the speed of the valve body 114, the needle 102*a*, and the needle 102*b* in the timing when the valve body 114 comes into contact with the valve seat 118 can be reduced and therefore, the time until the needle 102*a* makes a parabolic motion in the valve closing direction after the valve body 114 is closed and returns to the position in contact with the valve body 114 due to the return spring 112 can be shortened. If the injection pulse of the next injection in divided injection is applied while the needle 102*b* is in motion, the time after the injection pulse is turned on until the needle 102*b* collides against the valve body 114 is shortened due to, in addition to the magnetic suction force acting on the needle 102*b*, kinetic energy of the needle 102*b* and thus, the valve operating start timing of the valve body 114 becomes earlier, which is a factor of variations of the injection quantity between the first injection and the second injection. In Example 1 of the present invention, by causing the drive device to store the valve opening start lag time and the valve closing finish lag time for each fuel injection device of each cylinder, divided injection during one intake and exhaust stroke can be performed in an intermediate lift operation and as a result, the injection interval between the valve closing of the valve body 114 and the next injection can be shortened and therefore, the number of times of divided injection can be increased and the degree of homogeneity of the air fuel mixture can be improved with more precise injection quantity control and injection timing enabled. Compared with a case when driven after the valve body 114 reaches the target lift, the injection quantity is small in the intermediate lift and a penetration force of fuel spray of the injection fuel can be weakened and thus, adhesion of fuel to the piston and cylinder wall surface can be inhibited and particulate matter (PM) containing soot and the number of particulate matter (PN) can be reduced so that the exhaust gas can be made cleaner.

Example 2

Figure 19:
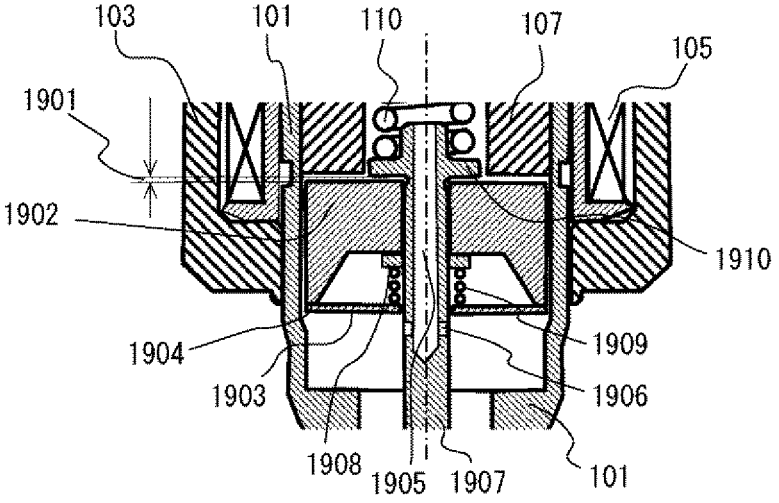
FIG. 19 is an enlarged view of a drive unit cross section in a valve closed state in which the valve body and a valve seat of the fuel injection device according to Example 2 of the present invention are in contact.
Figure 20:
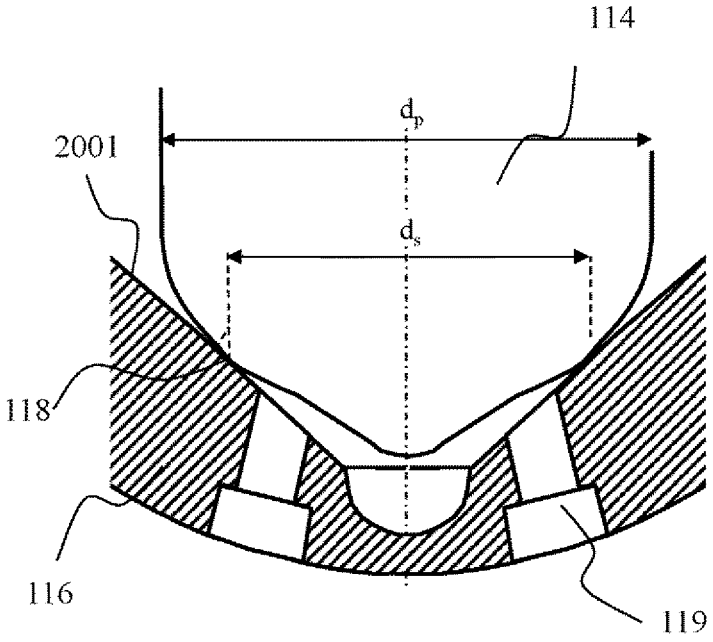
FIG. 20 is a diagram enlarging a longitudinal section of a valve body tip of the fuel injection device according to Example 2 of the present invention.
Figure 21:
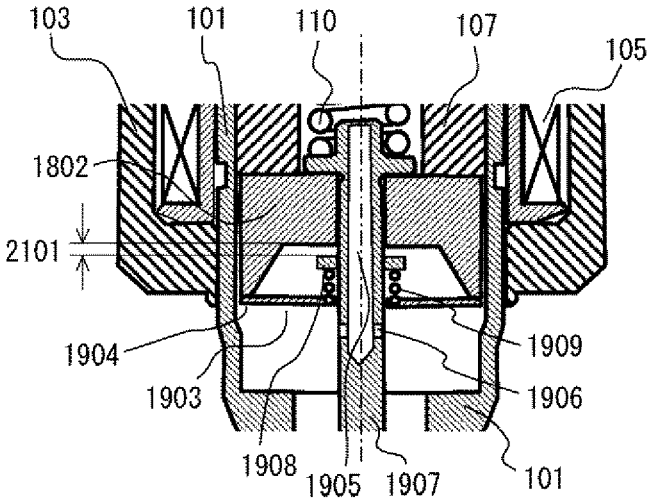
FIG. 21 is an enlarged view of the drive unit cross section when the valve body of the fuel injection device according to Example 2 of the present invention is in a valve open state.
Figure 22:
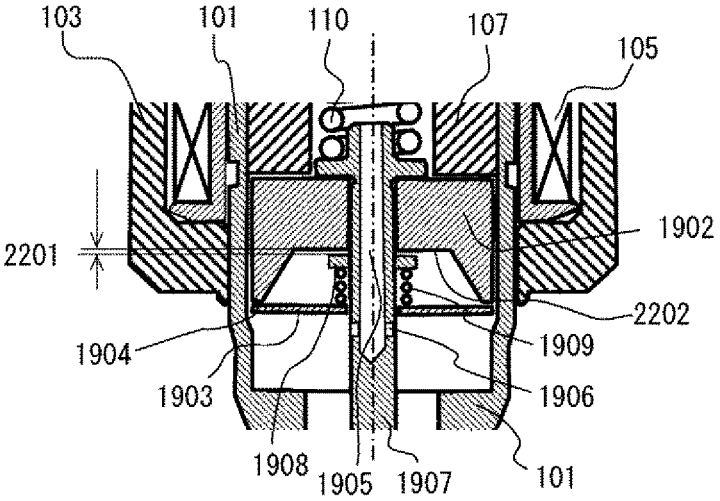
FIG. 22 is an enlarged view of the drive unit cross section at the instant when the valve body of the fuel injection device according to Example 2 of the present invention comes into contact with a valve seat 118 after starting to close from a valve open state.
Figure 23:
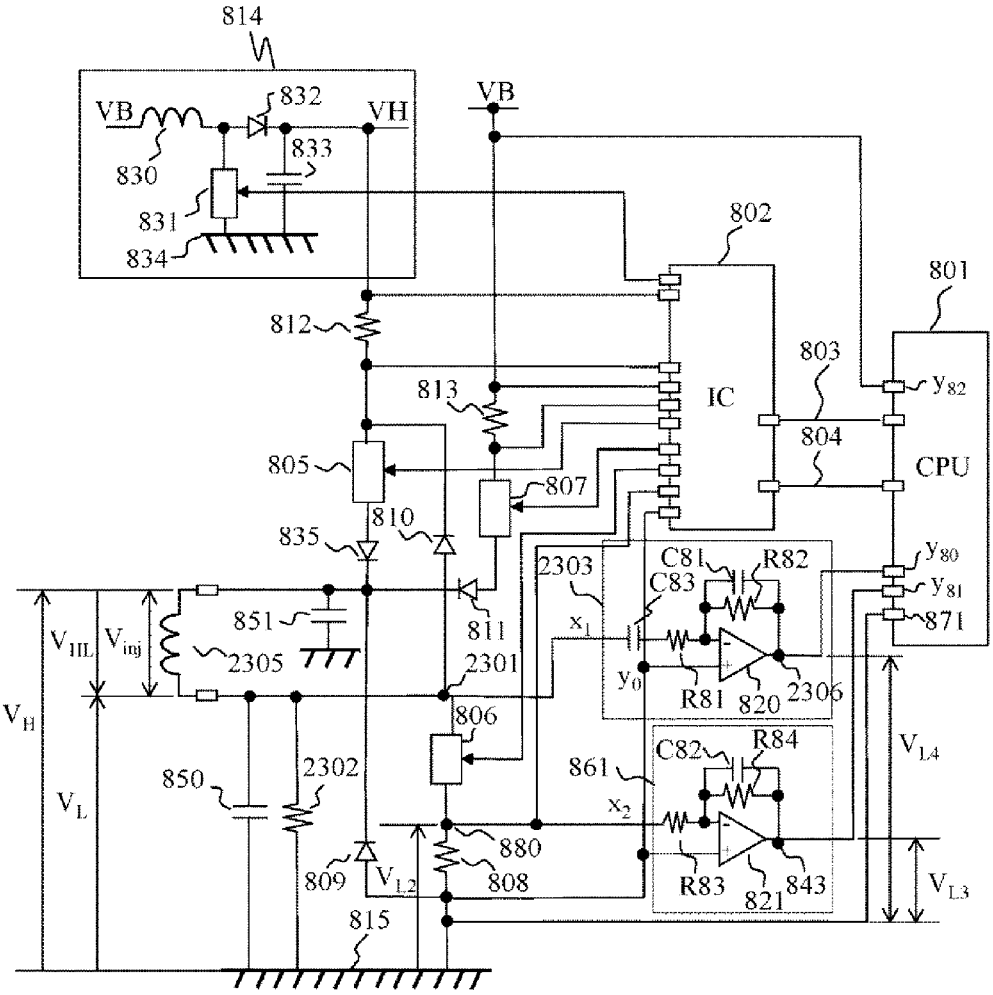
FIG. 23 is a diagram illustrating the configuration of the drive device according to Example 2 of the present invention.
Figure 24:
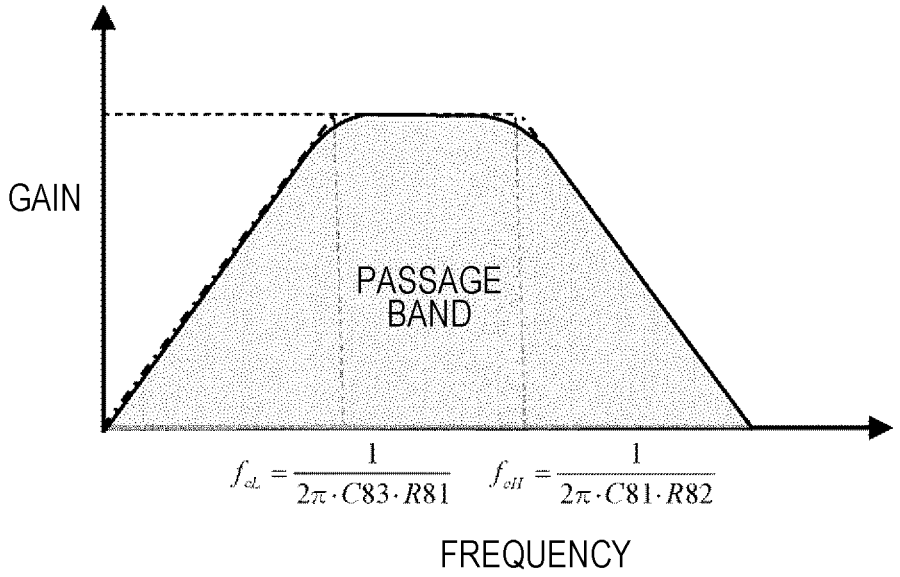
FIG. 24 is a diagram illustrating frequency gain characteristics of an analog differentiating circuit of the drive device in FIG. 23 according to Example 2 of the present invention.
Figure 25:
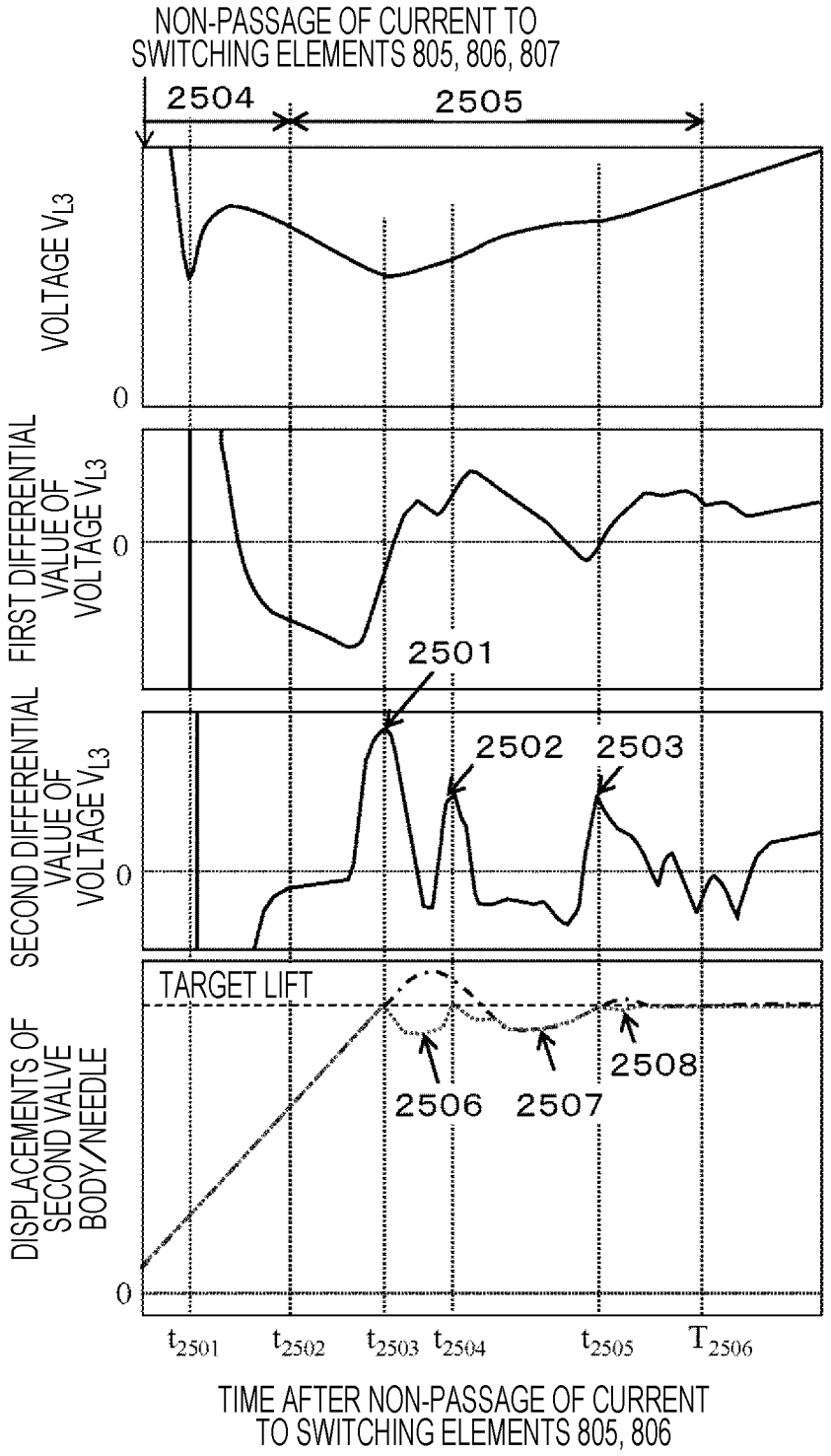
FIG. 25 is a diagram illustrating the relationship between a voltage $V_{L3}$, to detect changes of the current flowing to the solenoid according to Example 2 of the present invention, the first differential value of the voltage $V_{L3}$, the second differential value of the voltage $V_{L3}$, and displacements of a second valve body and a second needle and the time.
Figure 26:
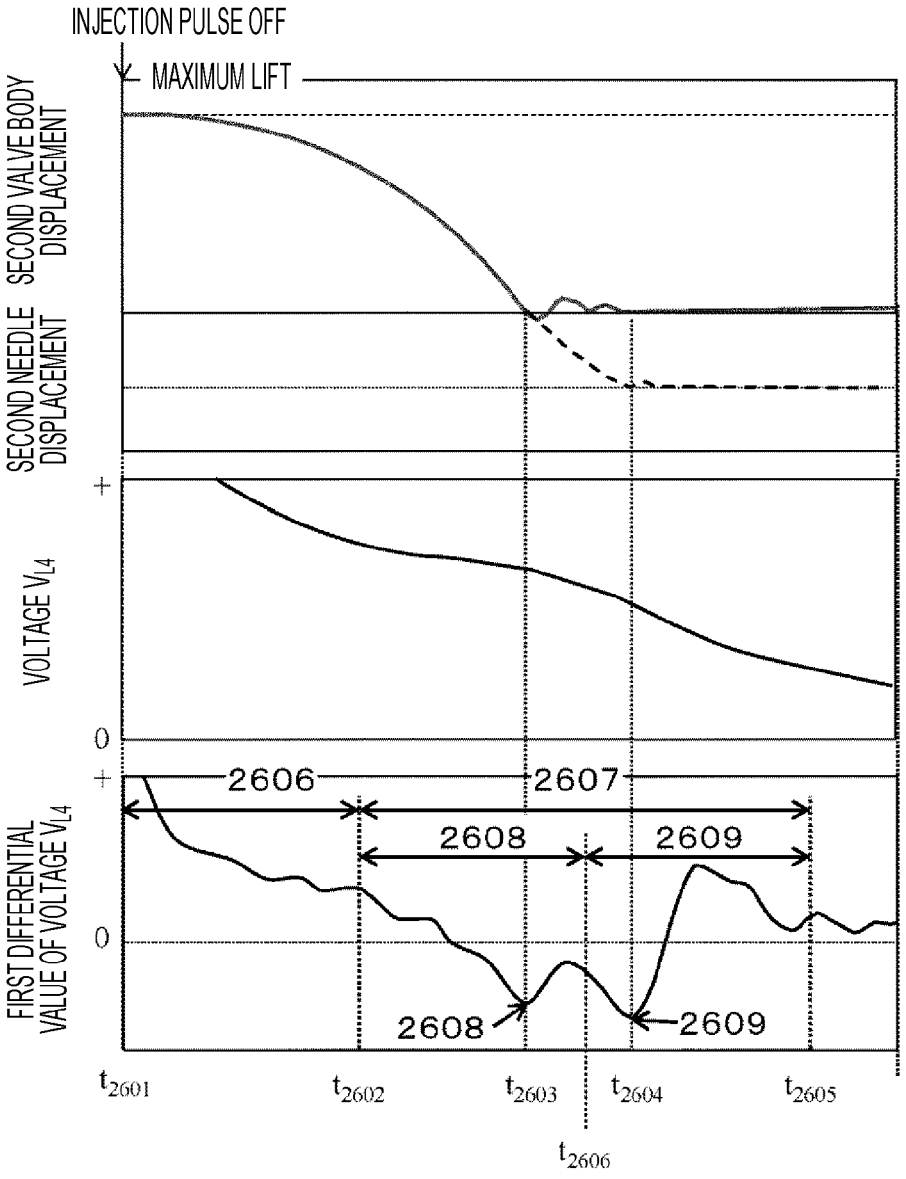
FIG. 26 is a diagram illustrating the relationship between the displacements of the second valve body and the second needle when closed from the maximum lift in an intermediate lift state in Example 2 of the present invention, a voltage $V_{L4}$ as a potential difference between a terminal to detect a voltage $V_L$ by CPU and a ground potential, and the second differential value of the voltage $V_{L4}$ and the time after the injection pulse is turned off.

Using FIGS. 19, 20, 21, 22, 23, 24, 25, and 26, the configuration of the fuel injection device and the drive device in Example 2 of the present invention will be described. FIG. 19 is an enlarged view of a drive unit cross section in a valve closed state in which the valve body and the valve seat of the fuel injection device according to Example 2 of the present invention are in contact. FIG. 20 is a diagram enlarging a longitudinal section of a valve body tip portion of the fuel injection device. FIG. 21 is an enlarged view of the drive unit cross section when the valve body of the fuel injection device according to Example 2 is in a valve open state. FIG. 22 is an enlarged view of the drive unit cross section at the instant when the valve body comes into contact with a valve seat 118 after starting to close from a valve open state. FIG. 23 is a diagram showing the configuration of the drive device according to Example 2 of the present invention. FIG. 24 is a diagram showing frequency gain characteristics of an analog differentiating circuit of the drive device in FIG. 23. FIG. 25 is a diagram showing the relationship between a voltage $V_{L3}$, to detect changes of the current flowing to the solenoid 105, the first differential value of the voltage $V_{L3}$, the second differential value of the voltage $V_{L3}$, and displacements of a second valve body 1907 and a second needle 1902 and the time. FIG. 26 is a diagram showing the relationship between the displacements of the second valve body 1907 and the second needle 1902 when closed from the maximum lift in an intermediate lift state, a voltage $V_{L4}$ as a potential difference between a terminal 2306 to detect the voltage $V_L$ by CPU 801 and the ground potential 815, and the second differential value of the voltage $V_{L4}$ and the time after the injection pulse is turned off. In FIGS. 19, 20, 21, and 22, the same reference signs are used for components equivalent to those in FIGS. 1 and 2. In FIGS. 21 and 22, the same reference signs are used for components identical to those in FIG. 19. In FIG. 23, the same reference signs are used for components equivalent to those in FIG. 8.

First, using FIGS. 19 and 20, the drive unit structure and configuration of the fuel injection device in a valve closed state in which a valve body and the valve seat 118 in Example 2 of the present invention will be described. From FIG. 19, the second valve body 1907 includes a first regulating unit 1910 in an upper portion thereof and a second regulating unit 1908 is connected to the second valve body 1907. A first member 1903 to support an initial position spring 1909 is joined to the second needle 1902 in a junction 1904. The second needle 1902 can relatively move between the first regulating unit 1910 and the second regulating unit 1908. In a valve closed state in which the second valve body 1907 and the valve seat 118 are in contact, a load by the spring 110 and a fluid force (hereinafter, called a differential pressure force) as a product of the area of a seat diameter d, in the contact position of the second valve body 1907 and the valve seat 118 and the fuel pressure act on the second valve body 1907 in the valve closing direction. The second needle 1902 is energized in the valve closing direction by the load of the initial position spring 1909 and remains at rest in contact with the second regulating unit 1908. In the valve closed state, there is a gap 1901 between the second regulating unit 1910 and the second needle 1902. While the second valve body 1907 and the valve seat 118 are in contact, there is no pressure difference between the upper portion and the lower portion of the second needle and thus, no differential pressure force acts on the second needle. A vertical hole fuel passage 1905 is formed in the center of the second valve body 1907 and fuel can flow downstream by passing through a horizontal hole fuel passage 1906.

Using FIGS. 23 and 24, the configuration of the drive device in Example 2 will be described. The drive device in Example 2 differs from the drive device in Example 1 in that the measuring location of the voltage to detect the valve closing finish timing is changed from the voltage $V_{L1}$ to the voltage $V_L$, a capacitor C83 is provided between the active low-pass filter 860, the a ground potential (GND) side terminal 2301 of the fuel injection device 840, and the resistor R81 to provide an analog differentiating circuit 2203 constructed of the capacitors C81, C83, the resistors R81, R82, and the operational amplifier 820, first differentiation processing of the voltage VL is performed by the drive device in an analog fashion, and a signal of the first differential value of VL is input into the A/D conversion port of the CPU 801. If configured not to divide the $V_L$ voltage, the analog differentiating circuit 2203 detects a potential difference between the ground potential (GND) side terminal of the solenoid 105 and the ground potential (GND) and thus, the maximum value of the voltage value of the VL voltage is a high voltage value under that condition that a voltage in the negative direction is applied to the solenoid 105, for example, 60 V. By arranging a capacitor C1 between the measuring terminal 2301 to detect the voltage $V_L$ and the operational amplifier 820, the voltage input into the operational amplifier 820 can be reduced and thus, the withstand voltage needed for the operational amplifier 820 and the A/D converter of the CPU 801 can be reduced so that the cost of the operational amplifier 820 and the CPU 801 can be reduced. According to the above configuration, the resistor 853 used in Example 1 and needed to divide the voltage $V_L$ can be eliminated, leading to cost reductions of the drive device. Also, high-frequency noise superimposed on the VL voltage of the drive device can be reduced by performing differentiation processing using the analog differentiating circuit 2203 and by adopting a configuration in which the voltage value after first differentiation processing is input into the CPU 801, the time resolution needed for the A/D conversion port of the CPU 801 can be reduced and loads of filtering processing and digital differentiation operation processing of the CPU 801 can be reduced. The relation between the voltage VL to be detected and the voltage value $V_0$ input into the CPU 801 is shown in Formula (5). From Formula (5), the value of the voltage $V_0$ may preferably be adjusted to the withstand voltage or less of the A/D conversion port provided in the CPU 801 or IC 802 by adjusting the values of the resistors R81, R82 and the capacitors C81, C83 in the analog differentiating circuit 2303.

$$V_0 = \frac{1}{\frac{R81}{R82} + \frac{C83}{C81} + \frac{C83}{R82 \cdot s} + \frac{R81 \cdot s}{C81}} \cdot VL \tag{5}$$

FIG. 24 shows frequency-gain characteristics of the analog differentiating circuit 2303 in Example 2. From FIG. 24, the analog differentiating circuit 2303 is a band pass filter in which the gain in a low frequency is small and the gain in a high frequency is small and is configured to make the gain small in other frequency bands than the frequencies $f_{cL}$ to $f_{cH}$. In a conventional analog differentiating circuit, the relation between the frequency and the gain is a directly proportional relation and thus, when a stepwise high-frequency signal is input, the signal may infinitely be amplified in the analog circuit, leading to a problem that the circuit transmits. Thus, by deriving the frequency band needed to detect the valve closing finish timing in advance and designing design values of the resistors R81, R82 and the capacitors C81, C83 of the analog differentiating circuit 2303 in advance, only the voltage of the needed frequency band can be detected in a stable manner so that the detection precision of the valve closing finish timing of a fuel injection device 2305 can be improved. The resistors R81, R82 and the capacitors C81, C83 may preferably be set by analyzing the VL voltage and the frequency in a period after the injection pulse width Ti is stopped until the second valve body 1907 finishes closing the valve in advance. The potential difference between a terminal 843 from which high-frequency noise components are removed by passing the voltage VL2 to detect the valve opening start and valve opening finish timing through the active low-pass filter 861 and the ground potential 815 is called the voltage $V_{L3}$. By inputting the voltage $V_{L3}$ into the A/D conversion port of the CPU 801, the value obtained by dividing the voltage $V_{L3}$ by the resistance value of the resistor 808 is the current flowing through the solenoid 105 according to the Ohm's law and thus, the current flowing through the solenoid 105 can be detected by the CPU 801. According to the method in Example 2 of the present invention, it is sufficient to be able to detect the gradient of the current flowing through the solenoid 105, that is, the value of the current differential value using the drive device so that the valve opening start and valve closing finish timing can be detected by performing differentiation processing of the voltage $V_{L3}$.

Next, using FIGS. 19, 20, and 21, a valve opening operation of the fuel injection device 2305 in Example 2 will be described. When a current is supplied to the solenoid 105 and the magnetic suction force acting on the second needle 1902 exceeds the load of the initial position spring 1909, the second needle 1902 moves in the valve opening direction and in the timing when the gap 1901 becomes zero, the second needle 1902 collides against the second valve body 1907 and the second valve body 1907 separates from the valve seat 118. With the movement of the second needle 1902 in the valve opening direction, shearing resistance is generated between the outside diameter of the second needle 1902 and the nozzle holder 101 and a shearing resistance force acts on the second needle 1902 in the valve closing direction. However, the shearing resistance can be reduced by increasing the gap between the outside diameter of the second needle 1902 and the nozzle holder 101. The shearing resistance force acting on the second needle 1902 is smaller than the magnetic suction force as a force in the valve opening direction and thus, the second needle 1902 is accelerated in the valve opening direction by the magnetic suction force generated by a current supplied to the solenoid by the application of the step-up voltage VH to the solenoid 105 after a current being passed to the switching elements 805, 808. Then, the passage of current to the switching elements 805, 806 is stopped and the step-up voltage VH in the negative direction is applied to the terminal voltage $V_{inj}$ of the solenoid 105 to rapidly decrease the current flowing to the solenoid. Then, the current is passed to the switching elements 807, 806 and the battery voltage VB is applied to the solenoid 105 and while the current is passed to the switching elements 807, 806, the second needle 1902 is caused to collide against the second valve body 1907 and the second valve body 1907 is caused to start to open. By passing the current to the switching elements 807, 806 for a fixed time after the second valve body 1907 starts to open or until the current value flowing to the solenoid 105 reaches a predetermined current value, the valve opening start timing can be detected as the maximum value of the second differential value of current. Compared with Example 1, the load by the spring 110 acts on the second valve body 1907, instead of the needle 102, and thus, acceleration changes of the second needle 1902 in the valve opening start timing of the second valve body 1907 are large and changes of the gradient of current to detect the valve opening start timing are large. The changes of the gradient of current are also caused in the voltage $V_{L2}$ to detect the current flowing to the solenoid 105 and thus, the maximum value or the minimum value of the voltage $V_{L2}$ after second differentiation processing of the voltage $V_{L2}$ can easily be detected and as a result, detection precision of the valve opening start timing can be improved.

Next, using FIGS. 19, 20, 21, and 25, the operation of the second needle 1902 and the second valve body 1907 when the valve body 114 in Example 2 opens from a valve closed state and the detection method of the valve opening finish timing will be described. FIG. 25 is a diagram showing the relationship between a voltage $V_{L3}$, to detect changes of the current flowing to the solenoid 105, the first differential value of the voltage $V_{L3}$, the second differential value of the voltage $V_{L3}$, and displacements of a second valve body 1907 and a second needle 1902 and the time. The time axis in FIG. 25 shows the time from the timing when the passage of current to the switching elements 805, 806 maintained to apply the step-up voltage VH to the solenoid 105 is stopped while the second valve body 1907 performs a valve opening operation from a valve closed state and a backward voltage is applied to the solenoid 105.

No differential pressure force works on the second needle 1902 while the second valve body 1907 is in contact with the valve seat 118 and thus, if a current is supplied to the solenoid 105, the second needle 1907 performs an acceleration operation and collides against the second valve body 1907 and then reaches the target lift in a short time and in timing $t_{2503}$, the second needle 1902 collides against the fixed core 107. In the fuel injection device 2305 in Example 2, in contrast to the fuel injection device 840 in Example 1 of the present invention, the load by the initial position spring 1909 acting on the second needle 1902 works in the valve closing direction and thus, the bound of the second needle 1902 caused by the collision of the second needle 1902 against the fixed core 107 after the second valve body 1907 reaches the target lift occurs a plurality of times like 2506, 2507, 2508 and a long time is needed for the bound of the second needle 1902 to converge. As a result, an arrangement point due to the collision of the second needle 1902 against the fixed core 107 arises in the voltage $V_{L3}$ to detect the valve opening finish timing in timings $t_{2502}$, $t_{2503}$, $t_{2504}$ and a plurality of mountains convex in the positive direction of the second differential value of the voltage VL3 may arise like 2501, 2502, 2503 (hereinafter, called a peak 2501, a peak 2502, and a peak 2503). Even in such a case, the valve opening finish timing can be detected by detecting the timing $t_{2502}$ when the second differential value of the voltage $V_{L3}$ takes the maximum value by the drive device for each fuel injection device of each cylinder. The timing of turning on the injection pulse or the timing of passing/stopping a current to the switching elements 805, 806, 807 may preferably be used to set the timing $t_{2502}$ as a trigger of an acquisition period 2505 of the voltage VL3 to detect the valve opening finish timing such that the above operation is when a fixed period 2504 passes after the passage/stop. Particularly, the injection pulse output from the CPU 801 is generated inside the CPU 801 and can easily be used as a trigger to determine the period 2504. Setting values of the period 2504 and the acquisition period 2505 may preferably be set to the drive device in advance so that a time to be able to detect individual variations of the valve opening finish timing of the fuel injection device of each cylinder is given to the acquisition period 2505 and the number of pieces of data of the voltage VL3 input into the CPU 801 is reduced. If the fuel pressure supplied to the fuel injection device 2305 changes, a differential pressure force acting on the second valve body 1907 changes and thus, the valve opening finish timing also changes. Therefore, the period 2504 and the acquisition period 2505 may preferably be determined based on the target fuel pressure set to the CPU 801 of the drive device or the value of an output signal of the pressure sensor installed on a pipe upstream of the fuel injection device 2305 detected by the drive device. Accordingly, even if operating conditions change, the valve opening finish timing can be detected with precision and also a data point sequence where the voltage VL3 needed for detection is incorporated into the CPU 801 can be reduced so that processing loads of the CPU 801 can be reduced. If a plurality of mountains convex in the positive direction of the second differential value of the voltage $V_{L3}$ exists in the acquisition period 2505 and the values of the second and third peaks 2502, 2503 are larger than the value of the first peak 2501, the drive device may preferably be caused to store the first peak 2501 as the valve opening finish timing. By adopting such a configuration, the acquisition period 2505 needed to detect individual variations of the fuel injection device 2305 of each cylinder can be secured and also erroneous detection of the valve opening finish timing can be inhibited so that detection precision of the valve opening finish timing and correction precision of the injection quantity can be improved. Also, from FIG. 21, while the second needle 1902 remains at rest in contact with the fixed core, a second gap 2101 exists between the lower end face of the second needle 1902 and the second regulating unit 1908.

Next, using FIGS. 20, 22, and 26, the operation of the second needle 1902 and the second valve body 1907 when the second valve body 1907 in Example 2 closes from a state in which the displacement of the intermediate lift takes the maximum value and the detection method of the valve closing finish timing will be described. FIG. 26 is a diagram showing the relationship between the displacements of the second valve body 1907 and the second needle 1902 when closed from the maximum lift in an intermediate lift state, a voltage $V_{L4}$ as a potential difference between a terminal 2306 to detect the voltage $V_L$ by the CPU 801 and the ground potential 815, and the second differential value of the voltage $V_{L4}$ and the time after the injection pulse is turned off. From FIGS. 22 and 26, when the second valve body 1907 is closed from a valve open state, the load by the spring 110 and a differential pressure force due to the flow of fuel act on the second valve body 1907 as forces in the valve closing direction and the second needle 1907 receives the forces in the valve closing direction via the second valve body 1907 and also the load of the initial position spring 1909 acts on the second needle 1902 in the valve closing direction. When the injection pulse is stopped and the passage of current to the switching elements 805, 806 is stopped and the step-up voltage VH in the negative direction is applied to the solenoid 105 to reduce the current flowing to the solenoid 105, the magnetic suction force acting on the second needle 1902 decreases accompanying the disappearance of an eddy current inside the magnetic circuit. The magnetic suction force as a force acting on the second needle 1902 in the valve opening direction falls below the force acting on the second valve body 1902 and the second needle 1907 in the valve closing direction, the second needle 1902 and the second valve body 1907 start a valve opening operation. The second needle 1902 separates from the second valve body 1907 in the timing $t_{2602}$ when the second valve body 1907 comes into contact with the valve seat 118 and continues to move in the valve closing direction. Then, the second needle 1902 collides against the second regulating unit 1908 and comes to rest in the timing $t_{2604}$ when a third gap 2201 between a lower end face 2202 of the second needle and the second regulating unit 1908 becomes zero at the instant when the second valve body 1907 comes into contact with the valve seat 118. In Example 2 of the present invention, the timing $t_{2601}$ when the injection pulse Ti is turned off is used as a trigger to fetch the voltage $V_{L4}$ by the CPU 801 and data acquisition of the voltage VL4 is started when a fixed period 2606 passes after the injection pulse Ti is turned off to input the voltage $V_{L4}$ corresponding to a first differential value of the voltage $V_L$ into the A/D conversion port of the CPU 801 only for a period 2607. Then, digital differentiation processing of the voltage $V_{L4}$ fetched by the CPU 801 is performed to calculate a first differential value of the voltage $V_{L4}$. In this case, the first differential value of the voltage $V_{L4}$ corresponds to the second differential value of the voltage $V_L$.

By detecting the first differential value of the voltage $V_{L4}$ (corresponding to the second differential value of the voltage $V_L$) by the drive device, in the valve closing finish timing at the instant when the second valve body 1907 comes into contact with the valve seat 118 and the second needle 1902 separates from the second valve body 1907, the second needle 1902 no longer receives the force working on the second needle 1902 in the valve closing direction that has acted via the second valve body 1907 and thus, the acceleration of the second needle 1902 changes and a first mountain 2608 whose first differential value of the voltage $V_{L4}$ is in the negative direction arises. Then, at the instant when the second needle 1902 collides against the second regulating unit 1908, the second needle 1902 receives a repulsive force by contact with the second regulating unit 1908 and the acceleration thereof changes significantly, creating a second mountain 2609 whose first differential value of the voltage $V_{L4}$ is in the negative direction arises. The values of the first differential value of the voltage $V_{L4}$ of the first mountain 2608 and the second mountain 2609 depend on the gap of the gap 1901 and the shape of the magnetic circuit and heavily depends on the speed of the second needle 1902 in the valve closing finish timing that changes depending on the spring load or a differential pressure force due to fuel pressure. If the speed in the valve closing finish timing is small, kinetic energy of the second needle 1902 in the valve closing finish timing is also small and thus, the time from the valve closing finish timing until the second needle 1902 comes to rest becomes longer and the second mountain 2609 may have a smaller value of the first differential value of the voltage $V_{L4}$ than the first mountain 2608. When the minimum value of the first differential value of the voltage VL4 in the period 2607 is searched for, as described above, one of the first mountain 2608 and the second mountain 2609 will be detected. In such a case, the period 2607 is divided into a first period 2608 and a second period 2609, the minimum value of the first differential value of the voltage $V_{L4}$ in the first period 2608 is determined as the valve closing finish timing when the second valve body 114 comes into contact with the valve seat 118, and the minimum value of the first differential value of the voltage $V_{L4}$ in the second period is detected and determined as needle resting timing when the second needle 1902 comes into contact with the second regulating unit 1908 of the second valve body 1907 for each fuel injection device of each cylinder so that the valve closing finish timing can be detected with precision. After the second valve body 114 comes into contact with the valve seat 118 during valve closing operation, the second needle 1902 continues the motion in the valve closing direction until the collision against the second regulating unit 1908. If the next second injection pulse Ti for divided injection is supplied while the second needle moves in the valve closing direction, even if the second injection pulse equivalent to the last injection pulse (called the first injection pulse) is supplied, the injection quantity when the second injection pulse Ti is supplied changes from when the first injection pulse width Ti is supplied due to changes of the position of the second needle 1902 or kinetic energy of the second needle 1902 in the timing when the second injection pulse is supplied. Therefore, the supply timing of the second injection pulse Ti may preferably be controlled by detecting the timing $t_{2604}$ when the fuel injection device 2305 of each cylinder comes to rest detected by the drive device. The supply timing of the second injection pulse Ti may preferably be adjusted by matching to the individual of the fuel injection device 2305 of the longest timing $t_{2604}$. According to Example 2 of the present invention, under the condition of divided injection in which a plurality of fuel injections is performed during one intake and exhaust stroke, the interval between the first injection pulse and the second injection pulse can be reduced and also the injection quantity of the first injection pulse and the second injection can be controlled correctly and therefore, Example 2 is effective when the required number of times of divided injection is large. As the trigger to fetch the voltage $V_{L4}$, the timing when the injection pulse Ti is turned on or the timing of passage/stop of current to the switching elements 805, 806, 807 may be used.

Incidentally, the fuel injection device 2305 and the drive device in Example 2 of the present invention may be used in combination with the fuel injection device 840 and the drive device in Example 1.

Example 3

The control technique to correct the injection quantity of the fuel injection device 840 and the fuel injection device 2305 according to Examples 1 and 2 respectively according to Example 3 of the present invention will be described using FIGS. 27 to 30.

Figure 27:
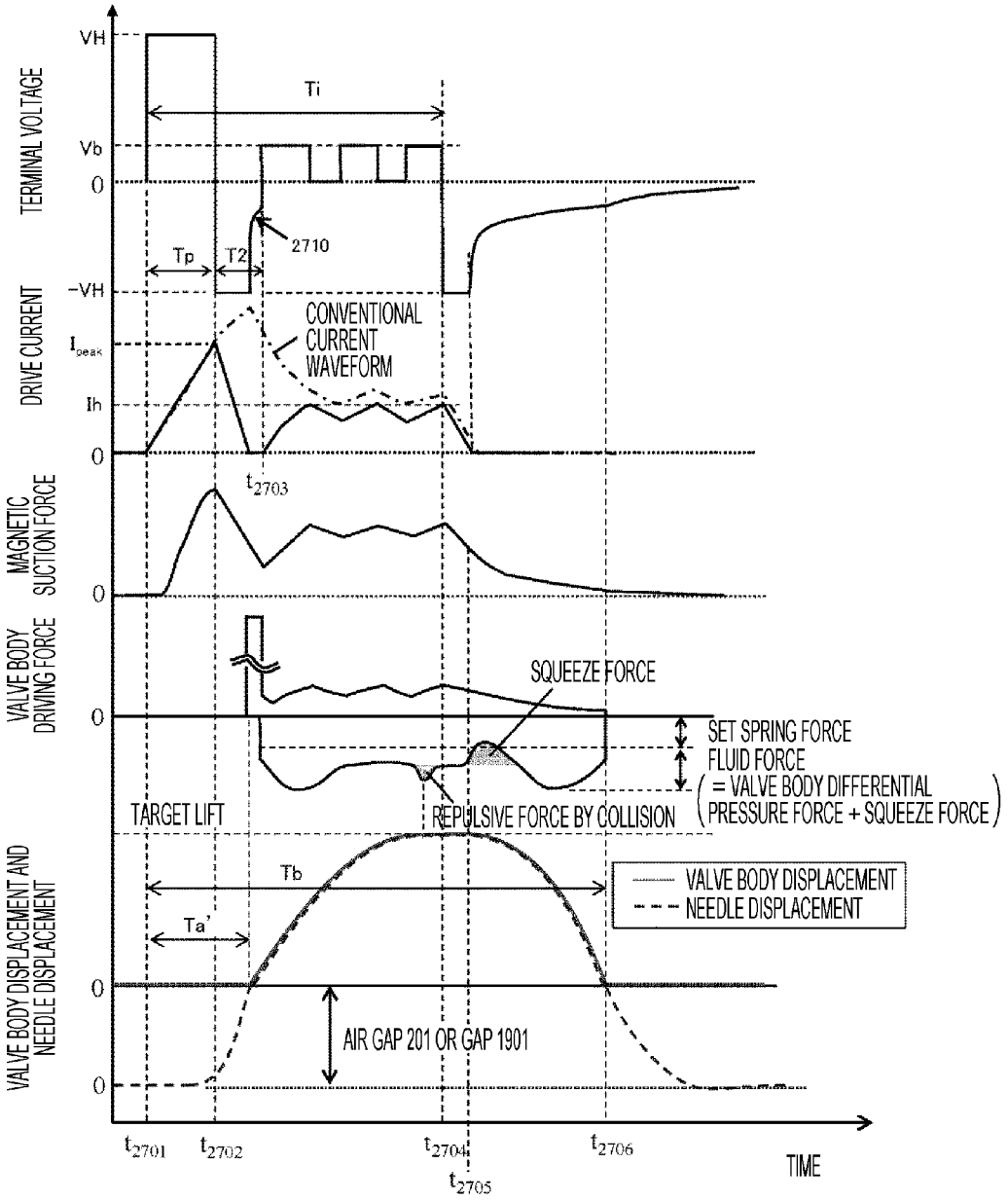
FIG. 27 is a diagram illustrating the relationship between the terminal voltage $V_{inj}$ of the fuel injection device or the fuel injection device, the drive current, a magnetic suction force acting on the needle or the second needle, a valve body driving force acting on the valve body or the second valve body, the displacement of the valve body or the second valve body, and the displacement of the needle or the second needle when used by, among cases in which the fuel injection device or the fuel injection device is driven by a technique according to Example 3 of the present invention, holding the valve body or the second valve body in a target lift position for a fixed time and the time.
Figure 28:
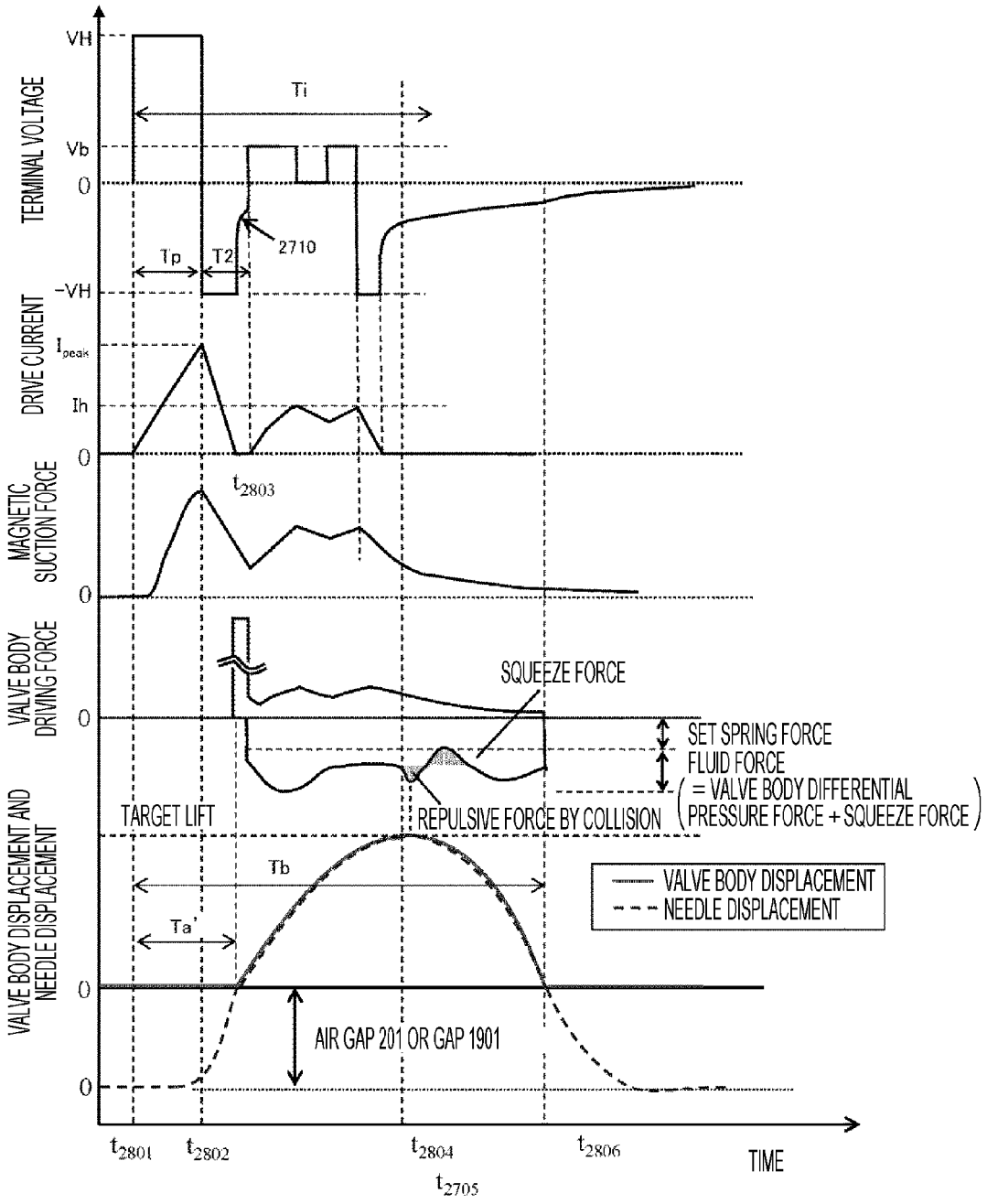
FIG. 28 is a diagram illustrating the relationship between the terminal voltage $V_{inj}$, the drive current, the magnetic suction force acting on the needle or the second needle, the valve body driving force acting on the valve body or the second valve body, the displacement of the valve body or the second valve body, and the displacement of the needle or the second needle in an operating state when, among cases in which the fuel injection device 8 or the fuel injection device is driven by the technique according to Example 3 of the present invention, the minimum injection quantity is implemented to cause the valve body or the second valve body to reach the target lift and the time.
Figure 29:
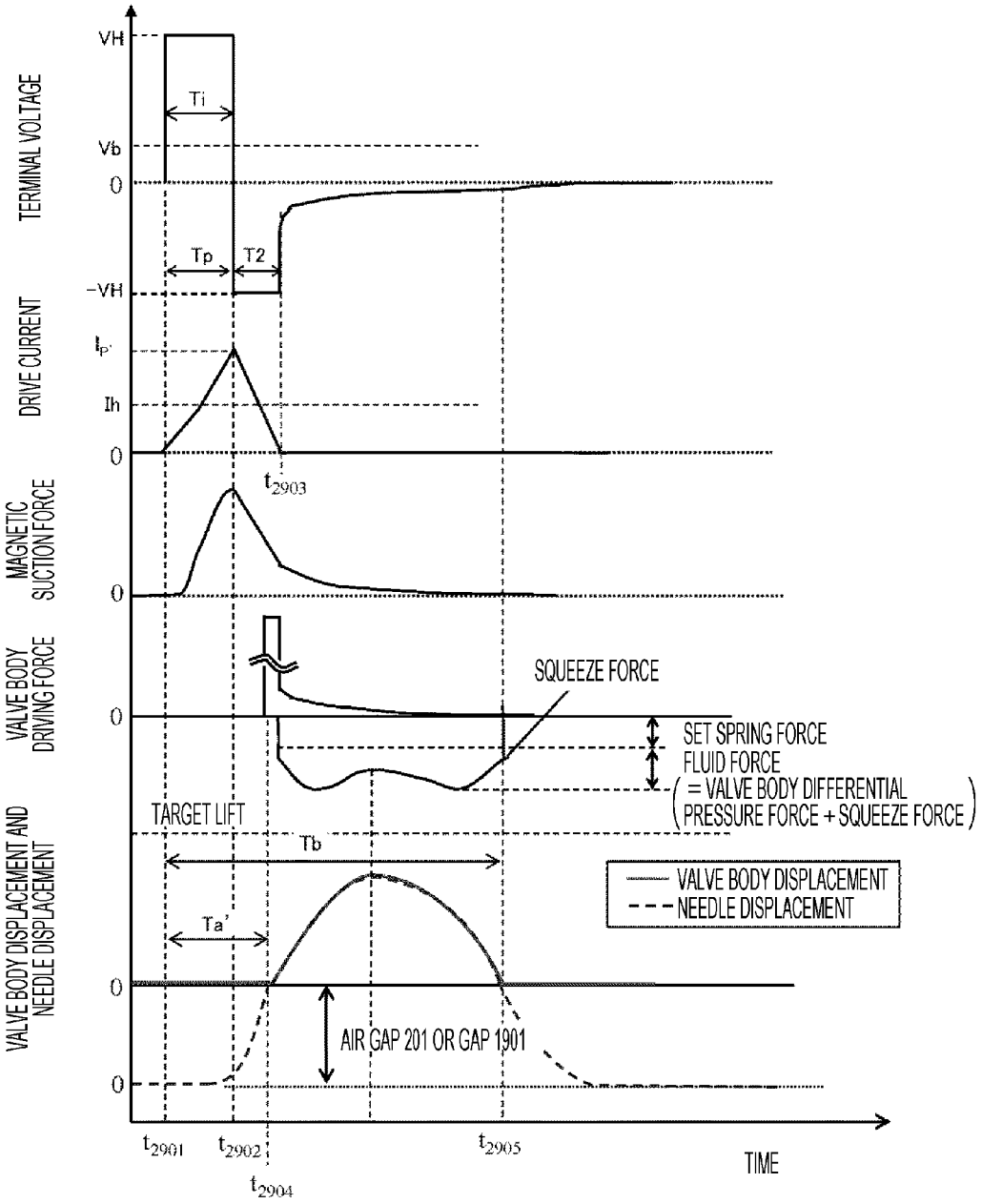
FIG. 29 is a diagram illustrating the relationship between the terminal voltage $V_{inj}$, the drive current, the magnetic suction force acting on the needle or the second needle, the valve body driving force acting on the valve body or the second valve body, the displacement of the valve body or the second valve body, and the displacement of the needle or the second needle when operating, among cases in which the fuel injection device or the fuel injection device is driven by the technique according to Example 3 of the present invention, in an intermediate lift and the time. In the diagram of the valve body driving force, the driving force in a valve opening direction is shown in a positive direction and the driving force in a valve closing direction is shown in a negative direction.
Figure 30:
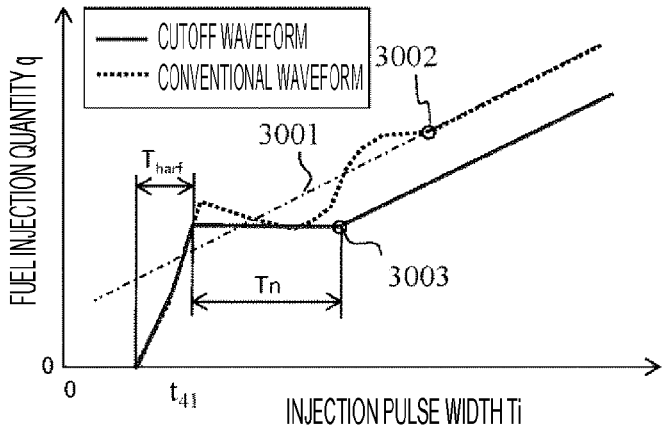
FIG. 30 is a diagram illustrating the relationship between the injection pulse width Ti and a fuel injection quantity q when a current waveform of the control methods of FIGS. 27 to 29 according to Example 3 of the present invention is used.

FIG. 27 is a diagram showing the relationship between the terminal voltage $V_{inj}$ of the fuel injection device 840 or the fuel injection device 2305, the drive current, the magnetic suction force acting on the needle 102 or the second needle 1902, the valve body driving force acting on the valve body 114 or the second valve body 1907, the displacement of the valve body 114 or the second valve body 1907, and the displacement of the needle 102 or the second needle 1907 when used by, among cases in which the fuel injection device 840 or the fuel injection device 2305 is driven by a technique according to Example 3, holding the valve body 114 or the second valve body 1907 in a target lift position for a fixed time and the time. In the diagram of the valve body driving force, a driving force in the valve opening direction is shown in the positive direction and a driving force in the valve closing direction is shown in the negative direction. In the diagram of the drive current, a conventional current waveform used generally is shown as an alternate long and short dash line. FIG. 28 is a diagram showing the relationship between the terminal voltage $V_{inj}$, the drive current, the magnetic suction force acting on the needle 102 or the second needle 1902, the valve body driving force acting on the valve body 114 or the second valve body 1907, the displacement of the valve body 114 or the second valve body 1907, and the displacement of the needle 102 or the second needle 1907 in an operating state when the minimum injection quantity is implemented to cause the valve body 114 or the second valve body 1907 to reach the target lift and the time. In the diagram of the valve body driving force, a driving force in the valve opening direction is shown in the positive direction and a driving force in the valve closing direction is shown in the negative direction. FIG. 29 is a diagram showing the relationship between the terminal voltage $V_{inj}$, the drive current, the magnetic suction force acting on the needle 102 or the second needle 1902, the valve body driving force acting on the valve body 114 or the second valve body 1907, the displacement of the valve body 114 or the second valve body 1907, and the displacement of the needle 102 or the second needle 1907 when operating in an intermediate lift that realizes a smaller injection quantity than the injection quantity by the operation shown in FIG. 28 and the time. In the diagram of the valve body driving force, a driving force in the valve opening direction is shown in the positive direction and a driving force in the valve closing direction is shown in the negative direction. FIG. 30 is a diagram showing the relationship between the injection pulse width Ti and a fuel injection quantity q when a current waveform of the control methods of FIGS. 27 to 29 is used.

The operation when the valve body 114 or the second valve body 1902 is used by being held in a target lift position will be described using FIG. 27. From FIG. 27, the injection pulse width Ti is supplied and a current is passed to the switching elements 805, 806 at time $t_{2901}$ and when a valve opening signal turns to ON, the step-up voltage VH is applied to the solenoid 105. Accordingly, the current flowing to the solenoid 105 gradually increases and the magnetic suction force acting on the needle 102 or the second needle 1902 increases after a fixed delay time accompanying the disappearance of an eddy current generated inside the magnetic circuit. When the magnetic suction force exceeds a valve closing force acting on the needle 102 or the second needle 1902, the needle 102 or the second needle 1902 starts to move and the movement thereof is gradually accelerated. In the fuel injection device 2305 in Example 2, the load by the set spring 110 acts on the second valve body 1907 in a valve closed state and the second valve body 1907 is pressed by the load of the initial position spring 1909 in the valve closing direction. Next, when the current flowing to the solenoid 105 reaches the peak current value $I_{peak}$ at time 2902, the application of the step-up voltage VH is stopped by stopping the current to the switching elements 805, 806 and at the same time, the step-up voltage VH in the negative direction is applied. As a trigger of this operation performed at the timing $t_{2902}$, in addition to using reaching the peak current value $I_{peak}$ as described above, a method of determining the step-up voltage application time Tp in advance and a method of setting when a fixed time passes after the peak current value $I_{peak}$ is reached are known. In addition to a case when the step-up voltage VH varies depending on the circuit configuration, the resistance value, wire resistance, inductance and the like of the solenoid 105 of the fuel injection device 840 or the fuel injection device 2305 vary and thus, if the step-up voltage application time Tp is fixed, the peak current value $I_{peak}$ varies. To provide a stable valve opening force during valve opening operation in consideration of variations of the valve operation of the fuel injection device 840 or the fuel injection device 2305 of each cylinder, the control method of fixing the peak current value $I_{peak}$ is better. On the other hand, to reduce variations of the time in which the valve opening force is provided, the method of fixing the application time Tp is better. In the method of stopping the application of the step-up voltage VH when a fixed time passes after the peak current value $I_{peak}$ is reached, the current cutoff time can be controlled without depending on the set resolution of the peak current value $I_{peak}$ while achieving an effect of setting the peak current value $I_{peak}$ and thus, the current value can be adjusted with more precision and the correct precision of the injection quantity can be improved.

In timing $t_{2702}$ when the needle 102 or the needle 1907 collides against the valve body 114 or the second valve body 1907, due to collision of the needle 102 or the second needle 1907 against the valve body 114 or the second valve body 1907, kinetic energy of the needle 102 or the second needle 1907 and an impulse due to collision of the needle against the valve body are given to the valve body 114 or the second valve body 1907 and the valve body 114 or the second valve body 1907 performs a valve opening operation. At this point, energy input into the solenoid 105 in a period 2701 is converted into kinetic energy of the needle 102 or the second needle 1907. Then, the valve body 114 or the second valve body 1907 reaches the target lift due to the magnetic suction force acting on the needle 102 or the second needle 1907, but a differential pressure force (fluid force) in accordance with the displacement position acts on the valve body 114 or the second valve body 1907 in the valve closing direction. When the valve body 114 or the second valve body 1907 reaches the target lift position, a repulsive force may be generated by the collision of the needle 102 or the needle 1902 against the fixed core 107, but the target lift is reached with a holding current value Ih lower than the peak current value $I_{peak}$ while inhibiting the valve opening speed of the valve body 114 or the second valve body 1907 in the step-up voltage cutoff period T2 and thus, the repulsive force is small and the needle 102 or the second needle 1902 does not bound from the fixed core 107. According to the configuration of the fuel injection device 840, the load of the return spring 112 works in the valve opening direction in which the bound of the needle 102 is inhibited and therefore, an effect of being able to inhibit the bound of the needle 102 that could be generated by the collision of the needle 102 against the fixed core 107 is achieved.

At time $t_{2702}$ or thereafter, when the current reaches 0 A while the step-up voltage VH in the negative direction is applied to the solenoid 105, changes of the induced electromotive force caused by current changes decrease, but if a magnetic flux remains inside the magnetic circuit at this point, the disappearance of the magnetic suction force and the magnetic flux continues and a voltage portion generated by the induced electromotive force is applied to the solenoid 105 as a voltage in the negative direction like 2710. The magnetic suction force working on the needle 102 or the second needle 1907 decreases simultaneously with the decrease of the current flowing to the solenoid 105 and kinetic energy of the valve body 114 or the second valve body 1907 decreases, but thereafter, the magnetic suction force increases again with the supply of the holding current value Ih and the valve body 114 or the second valve body 1907 reaches the target lift position.

By cutting off the current rapidly to decrease the current to the holding current value Ih after the peak current value $I_{peak}$ is once reached, the magnetic suction force when the valve body 114 or the second valve body 1907 reaches the target lift can be made smaller than a case of the conventional current waveform (called the conventional waveform) shown in the drive current of FIG. 27 from the peak current value $I_{peak}$ to the holding current value Ih. By decreasing the magnetic suction force, the speed of the collision of the valve body 114 or the second valve body 1907 against the fixed core 107 can be reduced and thus, when the cutoff waveform is used, as shown in FIG. 30, nonlinearity arising in injection quantity characteristics can be improved when compared with the conventional waveform and the region where the relationship between the injection pulse width Ti and the injection quantity q is linear can be extended in the direction in which the injection quantity decreases so that the minimum controllable injection quantity when the valve body 114 or the second valve body 1907 reaches the target lift can be reduced from a minimum injection quantity 3002 of the conventional waveform to a minimum injection quantity 3003 of the cutoff waveform.

Using the valve opening lag time as a time from the supply of the injection pulse Ti stored for each fuel injection device of each cylinder to the valve opening finish timing when the valve 114 or the second valve body 1907 reaches the target lift, the peak current value $I_{peak}$ or the step-up voltage application time Tp and the voltage cutoff time T2 may be adjusted for each fuel injection device of each cylinder. For example, for an individual whose valve opening lag time is earlier, the valve opening speed is high and thus, the step-up voltage application time Tp is may preferably be set shorter to make the time when the needle 102 or the second needle 1902 starts to decelerate earlier. On the other hand, for an individual whose valve opening lag time is later, the step-up voltage application time Tp is may be set longer to make the time when the needle 102 or the second needle 1902 starts to decelerate later.

If the injection pulse width Ti is turned off in the period of the step-up voltage cutoff time Tp when a current cutoff waveform is used, there arises a period in which the same current waveform is supplied to the solenoid 105 of the fuel injection device 840 or the fuel injection device 2305 regardless of the magnitude of the injection pulse width Ti and thus, a dead zone Tn in which the fuel injection quantity q does not change even if the injection pulse width Ti is increased arises. In injection quantity characteristics of the cutoff waveform shown in FIG. 30, an intermediate lift region $T_{harf}$ in which the valve body 114 does not reach the target lift and a region of the injection pulse width Ti at 3003 and onward where driven after the valve body 114 reaches the target lift have different gradients of the injection pulse width Ti and the fuel injection quantity q, but nonlinearity of injection quantity characteristics arising in injection quantity characteristics of the conventional waveform is improved and thus, the relationship between the injection pulse width and the fuel injection quantity q is a positive relationship so that the fuel injection quantity q increases with an increasing injection pulse width. To simplify the control algorithm of the injection quantity installed in the CPU 801 of the drive device, it is necessary to continuously increase the injection quantity with an increasing engine speed or engine load and thus, in the fuel injection device 840, the fuel injection quantity q needs to increase with an increasing injection pulse width Ti. In such an engine, the fuel injection quantity q required with an increasing engine speed or engine load can appropriately be controlled using the control technique in Example 3, which makes the control of the injection quantity easier. When the conventional waveform is used, the deviation value of an ideal straight line 3001 determined from the injection quantity in a region where the relationship between the injection pulse width and the injection quantity is substantially linear from the fuel injection quantity q varies in the positive and negative directions and in a region where the injection quantity characteristic is nonlinear, it is necessary for the drive device to grasp the relationship between the injection pulse width Ti and the fuel injection quantity q and therefore, it is necessary to detect the valve closing finish timing for each injection pulse width Ti and cause the drive device to store the timing as a valve closing lag time for the fuel injection device of each cylinder. In the control method using a cutoff waveform in Example 3, on the other hand, the relationship between the injection pulse width Ti and the fuel injection quantity q is a positive correlation in the intermediate lift region $T_{harf}$ and the region where the target lift is reached and the deviation value from the required injection quantity can be calculated based on detection information of the valve closing finish timing at two points of each of the intermediate lift region $T_{harf}$ and the region where the target lift is reached and detection information of the valve opening finish timing and the valve opening start timing at one point of the region where the target lift is reached so that calculation loads of the CPU 801 or the IC 802 needed to detect the valve operation and memory capacities for storage of individual information can be reduced and the algorithm provided to the CPU 801 or the IC 802 to correct individual variations of the injection quantity can be simplified. If the injection quantity smaller than the minimum controllable injection quantity 3003 under the condition that the valve body 114 or the second valve body 1907 reaches the target lift is required, the dead zone Tn may preferably be set to the drive device for the fuel injection device 840 or the fuel injection device 2305 of each cylinder in advance so that the injection pulse width Ti smaller than the period of the dead zone Tn is used.

More specifically, when the peak current value $I_{peak}$ or the step-up voltage application time Tp and the voltage cutoff time T2 are adjusted, parameters can be adjusted by feedback by storing the valve opening lag time Ta of each cylinder in the drive device and individual variations of operation characteristics or changes due to degradation of the fuel injection device 840 or the fuel injection device 2305 can be handled so that a stable operation can be realized. In the fuel injection device 840 or the fuel injection device 2305, the valve opening finish timing varies under the influence of variations of the dimensional tolerance. If the same cutoff waveform is supplied to the solenoid 105 in an individual whose valve opening finish timing is earlier and an individual whose valve opening finish timing is later, for the individual whose valve opening finish timing is earlier, even if the current is cut off in the step-up voltage cutoff timing $t_{2702}$ as the timing when the peak current value $I_{peak}$ is cut off, the deceleration of the needle 102 or the second needle 1907 is not in time and the collision speed of the needle 102 or the second needle 1907 and the fixed core 107 increases so that nonlinearity of injection quantity characteristics may arise. For the individual whose valve opening finish timing is later, if the passage of current to the switching elements 805, 806 is stopped in the end timing of the step-up voltage cutoff time Tp to decrease the current flowing to the solenoid 105, the magnetic suction force acting on the needle 102 or the second needle 1902 needed for the valve body 114 or the second valve body 1907 to reach the target lift cannot be secured and thus, the valve body 114 or the valve body 1907 does not reach the target lift position. Therefore, when some displacement is reached after the valve body 114 or the second valve body 1907 starts to open in the fuel injection device 840 or the fuel injection device 2305 of each cylinder using information of the valve opening lag time stored in the drive device, the passage of current to the switching elements 805, 806 is stopped to apply the step-up voltage VH in the negative direction to the solenoid 105 and the step-up voltage application time Tp and the voltage cutoff time T2 may preferably be adjusted so that the timing when the deceleration starts is equivalent when viewed from the valve opening finish timing. The value of the peak current value $I_{peak}$ is automatically changed when the step-up voltage application time Tp is changed, but the setting of the peak current value $I_{peak}$ may be changed for the fuel injection device 840 or the fuel injection device 2305 before adjusting the step-up voltage application time Tp. By adjusting the peak current value $I_{peak}$ for each individual, compared with a case when the step-up voltage application time Tp is adjusted, variations of the current flowing to the solenoid 105 and the valve operation originating therefrom due to variations of the voltage value of the step-up voltage VH of the drive device can be reduced to a minimum and thus, the appropriate deceleration timing for the fuel injection device 840 or the fuel injection device 2305 of each cylinder can be adjusted. By adjusting the peak current value $I_{peak}$ and the drive voltage cutoff time T2 for each fuel injection device of each cylinder, individual variations of the speed when the needle 102 or the second needle 1902 collides against the fixed core 107 can be reduced and thus, drive sound during valve opening caused by the collision can be reduced, achieving an effect of making the engine more silent. By reducing the collision speed of the needle 102 or the second needle 1907 against the fixed core 107, an impact force working on the collision surface of the needle 102 or the second needle 1907 and the fixed core 107 can be reduced and deformation and abrasion of the collision surface can be prevented and thus, changes of the target lift quantity due to degradation can be inhibited. According to the effect in the present example, the collision speed of the needle 102 or the second needle 1907 against the fixed core 107 can be reduced and maintained constant regardless of individual fuel injection devices of each cylinder and thus, hardness of materials needed to prevent deformation and abrasion of the collision surface can be decreased and plating formed on the end face on the fixed core 107 side of the needle 102 or the needle 1907 and the end face on the needle 102 side of the fixed core 107 is not needed so that significant cost reductions can be achieved. Without plating, variations of the flow rate per unit time accompanying individual variations of the target lift caused by individual variations of the plating thickness and variations of the squeezing force accompanying variations of the fluid gap between the needle 102 and the fixed core 107 in a valve open state can be inhibited and thus, precision of the injection quantity can be improved.

When the valve body 114 or the second valve body 1907 reaches the target lift, the needle 102 or the second needle 1907 comes into contact with the fixed core 107, and the valve body 114 or the second valve body 1907 comes to rest in the target lift position, the fuel injected from the fuel injection device 840 or the fuel injection device 2305 has a fixed flow rate and the injection quantity can be increased in proportion to an increase of the injection pulse width Ti so that the injection quantity can be controlled with precision.

By correcting the value of one of the peak current value $I_{peak}$ and the step-up voltage application time Tp and the voltage cutoff time T2 such that the injection quantity is the same for each fuel injection device of each cylinder, the value of the dead zone Tn of injection quantity characteristics generated when a current cutoff waveform is used is different from fuel injection device to fuel injection device of each cylinder. If the value of one of the peak current value $I_{peak}$ and the step-up voltage application time Tp and the voltage cutoff time T2 using detection information, the dead zone Tn is determined. Thus, by configuring the CPU 801 or the IC 802 so as to be able to set a different value of the dead zone Tn for the fuel injection device 840 or the fuel injection device 2305 of each cylinder, it becomes possible to control by continuously changing from the intermediate lift region $T_{harf}$ where the injection pulse width Ti is small and the valve body 114 does not reach the target lift to the injection quantity of the minimum injection quantity 3003 and thereafter after the valve body reaches the target lift so that the injection quantity can be controlled by fitting to engine operating conditions.

In the valve closing operation, the passage of current to the switching elements 807, 806 is stopped at time $t_{2704}$ when the injection pulse width Ti as a valve opening signal time and the step-up voltage VH in the negative direction is applied to the solenoid 105 to rapidly decrease the current flowing to the solenoid 105, which decreases the magnetic suction force. The operation of the valve body 114 or the second valve body 1907 in the valve closing direction is started at time $t_{2705}$ when the magnetic suction force falls below the force in the valve closing direction and the valve closing is finished at time $t_{2706}$. In the fuel injection device 2305, however, after the second valve body 1907 finishes closing, the load by the set spring 110 continues to act on the second valve body 1907 in the valve closing direction of the valve body driving force. In the force in the valve closing direction of the valve body driving force before the valve opening start and after the valve closing finish shown in FIG. 27, the valve body driving force when the fuel injection device 2305 is used is shown. By detecting and storing the valve closing finish lag time Tb as a time after the injection pulse width Ti is turned on till the valve closing finish timing of the valve body 114 or the second valve body 1907, if there is any deviation from the lag time of the target setting value, the setting of the holding current value Ih in the target lift position may be increased or decreased to adjust to the standard lag time. In addition, when individual variations of the valve closing finish lag time are corrected after the drive current and the drive voltage of the fuel injection device of each cylinder are corrected, the actual injection period (Tb−Ta') in which the valve body 114 or the second valve body 1907 is actually open can be controlled to the actual injection period needed to realize the required injection quantity by correcting the injection pulse width Ti, decreasing the injection pulse width Ti for the fuel injection device having a large valve closing finish lag time and increasing the injection pulse width Ti for the fuel injection device having a small valve closing finish lag time so that correction precision of the injection quantity can be improved.

The operating state when the minimum injection quantity is implemented while the valve body 114 or the second valve body 1907 is caused to reach the target lift is shown in FIG. 28. A valve opening signal, that is, the injection pulse is turned on at time $t_{2801}$, a current is passed to the switching elements 805, 806, and the step-up voltage VH is applied to the solenoid 105 from the second voltage source to generate a magnetic suction force in the needle 102 or the second needle 1902. Then, when the peak current $I_{peak}$ is reached or the step-up voltage application time Tp is reached, the application of the step-up voltage VH is stopped by stopping the current to the switching elements 805, 805, the step-up voltage VH in the negative direction is applied to rapidly decrease the current flowing to the solenoid 105, which decreases the magnetic suction force acting on the needle 102 or the second needle 1902. A current is passed to the switching elements 806, 807 after the setting time of the voltage cutoff time T2 in which the voltage in the drive direction, that is, the voltage in the positive direction is cut off ends and when the injection pulse width Ti is turned on as a valve opening signal time in the timing when the voltage is applied from the battery voltage VB to the solenoid 105, the second valve body 114 or the second valve body 1907 having reached the target lift position therearound changes to an operation in the valve closing direction in the timing when the magnetic suction force falls below the force in the valve closing direction of the valve body driving force and thereafter to continue to perform the valve closing operation without coming to rest in the target lift position. To perform the operation of the minimum injection quantity in the full lift, if the injection pulse width Ti during the operation increases, the time during which the valve body 114 rests in the target lift position needs to be longer for the increase. That is, when the minimum injection quantity is implemented, the rest time in the target lift position is ideally close to 0 second unlimitedly and if the valve opening signal time, that is, the injection pulse width Ti is increased, the time during which the valve body rests in the target lift position becomes longer for an increased time and with an increased injection quantity after the increased valve closing finish timing in accordance with an increase of the rest time, control may be exercised such that the injection pulse width Ti and the fuel injection quantity q are linearly related.

If the fuel pressure supplied to the fuel injection device 840 or the fuel injection device 2305 changes, the peak current $I_{peak}$ needed for the valve body 114 or the second valve body 1907 to reach the target lift and the holding current value Ih capable of holding the valve body 114 or the second valve body 1907 in a valve open state. If the fuel pressure increases in a state in which the valve body 114 or the second valve body 1907 is closed, a force obtained as a product of the pressure receiving area of the seat diameter and the fuel pressure acts on the valve body 114 or the second valve body 1907 and thus, kinetic energy of the needle 102 or the needle 1902 needed for the valve body 114 or the second valve body 1907 to start valve opening changes. When the displacement of the valve body 114 or the second valve body 1907 is started by the collision of the needle 102 or the needle 1907 against the valve body 114 or the second valve body 1907, the velocity of flow of the fuel flowing in the seat portion of the valve body 114 or the second valve body 1907 increases and under the influence of a pressure drop (static pressure fall) based on the Bernoulli's theorem, the pressure of the fuel flowing near the seat portion decreases rapidly and a pressure difference between the pipe side and the tip portion of the valve body 114 or the second valve body 1907 increases so that the differential pressure force acting on the valve body 114 or the second valve body 1907 increases. In accordance with an increase or a decrease of the differential pressure force, the peal current value $I_{peak}$, the voltage cutoff time T2, and the holding current value Ih that are needed may preferably be adjusted. When the holding current value Ih of the drive current is maintained constant and used under the condition of the fuel pressure in a wide range having different loads of an engine, it is necessary to set a high holding current value Ih capable of generating a magnetic suction force working on the needle 102 or the second needle 1902 such that the valve body 114 or the second valve body 1907 can be held in a valve open state by a high fuel pressure. If the valve body 114 or the second valve body 1907 is driven under the condition of reaching the target lift at low fuel pressure using a high holding current value Ih, the magnetic suction force generated in the needle 102 or the second needle 1907 increases when the injection pulse width Ti is stopped and also the valve closing lag time increases and the injection quantity increases. Therefore, in a configuration in which a command signal is sent from the ECU 120 to the drive circuit 121, an appropriate holding current value Ih in accordance with the fuel pressure may preferably be set using a signal from the pressure sensor mounted on a fuel pipe upstream of the fuel injection device 840 or the fuel injection device 2305 and detected by the ECU.

Like changes of the fuel pressure, individual variations of the fuel injection device 840 or the fuel injection device 2305 of each cylinder change and the holding current value Ih needed to hold the valve body 114 or the second valve body 1907 in a valve open state changes depending on variations of the load of the spring 110. For an individual in which the load by the spring 110 is large, the magnetic suction force needed to hold the valve body 114 or the second valve body 1907 in a valve open state increases and thus, it is necessary to set a large holding current value Ih. The load of the spring 110 is adjusted in a process in which the injection quantity of the fuel injection device 840 or the fuel injection device 2305 is adjusted. Thus, the valve opening lag time and valve closing lag time and the load of the spring 110 are strongly correlated and thus, the load of the spring 110 can be estimated from the valve opening/closing lag time. By causing the drive device to store information of the load by the spring 110 estimated for each cylinder, the timing when the needle 102 or the second needle 1907 is decelerated is determined based on information of the load of the spring 110 and the valve opening lag time and the bound of the needle 102 or the second needle 1902 from the fixed core can be inhibited by correcting the peak current value $I_{peak}$ or the step-up voltage application time Tp and the voltage cutoff time T2 for the fuel injection device 840 or the fuel injection device 2305 of each cylinder and therefore, continuity of injection quantity characteristics driven from the intermediate lift to the full lift can be secured and the injection quantity can be controlled more easily.

In addition to adjustments of the peak current value $I_{peak}$ or the step-up voltage application time Tp and the voltage cutoff time T2 to reduce individual variations of the fuel injection device 840 or the fuel injection device 2305 of each cylinder, adjustments of the current waveform by fuel pressure can effectively be made. A differential pressure force acting on the second valve body 1907 due to fuel pressure increases with an increasing fuel pressure and thus, the timing when the second valve body 1907 is decelerated after stopping the current to the switching element 805 and the switching element 806, applying the step-up voltage VH in the negative direction to the solenoid 105, and cutting of the peak current value $I_{peak}$ becomes earlier and also the bound of the second valve body 1907 caused by the collision of the second needle 1902 against the fixed core 107 after the second valve body 1907 reaches the target lift position. Therefore, by increasing the peak current value $I_{peak}$ with an increasing fuel pressure, the collision speed of the second needle 1902 and the fixed core 107 can be reduced while the peak current value $I_{peak}$ needed for the second valve body 1907 to reach the target lift is secured so that nonlinearity of injection quantity characteristics can be reduced and variations of the injection quantity can be reduced. If the peak current value $I_{peak}$ is increased, the timing when the application of the step-up voltage VH is stopped by stopping the current to the switching elements 805, 806 is delayed and also the voltage cutoff time T2 is delayed by being linked thereto. The voltage cutoff time T2 may be configured to decrease with an increasing fuel pressure. By adopting the above configuration, when a differential pressure force acting on the valve body 114 or the second valve body 1907 increases with an increasing fuel pressure, the collision speed of the needle 102 or the second needle 1902 and the fixed core 107 decreases and also the timing for deceleration is delayed so that appropriate deceleration timing can be set. The fuel pressure and the differential pressure force acting on the valve body 114 or the second valve body 1907 have a linear relationship and thus, in accordance with the fuel pressure, correction coefficients to determine the peak current value $I_{peak}$ or the step-up voltage application time Tp and the holding current value Ih may preferably be provided to ECU or the drive circuit in advance. By adjusting the peak current value $I_{peak}$ and the holding current value Ih described above for the fuel injection device 840 or the fuel injection device 2305 of each cylinder and each fuel pressure supplied to the fuel injection device 840 or the fuel injection device 2305, the current to be used can be reduced and therefore, heating of the solenoid 105 and heating of ECU of the fuel injection device 840 or the fuel injection device 2305 can be reduced and an effect of being able to reduce energy consumption can be achieved. In addition, the time when the step-up voltage VH is applied is reduced and thus, the load of the step-up circuit can be reduced and the step-up voltage VH when the next injection pulse width is requested in divided injection can be maintained constant and therefore, the injection quantity can be controlled correctly.

Next, the operation to use a region (called an intermediate lift region) where the valve body 114 is prevented from reaching the target lift by the control technique in Example 2 of the present invention is shown in FIG. 29. In the present operation, to realize an injection quantity further smaller than the minimum injection quantity when the target lift is allowed to be reached, the injection quantity is reduced by lowering the peak current value $I_{peak}$ below the standard setting value for a decrease of the injection quantity. That is, when an injection quantity smaller than the injection quantity by the operation shown in FIG. 28 is realized, the injection pulse width Ti as a valve opening time signal, the setting value of the peak current value $I_{peak}$, and the setting value of the step-up voltage application time Tp may be changed. As shown in FIG. 28, by setting to a setting value Ip' smaller than the standard peak current value $I_{peak}$, the application of the step-up voltage VH is stopped at time $t_{2902}$ when the current flowing through the solenoid 105 reaches Ip'. Accordingly, the step-up voltage VH in the negative direction is applied to the solenoid 105 and the current flowing through the solenoid 105 decreases rapidly and the magnetic suction force is thereby reduced. However, in a region where fuel to be injected is small and the displacement of the valve body 114 is small, the valve body 114 or the second valve body 1907 is started to open by an impulse and kinetic energy received by the valve body 114 or the second valve body 1907 after the collision of the needle 102 or the second needle 1902 against the valve body 114 or the second valve body 1907 and thus, the application of voltage to the solenoid 105 in the positive direction may preferably be stopped before time t2904 when the valve body 114 starts to open. The stop of the voltage in the positive direction may be controlled by the step-up voltage application time Tp between the time when the injection pulse is turned on, the current is passed to the switching element 805 and the switching element 806, and the step-up voltage VH is applied to the solenoid 105 and the time when the current to the switching element 805 and the switching element 806 is stopped and the step-up voltage VH in the negative direction is applied to the solenoid 105 or the setting value Ip'. Kinetic energy generated in the needle 102 in timing before the valve body 114 starts to open can be controlled by the step-up voltage application time Tp or the setting value Ip' and the displacement of the valve body 114 can be controlled. The valve body 114 does not reach the target lift in the intermediate lift operation and thus, the displacement of the valve body 114 is not regulated by the mechanism and a slight change of fuel pressure or the like is likely to lead to individual variations of the injection quantity. Therefore, by detecting valve closing finish timing t2905 as a time when the first differential value of the voltage VL4 takes the minimum value or the second differential value of the voltage VL takes the minimum value after the injection pulse is turned on for each fuel injection device of each cylinder and causing the drive device to store the valve closing finish timing t2905, whether the valve closing finish timing matches the valve closing finish timing or the injection period to realize the required injection quantity is checked by the ECU 120 or the EDU 121 and if deviated from the target value, the precision of the actual injection quantity with respect to the required injection quantity can be improved by increasing or decreasing the setting value Ip' of the peak current for the next injection. Similarly, when the step-up voltage application time Tp is set, the precision of the actual injection quantity with respect to the required injection quantity can be improved by detecting the valve closing finish timing t2904 by the drive device and adjusting the step-up voltage application time Tp such that the valve closing finish timing t2904 matches the valve closing finish timing or the injection period to realize the required injection quantity.

Example 4

Figure 31:
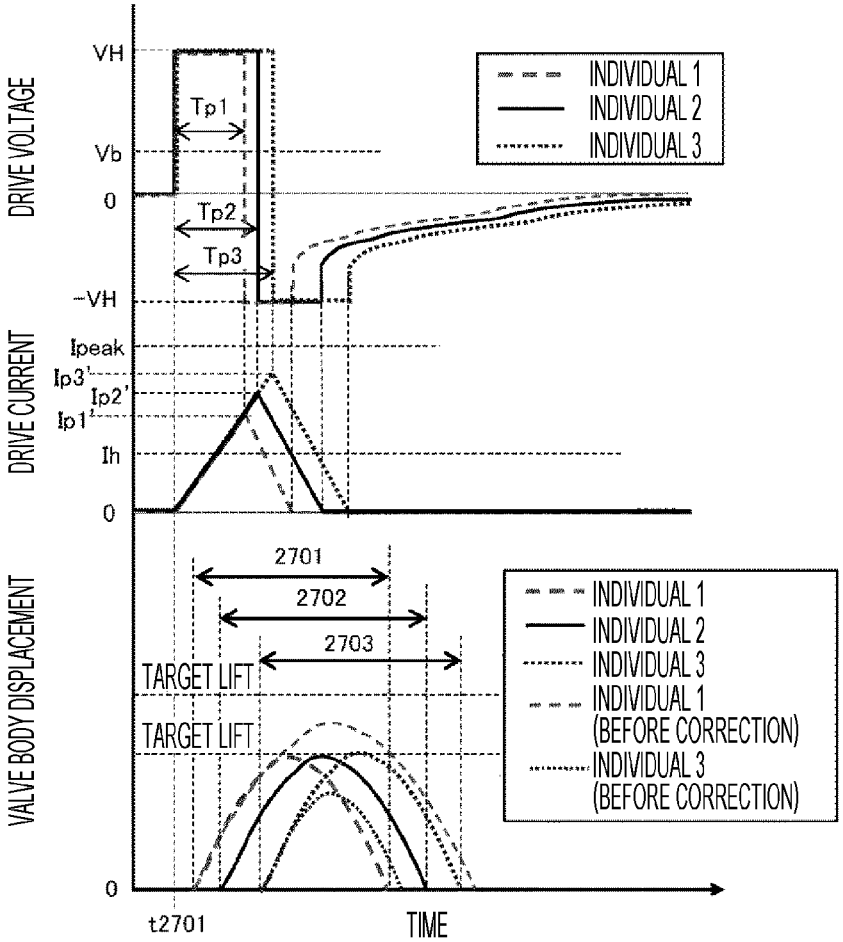
FIG. 31 is a diagram illustrating the relationship between the drive voltage, the drive current, and the valve body displacement of each individual as a result of correcting the injection pulse, the drive voltage, and the drive current such that an injection period (Tb−Ta') matches for individuals having the valve opening start timing Ta' and the valve closing finish timing Tb of the valve body or the second valve body that are mutually different under the condition of supplying the same injection pulse width Ti and the time.
Figure 32:
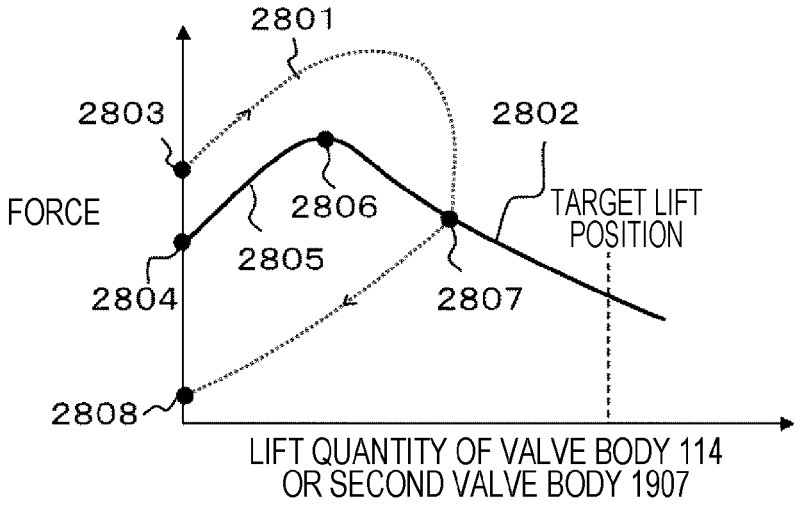
FIG. 32 is a diagram illustrating the relationship between the lift of the valve body or the second valve body according to Example 4 of the present invention in the case of the intermediate lift in which the target lift of the second valve body is not reached and a force acting on the valve body or the second valve body.

The control technique to correct the injection quantity in Example 4 of the present invention will be described using FIGS. 31 to 34. FIG. 31 is a diagram showing the relationship between the drive voltage, the drive current, and the valve body displacement of each individual as a result of correcting the injection pulse, the drive voltage, and the drive current such that an injection period (Tb−Ta') matches for individuals having the valve opening start timing Ta' and the valve closing finish timing Tb of the valve body 114 or the second valve body 1907 that are mutually different under the condition of supplying the same injection pulse width Ti to individuals 1, 2, 3 of the fuel injection device of each cylinder and the time. In the valve body displacement of FIG. 31, the displacements of the individuals 1, 3 when the same injection pulse width, drive voltage, and drive current as those of the individual 2 are supplied are shown. FIG. 32 is a diagram showing the relationship between the lift of the valve body 114 or the second valve body 1907 in the case of the intermediate lift in which the valve body 114 or the second valve body 1907 reaches the target lift and a force acting on the valve body 114 or the second valve body 1907.

As described with reference to FIG. 6 in Example 1, even if the same injection pulse width is supplied, the timing of the valve operation, that is, the valve opening start timing Ta' and the valve closing finish timing Tb of the valve body 114 or the second valve body 1907 are different from fuel injection device to fuel injection device of each cylinder under the influence of variations of the dimensional tolerance or the like and individual variations of the injection quantity arise, after the valve body 1907 separates from the valve seat 118, due to variations of the actual injection period (Tb−Ta') in which fuel is injected from individual to individual. In the control method in Example 3 of the present invention, the control method of fuel injection that inhibits individual variations of the injection using detection information of the valve opening start timing, valve opening finish timing, and valve closing finish timing described in Example 1 and Example 2 and the drive device is caused to store will be described. From FIG. 27, the correction method of individual variations of the injection quantity in the minimum injection quantity having the smallest injection quantity under a certain fuel pressure. For the individual 1 (before corrections) whose valve opening start timing Ta' is earlier, if the same injection pulse width, drive voltage, and drive current as those of the individual 2 are supplied, the valve closing finish timing Tb becomes later because compared with the individual 2, the maximum value of the valve body displacement in the timing when the current supply is stopped is large and as a result, compared with the individual 2, the injection period is large and the injection quantity is large. For the individual 1 (before corrections) whose valve opening start timing Ta' is later, if the same injection pulse width, drive voltage, and drive current as those of the individual 2 are supplied, the valve closing finish timing Tb becomes earlier because compared with the individual 2, the valve body displacement in the timing when the current supply is stopped is small and as a result, compared with the individual 2, the injection period is small and the injection quantity is small. For the individual 1 (before corrections) whose injection period is large, parameters may preferably be corrected so that the injection period matches the injection period 2702 of the individual 2 by making the injection pulse Ti smaller, making the period in which the step-up voltage VH is applied smaller like Tp1, or making the peak current value Ipeak of the drive current smaller like Ip1'. On the other hand, for the individual 3 (before corrections) whose injection period is small, parameters may preferably be corrected so that the injection period matches the injection period 2702 of the individual 2 by making the injection pulse Ti larger, making the period in which the step-up voltage VH is applied larger like Tp3, or making the peak current value Ipeak of the drive current larger like $Ip^{3'}$. If the injection period is corrected by using the peak currents Ip1', Ip2', Ip3' of the drive current, even if the resistance of the solenoid 105 changes due to temperature changes or the voltage value of the step-up voltage VH varies, variations of the displacement of the valve body 114 or the second valve body 1907 can be reduced to a minimum and unintended variations of the injection period accompanying environmental changes can be inhibited. If the injection period is corrected by using the application times Tp1, Tp2, Tp3 of the step-up voltage, compared with the method of using the peak current of the drive current, the time resolution can be made smaller and thus, an effect of improving the correction precision of the injection period is achieved. This is because the set resolution of the peak current value depends on the resistance value of the resistor 808 or the resistor 812 to detect the current value. While the set resolution of the peak current value improves with a decreasing resistance value, it is difficult for the IC 802 to detect the current value that is too small. The stop timing of the drive voltage to adjust the injection period may be set to be a time when a fixed time passes after the target current value is reached. Due to the above effect, even if the resistance of the solenoid 105 changes, unintended variations of the injection period can be inhibited and also the time resolution of the stop timing of the drive voltage can be improved and therefore, the correction precision of the injection period and the correction precision of individual variations of the injection quantity can be improved.

The valve body 114 or the second valve body 1907 during intermediate lift operation and the relation of forces acting on the valve body will be described using FIG. 32. Reference numeral 2801 shown in FIG. 28 is a force (mainly a magnetic suction force) in the valve opening direction and reference numeral 2802 is the sum of a differential pressure force as a force in the valve closing direction and acting on the valve body 114 or the second valve body 1907 and a load by the set spring 110. The load by the set spring 110 acts on the needle 102 while the valve body 114 is closed, but in FIG. 28, the load is assumed to act on the valve body 114 as a force in the valve closing direction at the instant to start to open. In the case of the second valve body 1907, the load by the set spring directly acts on the second valve body 1907. For the valve body 114 and the second valve body 1907, directions of forces of the initial position spring 1909 and the return spring 112 are different, but these forces are smaller than the magnetic suction force, the load by the set spring, and the differential pressure force acting on the valve body and thus, the description thereof is omitted. First, when a current is supplied to the solenoid 105, the magnetic suction force is generated in the needle 102 or the needle 1902 and if the magnetic suction force exceeds the load by the set spring 110, the needle 102 starts to be displaced and the needle 102 collides against the valve body 114 or the second valve body 907 at 2803 and the valve body 114 or the second valve body 1907 starts to open. In a fuel injection device according to Example 2, the load by the set spring acts on the second valve body 1907 and the second needle 1907 does not receive the loads by the set spring 110 before colliding against the second valve body 1907. Of the load by the set spring and the differential pressure force as the force 2802 in the valve closing direction, even if the valve body 114 or the second valve body 1907 is displaced, the set spring force is varied by the force as a product of the displacement and a spring constant and so is almost constant with respect to the displacement of the valve body. On the other hand, the differential pressure force acts as a constant value obtained as the product of the area of a seat diameter ds and the fuel pressure while the valve body 114 or the second valve body 1907 is closed, but when the displacement of the valve body 114 or the second valve body 1907 starts, the differential pressure force increases with the displacement like 2805. This is because under the condition of a small displacement of the valve body 114 or the second valve body 1907, the channel cross section of the seat portion is small and the velocity of flow of the fuel increases and thus, the pressure near the seat portion falls due to a pressure drop based on the Bernoulli's theorem. When the displacement of the valve body 114 or the second valve body 1907 reaches a certain value 2806, the cross section of the seat portion increases and the velocity of flow of the fuel flowing in the seat portion decreases and thus, the influence of the pressure drop decreases and the differential pressure force acting on the valve body 114 or the second valve body 1907 decreases with an increasing displacement of the valve body. The differential pressure force in the valve closing direction has, as described above, a profile of increasing in a region where the displacement of the valve body 114 or the second valve body 1907 is small and decreasing in a region where the displacement is large.

Because the valve body 114 or the second valve body 1907 receives kinetic energy of the needle 102 or the second needle 1907 in the valve opening start timing, the force in the valve opening direction at 2803 is larger than the force in the valve closing direction at 2804 and the force in the valve opening direction exceeds the maximum force in the valve closing direction at 2806 to perform a valve opening operation. Then, when the injection pulse Ti is turned off, the magnetic suction force decreases accompanying the disappearance of an eddy current and when the force in the valve opening direction falls below the force in the valve closing direction at 2807, the displacement of the valve body 114 or the second valve body 1907 starts to decrease and the valve body 114 or the second valve body 1907 performs a valve closing operation. According to the control method in Example 3 of the present invention, a stable intermediate lift operation is performed after the force in the valve opening direction exceeds the force in the valve closing direction and therefore, a valve closing operation may preferably be started by the valve body 114 or the second valve body 1907 after 1806 where the differential pressure force takes the maximum value. When the valve body 114 or the second valve body 1907 starts to close near 2806 where the differential pressure force takes the maximum value, the displacement of the valve body 114 or the second valve body 1907 varies when the force in the valve opening direction exceeds the maximum value 2806 due to a slight variation of force and when the force in the valve opening direction does not exceed the maximum value, making the valve body more likely to be subject to changes of environmental conditions such as the fuel pressure.

Figure 33:
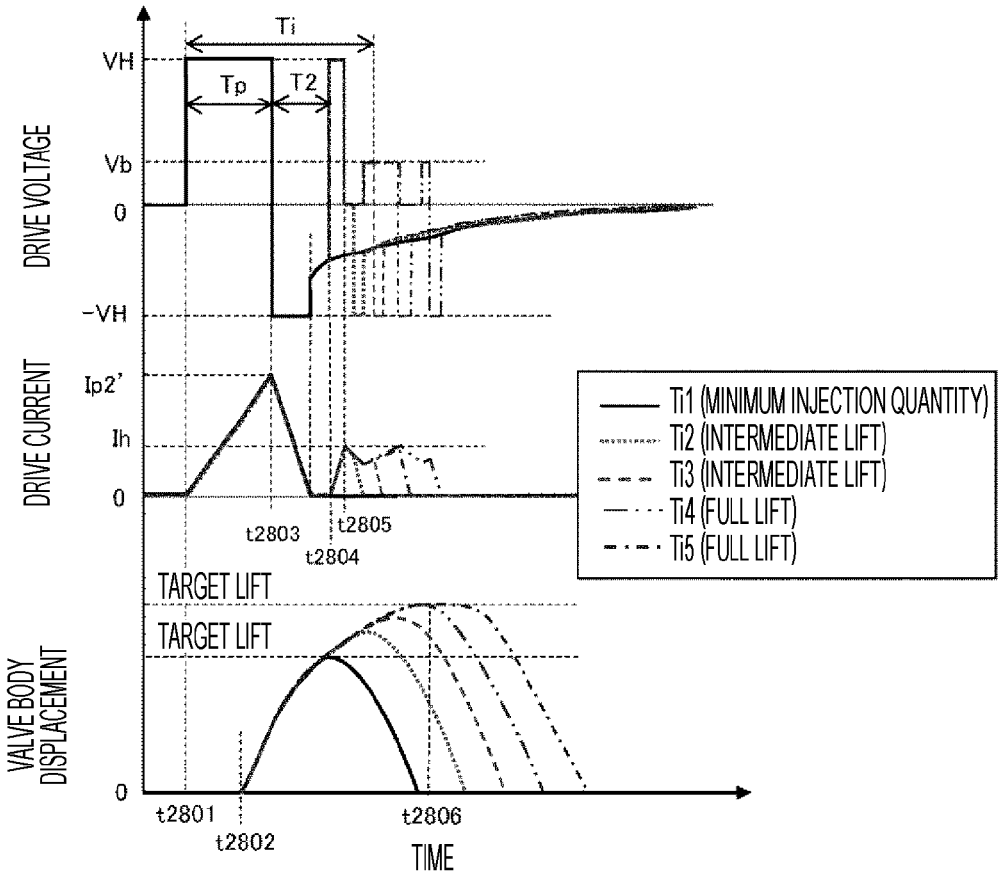
FIG. 33 is a diagram illustrating an adjustment method of the injection quantity after the injection period in the minimum injection quantity is adjusted in Example 4 of the present invention.
Figure 34:
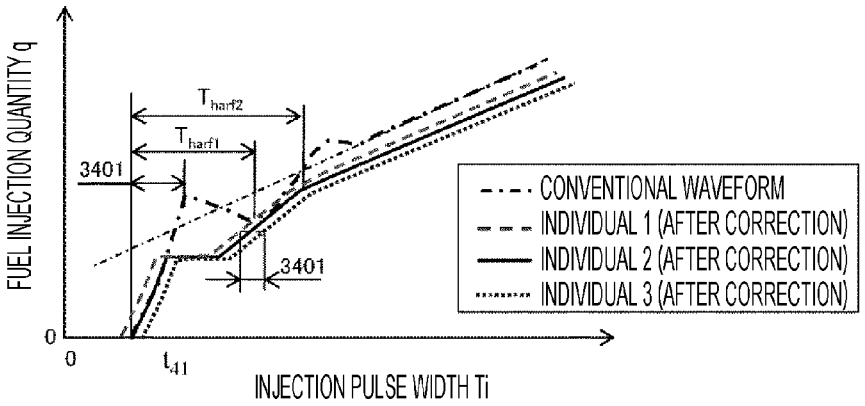
FIG. 34 is a diagram illustrating the relationship between the injection pulse and the injection quantity after the injection period in the minimum injection quantity is adjusted in Example 4 of the present invention.

Next, using FIGS. 33 and 34, the control method of the injection quantity after the injection quantity in the minimum injection quantity is adjusted. FIG. 33 is a diagram showing an adjustment method of the injection quantity after the injection period in the minimum injection quantity is adjusted. FIG. 34 is a diagram showing the relationship between the injection pulse and the injection quantity after the injection period in the minimum injection quantity is adjusted. From FIG. 33, Tp in the minimum injection quantity is adjusted, as described above, for the fuel injection device 840 or the fuel injection device 2305 of each cylinder to match injection periods. Then, to control the injection quantity in the intermediate lift, the current is passed to the switching elements 805, 806 and the step-up voltage VH is applied to the solenoid 105 after T2 end timing t2804 to cause the current to change to the holding current Ih. Then, the energization time of the injection pulse Ti is increased to cause the valve body 114 or the second valve body 1907 to reach the target lift position in contact with the fixed core 107. If changes of the valve closing finish timing caused by increasing the injection pulse Ti in the fuel injection device 840 or the fuel injection device 2305 of each cylinder are different from individual to individual in Ti2, Ti3 when an intermediate lift operation is performed after the injection pulse width Ti1 in the minimum injection quantity, the holding current value Ih2 is increased for individuals having small changes of the valve closing finish timing to exercise learning control such that injection periods match by increasing the magnetic suction force. For individuals having large changes of the valve closing finish timing, on the other hand, the magnetic suction force may preferably be decreased by reducing the holding current value Ih1 to exercise learning control such that injection periods match. By adjusting the current value of the holding current Ih for each individual of each cylinder as described above, the valve body can be caused to reach the target lift in a stable manner so that the correction precision of the injection quantity can be improved.

By controlling the displacement of the valve body 114 or the second valve body 1907 by the method described above, in the injection quantity characteristics shown in FIG. 34, compared with the gradient of the injection pulse width Ti and the injection quantity in an interval 3401 of the conventional waveform in an intermediate lift region, the gradient of the injection pulse width Ti and the injection quantity in an interval $T_{harf2}$ is small and the intermediate lift region to reach the target lift is extended from $T_{harf1}$ to $T_{harf2}$. In the interval 3401 with an intermediate lift of the conventional waveform, the injection quantity changes significantly relative to changes of the injection pulse width and thus, when the minute injection quantity control is exercised, it is unavoidable to finely set the time resolution of the injection pulse width Ti or the step-up voltage application time Tp and a drive device of the CPU 801 of a high clock rate needs to be used, leading to increased costs of the drive device. Because the relationship between the fuel injection quantity and the injection pulse width Ti is nonlinear between the interval 3401 having the intermediate lift and the target lift region, it is necessary to detect information of the injection period in the injection pulse width Ti at each point to control the injection quantity and storage capacities of the drive device become scarce and further, the injection quantity after the end of the interval 3401 may change significantly due to changes of environmental conditions or the like, which makes it difficult to improve the correction precision of the injection quantity and robustness, According to the control technique in Example 3 of the present invention, the difference between the gradient of the injection pulse width Ti and the injection quantity q in the intermediate lift region and the gradient of the injection pulse width Ti and the injection quantity q after the target lift is reached can be made small compared with the control technique using the conventional waveform and also the relationship between the injection pulse width Ti and the injection quantity q after the target lift is reached from the intermediate lift region is linear so that the injection quantity can advantageously be corrected and controlled more easily. As a result of individually adjusting the drive voltage and the current waveform of the fuel injection device 840 or the fuel injection device 2305 of each cylinder as described above, injection quantity characteristics are characteristics obtained by parallel translation in the direction of the injection pulse width Ti and have a deviation 3401 for the parallel translation in some fuel injection device q. However, the injection period that determines the fuel injection quantity q is detectable by the drive device for each cylinder and thus, individual variations can be controlled to correct the injection quantity by correcting the deviation 3401 for the parallel translation by the injection pulse width Ti for each cylinder. When the relationship between the injection pulse width and the fuel injection quantity is approximately linear in the intermediate lift region, if information of the injection period to detect the gradient thereof is available at two points, the gradient and an intercept of the correction formula thereof can be derived. The fuel injection quantity q increases linearly with an increasing injection pulse width Ti in the target lift region and thus, the relationship between the injection pulse width Ti and the fuel injection quantity q can be approximated by an approximately linear function and the gradient and intercept of the function can be derived from information of the injection period at two points or more. The injection pulse width Ti switching from the intermediate lift to the target lift can be calculated as a point where the fuel injection quantity q of the linear function in the intermediate lift and the fuel injection quantity q of the linear function in the full lift overlap and the correction formula of the injection quantity in the intermediate lift region and the correction formula of the injection quantity in the target lift and thereafter may preferably be configured to be switchable.

Example 5

Example 5 of the present invention is an embodiment showing an example in which the fuel injection device described in Examples 1 to 4 and the control method thereof are mounted on an engine.

Figure 35:
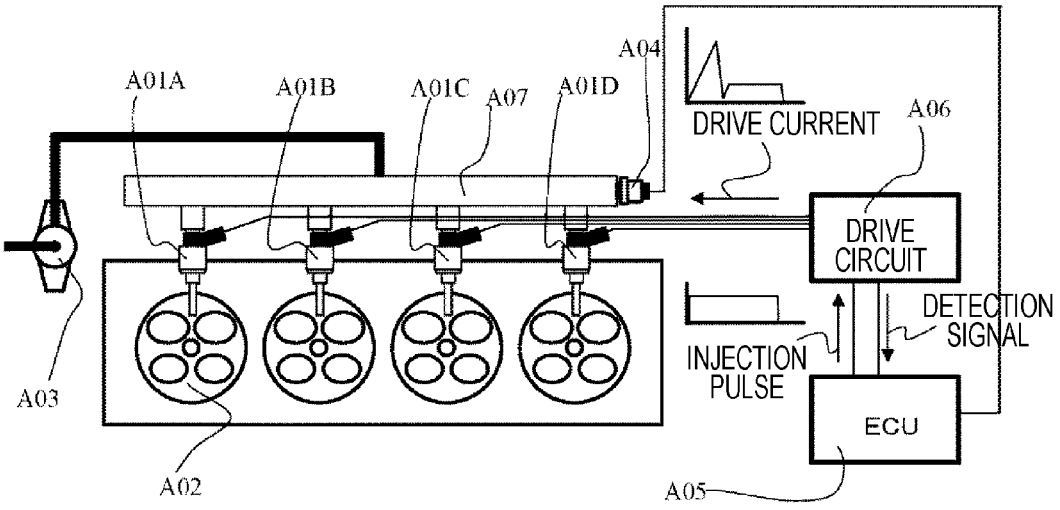
FIG. 35 is a configuration diagram of a gasoline engine of cylinder direct injection type according to Example 5 of the present invention.

FIG. 35 is a configuration diagram of a gasoline engine of cylinder direct injection type and fuel injection devices A01A to A01D are installed such that a fuel spray from injection holes thereof is directly injected into a combustion chamber A02. Fuel is sent out to a fuel pipe A07 after being pressurized by a fuel pump A03 and delivered to a fuel injection device A01. The fuel pressure is varied by the balance of the fuel quantity discharged by the fuel pump A03 and the fuel quantity injected into each combustion chamber by the fuel injection device provided for each cylinder of an engine and the discharge quantity from the fuel pump A03 is controlled by setting a predetermined pressure based on information of a pressure sensor A04 as a target value.

The injection of fuel is controlled by the injection pulse width sent out from an ECU engine control unit (ECU) A05, and the injection pulse is input into a drive circuit A06 of the fuel injection device and the drive circuit A06 determines the drive current waveform based on a command from the ECU A05 to supply the drive current waveform to the fuel injection device A01 only for a time based on the injection pulse.

Incidentally, the drive circuit A06 may be implemented as a component or a board integrated with the ECU A05.

The ECU A05 and the drive circuit A06 have capabilities capable of changing the drive current waveform depending on the fuel pressure and operating conditions.

When, in such an engine, the ECU A05 has, as described in Examples 1 to 9, capabilities to detect the valve opening and valve closing operations of the fuel injection device A01, methods of controlling the engine easily, reducing fuel consumption or exhaust, and inhibiting vibration of the engine by reducing variations of the combustion pressure between cylinders will be described.

Figure 36:
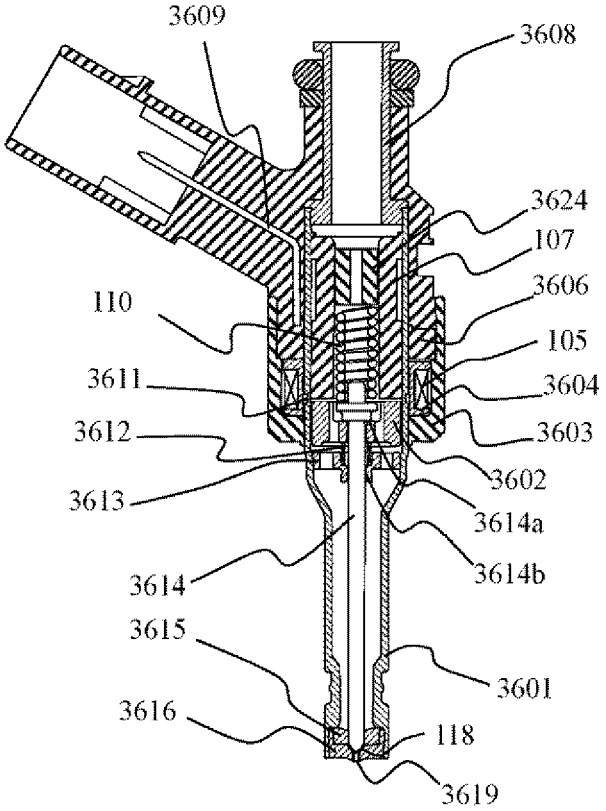
FIG. 36 is a diagram illustrating the configuration of a longitudinal view of the fuel injection device according to Example 6 of the present invention.

In the ECU A05 used in the engine shown in FIG. 36, the injection pulse width of the fuel injection device A01 is corrected such that the fuel quantity injected from the fuel injection devices A01A to A01D approaches the value requested by the ECU A05. That is, in a multiple cylinder engine, the drive pulses of different widths corrected for each cylinder are provided to respective fuel injection devices.

For example, a fuel injection device that injects more fuel when the same command pulse is given is driven by providing a shorter pulse width and a fuel injection device that injects less fuel when the same command pulse is given is driven by providing a longer pulse width. By including an operating mode that makes such corrections for each cylinder, variations of the fuel injection quantity between cylinders can be inhibited.

Further in the ECU A05 shown in FIG. 35, the drive current supplied to the fuel injection devices A01A to A01D of each cylinder is supplied in a waveform adjusted for each fuel injection device.

Each current waveform is set such that rebound behavior of the valve of each of the fuel injection devices A01A to A01D when the valve opened is diminished and as a result, can be set such that the range of the pulse width in which the relationship between the injection pulse width and the injection quantity approaches a linear relation is expanded.

To diminish rebound behavior when the valve is opened, for example, the time to supply the step-up voltage VH of the drive waveforms from the step-up voltage source to the solenoid 105 or the peak current value $I_{peak}$ is adjusted by controlling the passage/stop of current to the switching elements 805, 806, 807 to fit to the valve opening timing of the fuel injection device of each cylinder and the supply from the step-up voltage source is set to be stopped while the valve is opened to decelerate the valve. For example, the timing to stop the supply from the step-up voltage source is made earlier for a fuel injection device that opens the valve earlier when a certain current waveform is given and the timing to stop the supply from the step-up voltage source is set later for the fuel injection device 840 or the fuel injection device 2305 that opens the valve later. By using a drive waveform that decelerates the valve opening operation after the supply from the step-up voltage source is stopped, changes of the injection quantity with respect to changes of the injection pulse width Ti in a region of a minute injection quantity can be made smaller and an effect of being able to correct the injection quantity by the injection pulse width Ti more easily is achieved.

By providing a drive current waveform that decelerates the valve body 114 fitting to variations of the valve opening finish timing of the fuel injection device 840, 2305 of each cylinder, the current waveform suitable to the fuel injection device of each cylinder can be provided so that the range in which the relationship between the injection pulse and the injection quantity is linear can be expanded.

The passage current value (holding current value) to hold a valve open state of the drive waveforms may be adjusted in accordance with the valve closing timing of each fuel injection device. If the valve closing timing obtained when the fuel injection device is driven according to some drive current waveform is late, the holding current value is set small and if the valve closing timing is early, the holding current value is set relatively large. By setting the holding current value of the drive current waveforms by fitting to the state of the fuel injection device as described above, a case of providing an excessive current value can be prevented. By preventing a case of providing an excessive current value, a response delay time of valve closing can be reduced when the injection pulse width is small and the range in which the relationship between the injection pulse width and the injection quantity is a straight line can be expanded to the side of a smaller injection pulse width.

To inhibit individual variations of the injection quantity of the fuel injection device 840 or the fuel injection device 2305 of each cylinder in an intermediate lift operation, a method of controlling the step-up voltage application time Tp or the peak current value $I_{peak}$ so that, based on information of the valve opening start timing Ta' and the valve opening finish timing Tb for each individual detected by the drive device, the actual injection period (TB−Ta') matches is effective. In this case, the minimum injection quantity in an intermediate lift operation is determined by kinetic energy accumulated in the needle 102 or the needle 1902 by the current supplied to the solenoid 105 in the step-up voltage application time Tp, that is, the time in which the current is passed to the switching elements 805, 806. Then, the voltage cutoff time T2 to decelerate the needle is provided, the voltage cutoff time T2 and the holding current value Ih are determined based on information of the valve opening finish timing Ta and the valve closing finish timing Tb the drive device is caused to store, and the control is exercised such that the valve closing finish timing Tb and the displacement of the valve body 114 or the valve body 1907 increase with an increasing injection pulse until the valve body 114 or the valve body 1907 reaches the target lift. By adjusting the voltage cutoff time T2 and the holding current value Ih based on detection information, the bound of the needle 102 or the needle 1902 generated when the needle 102 or the needle 1902 collides against the fixed core 107 can be reduced by decelerating the speed of the valve body 114 or the valve body 1907 when the valve body 114 or the valve body 1907 reaches the target lift and thus, the injection quantity from the intermediate lift region to the timing when the target lift is reached and thereafter is positively correlated so that the injection quantity can continuously be controlled by increasing or decreasing the injection pulse width Ti.

In an engine in which the drive current waveform and the drive pulse width Ti are adjusted by ECU and provided to each fuel injection device as described above, it is necessary to provide the drive current waveform and the drive pulse in accordance with manufacturing variations and the state of each fuel injection device and for this purpose, the ECU 05A needs to read the valve opening start timing, the valve opening finish timing, and the valve closing finish timing as the state of each fuel injection device.

When the valve opening start timing, the valve opening finish timing, and the valve closing finish timing of each fuel injection device are read, each fuel injection device may preferably be operated according to a drive current waveform that allows easy detection of the valve opening/closing timing. However, the drive current waveform that allows easy detection may not necessarily be able to expand a range in which the injection pulse width and the injection quantity are linearly related.

Thus, the ECU 05A may well have power to set the drive current waveform to read the state of a fuel injection device. For example, in a situation in which the injection quantity does not necessarily have to be at the minimum such as warming-up after starting an engine, the drive current waveform to read the behavior of the valve body 114 is used to detect the valve opening start timing, the valve opening finish timing, and the valve closing finish timing of the fuel injection device of each connected cylinder and the detected information is recorded in a memory of the ECU 05A. Under the condition of divided injection in which fuel injection in one intake and exhaust stroke is divided, it is effective to be able to acquire detection information of the valve opening start timing and the valve closing finish timing needed to correct individual variations of the injection quantity of the fuel injection device of each cylinder in an intermediate lift operation by injecting fuel under the condition of causing the valve body 114 or the valve body 1907 to reach the target lift and under the condition of performing the intermediate lift operation.

Based on the recorded information of the drive device, the ECU 05A can control and inject a smaller injection quantity by adjusting the drive current waveform and the drive pulse width provided to each cylinder.

By setting the drive waveform to read the state of a fuel injection device and recording the state of the fuel injection device of a specific engine operating state, the injection quantity can be corrected to be able to reduce the minimum controllable injection quantity. In such a learning method, the state of aging of the fuel injection device can also be monitored and thus, even if the operation of the fuel injection device changes due to aging, the minimum value of the controllable injection quantity can be maintained at a low level.

In addition to warming-up after starting an engine, specific engine operating states include idling, an engine starting process, and a few cycles of intake and exhaust stroke after an engine key is taken off and a state in which the engine speed and loads can be adjusted by the command from the ECU 05A without depending on the driver's accelerator pedal operation and the injection quantity is not extremely small is a period of particularly easy implementation.

Even in a method in which the valve opening start timing, the valve opening finish timing, and the valve closing timing of the fuel injection device are recorded in the memory inside ECU and the injection pulse width Ti and the drive current waveform are corrected for the fuel injection device of each cylinder, the timing of valve operation may further be detected in each injection to reflect the detection information in the pulse width command value from ECU. Particularly when the valve closing finish timing as a valve closing operation is detected by detecting the terminal voltage of the solenoid 105 of the fuel injection device or a potential difference between the ground potential (GND) side terminal of the solenoid 105 and the ground potential, such information can be detected without using a waveform dedicated to detection and thus, the valve closing finish timing can be detected for each fuel injection. By giving feedback of the detection result to the injection pulse width in the next injection, the control precision of the fuel injection quantity can be improved and also changes of operation of the fuel injection device caused by the temperature, vibration or the like of the engine can be corrected.

As a result of being able to control fuel to a smaller injection quantity and use in an internal combustion engine as described above, fuel can be controlled to a smaller injection quantity and injected and thus, combustion under light load like, for example, when recovering from a fuel cut such as an idling stop is enabled and i becomes easier to achieve lower fuel consumption. In addition, A/F can be brought closer to the target value so that gases such as HC and NOx contained in an exhaust gas can be inhibited. Further, with a decreased fuel injection quantity, fuel injected during one intake and exhaust stroke can be divided and injected a plurality of times in a low load region and as a result, a penetration force of fuel spray is weakened or the control to form an air fuel mixture is made easier to exercise to inhibit fuel adhering to the combustion chamber wall surface and also the degree of homogeneity of the air fuel mixture is made uniform to reduce a region of dense fuel, which can lead to a lower amount of emission of soot as a portion of PM (particulate matter) and PN (particulate number of PM).

Example 6

Figure 37:
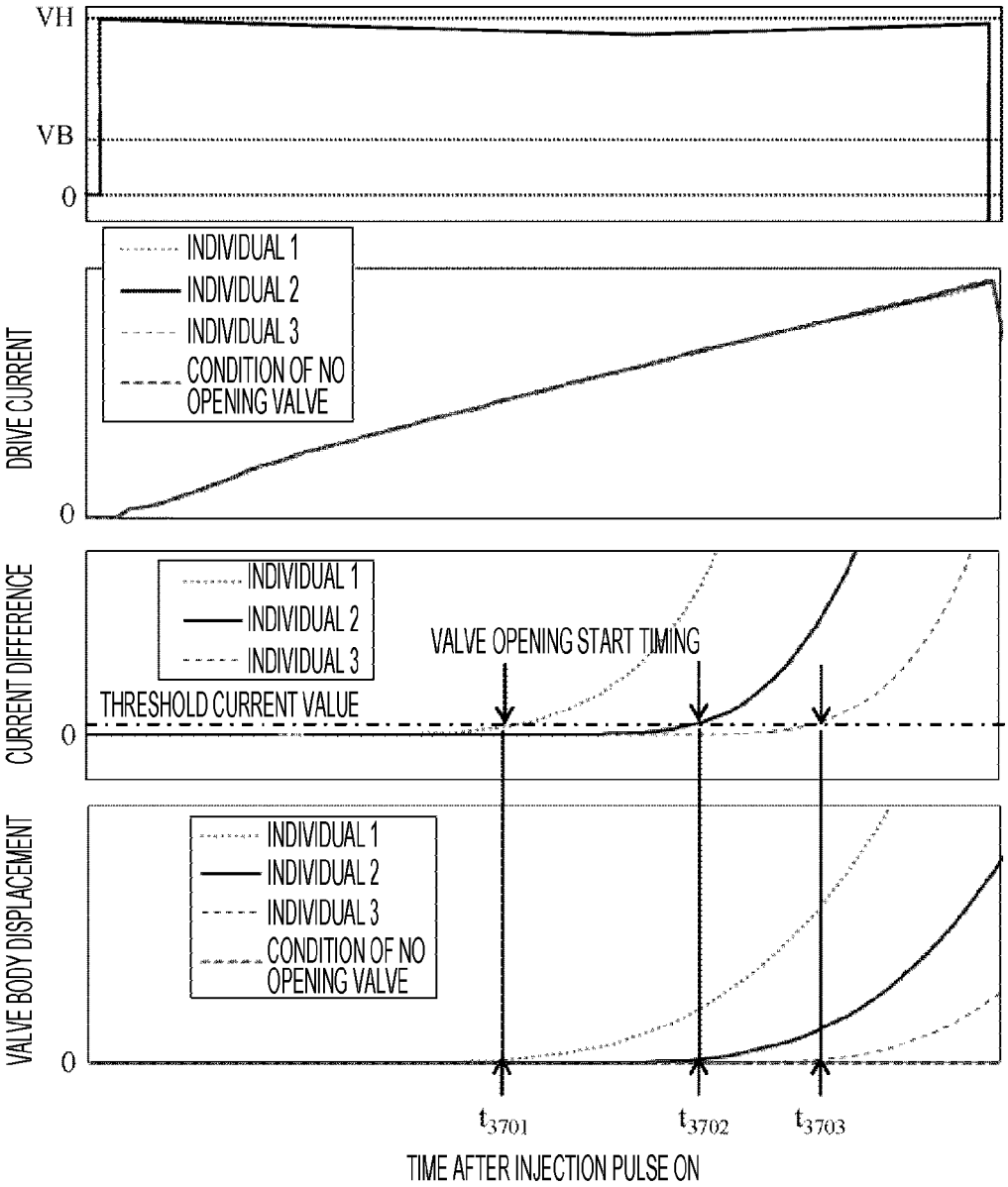

Next, using FIGS. 36 and 37, the configuration and operation of the fuel injection device in Example 6 and other detection methods of the valve opening start timing as a factor of individual variations of the injection quantity. The same symbols are attached to components in FIG. 36 that are equivalent to those in FIG. 1.

First, the configuration of the fuel injection device in Example 6 and the basic operation thereof will be described using FIG. 36. FIG. 36 is a diagram showing the configuration of a longitudinal view of the fuel injection device. The fuel injection device shown in FIG. 36 is a normally closed magnetic valve (electromagnetic fuel injection device) and when no current is passed to the solenoid 105, a valve body 3614 is energized toward the valve seat 118 by the spring 110 as a first spring and is in a closed state in close contact with the valve seat 118. In the valve closed state, a needle 3602 is energized toward the fixed core 107 side (valve opening direction) by a zero position spring 3612 as a second spring and in close contact with a regulating unit 3614*a* provided on an end on the fixed core side of the valve body 3614. In this state, there is a gap between the needle 3602 and the fixed core 107. A rod guide 3613 that guides a rod portion 3614*b* of the valve body 3614 is fixed to a nozzle holder 3601 forming a housing. The valve body 3614 and the needle 3602 are configured to be relatively displaceable and are included in the nozzle holder 3601. The rod guide 3613 constitutes a spring seat of the zero position spring 3612. The force by the spring 110 is adjusted during assembly by an indentation of a spring clamp 3624 fixed to the inside diameter of the fixed core 107. Incidentally, an energizing force of the zero position spring 3612 is set to be smaller than that of the spring 110.

The fuel injection device forms a magnetic circuit by the fixed core 107, the needle 3602, and a housing 3603 and has an air gap between the needle 3602 and the fixed core 107. A magnetic valve 3611 is formed in a portion corresponding to the air gap between the needle 3602 and a fixed core 3606 of the nozzle holder 3601. The solenoid 105 is mounted on an outer circumferential side of the nozzle holder 101 in a state of being wound around a bobbin 104.

A rod guide 115 is provided near the end of the valve body 114 on the opposite side of the regulating unit 114*a* like being fixed to the nozzle holder 101. The rod guide 115 may be formed as the same component as an orifice cup 116. The valve body 114 is guided by two rod guides of a first rod guide 113 and the second rod guide 115 when moving in a valve axial direction.

The orifice cup 116 in which the valve seat 118 and the combustion injection hole 119 are formed is fixed to the tip portion of the nozzle holder 101 to seal off an inner space (fuel passage) in which the needle 3602 and the valve body 3614 are provided.

Fuel is supplied from an upper portion of the fuel injection device and sealed with a sealing portion formed on the end of the valve body 3614 on the opposite side of the regulating unit 3614*a* and the valve seat 118. When the valve is closed, the valve body is pressed in the closing direction by a force in accordance with the inside diameter of the seat of the valve seat due to fuel pressure.

When a current is supplied to the solenoid 105, a magnetic flux is generated between the needle 3602 and the fixed core 107 and a magnetic suction force is generated. When the magnetic suction force acting on the needle 3602 exceeds the sum of a load by the spring 110 and a force due to the fuel pressure, the needle 3602 moves upward. At this point, the needle 3602 moves upward together with the valve body 3614 by being engaged with the regulating unit 3614*a* of the valve body 3614 and moves until the top end surface of the needle 3602 collides against the undersurface of the fixed core 107. At this point, if the supply of current to the solenoid 105 is stopped before the valve body 3614 reaches the target lift after the valve body 3614 starts to be displaced, an intermediate lift operation is performed. As a result, the valve body 3614 separates from the valve seat 118 and the supplied fuel is injected from a plurality of fuel injection holes 119.

When the passage of electric current to the solenoid 105 is cut off, the magnetic flux generated in the magnetic circuit disappears and the magnetic suction force also disappears. Due to the disappearance of the magnetic suction force acting on the needle 3602, the valve body 3614 is pushed back to a closing position in contact with the valve seat 118 by the load of the spring 110 and a force due to fuel pressure.

When the valve body 3614 is at rest in the target lift position, that is, in a valve open state, a protruding portion of a collision portion of one or both of the needle 3602 and the fixed core 107 are provided on a circular end face where the needle 3602 and the fixed core 107 are opposed to each other. Due to the protruding portion, an air gap is created in a valve open state between a portion excluding the protruding portion of the needle 3602 or the fixed core 107 and the surface on the side of the needle 3602 or the fixed core 107 and one or more fuel passages through which a fluid can move in an outside diameter direction and an inside diameter direction of the protruding portion in a valve open state are provided. In an operation in which the valve body 3614 is pushed back to the closing position, the needle 3602 moves together by being engaged with the regulating unit 114*a* of the valve body 114.

In the fuel injection device according to the present example, the valve body 114 and the needle 3602 achieve an effect of inhibiting the bound of the needle 3602 with respect to the fixed core 107 and the bound of the valve body 114 with respect to the valve seat 118 by causing a relative displacement in a very short time at the instant when the needle 3602 collides against the fixed core 107 during valve opening and at the instant when the valve body 3614 collides against the valve seat 118 during valve closing.

When configured as described above, the spring 110 energizes the valve body 114 in a direction opposite to a driving force by the magnetic suction force and the zero position spring 112 energizes the needle 3602 in a direction opposite to the energizing force of the spring 110.

Next, the method of detecting the valve opening start timing when the fuel injection device in FIG. 36 is used will be described using FIG. 37. FIG. 37 is a diagram showing the relationship between the terminal voltage $V_{inj}$ of the solenoid 105, the drive current supplied to the solenoid 105, a difference between a current value when the valve body does not open and a current value of each individual, and the valve displacement and the time after the injection pulse is turned on. In the drive current and the valve displacement in FIG. 37, profiles of the individuals 1, 2, 3 having different valve opening start timings and a profile when the valve body does not start to open are shown. From FIGS. 36 and 37, under the condition that the step-up voltage VH is applied and the valve body is started to open by a large current, the magnetic flux on the suction surface is near saturation and changes of the induced electromotive force accompanying the valve opening start of the valve body 3614 are small and as a result, changes of the drive current are also small. In the fuel injection device in FIG. 36, the needle 3602 gradually starts to open when a force in the valve opening direction exceeds a force in a valve closing direction from a resting state and thus, acceleration changes in the valve opening start timing are small and even if the valve opening start timing changes, changes of the drive current are small. In the configuration of the fuel injection device as described above, by causing the CPU 801 or the IC 802 to store the drive current when the valve body 3714 does not starts to open and calculating a difference from the drive current of the fuel injection device of each cylinder under the condition that the valve body 3714 starts to open or comparing both currents, a slight change of the drive current accompanying the valve opening start can be detected. At this point, changes of a current difference accompanying the valve opening start of the valve body 3714 also rise gradually and thus, by setting a certain threshold to the current difference, the timing when the threshold is exceeded may be set as the valve opening start timing and the CPU 801 or the IC 802 may preferably be caused to store a valve opening start lag time from the time when the injection pulse is turned on to the valve opening start timing. For the acquisition of the drive current (hereinafter, a reference current) under the condition that the valve body 3714 does not start to open, the drive current is acquired under the condition of a high fuel pressure supplied to the fuel injection device and a large differential pressure force acting on the valve body 3714 and detected for the fuel injection device of each cylinder. The profile of the drive current flowing to the solenoid 105 is subject to the resistance value of the solenoid 105 and individual variations of the inductance of the magnetic circuit and the like. Therefore, by storing the drive current under the condition of not starting to open for the fuel injection device of each cylinder and calculating a difference from the drive current of each fuel injection device, the valve opening start timing can be detected with precision and the correction precision of the injection quantity can be improved. If the capacity of the storage memory installed in the CPU 801 or the IC 802 is small, the memory area available for storage is limited and thus, the storage of the reference current and the drive current may preferably be configured such that when the detection of the valve opening start timing of a certain cylinder is finished, the memory is once erased and then caused to store the reference current and the drive current to detect the valve opening start timing of the fuel injection device of the next cylinder. Accordingly, the memory usage capacity of the CPU 801 or the IC 802 can be reduced and also the sampling rate of the data point sequence to be stored can be made finer so that the detection precision of the valve opening start timing can be improved. According to the technique in Example 6, the control causing the valve body 3614 to reach the target lift can be exercised using a large drive current and this technique is effective when the fuel injection device is operated under the condition of a high fuel pressure.

In a valve closed state in which the valve body 3614 and the valve seat 118 are in contact, a differential pressure force obtained as a product of the seat area and fuel pressure acts on the valve body 3614. Thus, if the fuel pressure increases, the differential pressure force acting on the valve body 3614 increases and the valve opening start timing of the valve body 3614 is delayed. The differential pressure force can be calculated as a product of the seat area and the fuel pressure and the relationship between the fuel pressure and the valve opening start timing is a substantially linear relation and thus, by causing the CPU 801 or the IC 802 to store two or more valve opening start timings under different fuel pressure conditions and creating a function of the fuel pressure and the valve opening start timing, the valve opening start timing of the fuel injection device of each cylinder and the valve opening start timing when the fuel pressure changes can be calculated by the ECU 120. From information of the valve opening start timing or the valve opening start lag time and information of the valve closing finish timing, the injection period in which the valve body 3614 is displaced can be determined under the condition of the intermediate lift and by controlling the drive current so that injection periods match, the injection quantity in the intermediate lift can be controlled and therefore, the control of a minute injection quantity can be exercised.

Example 7

Figure 38:
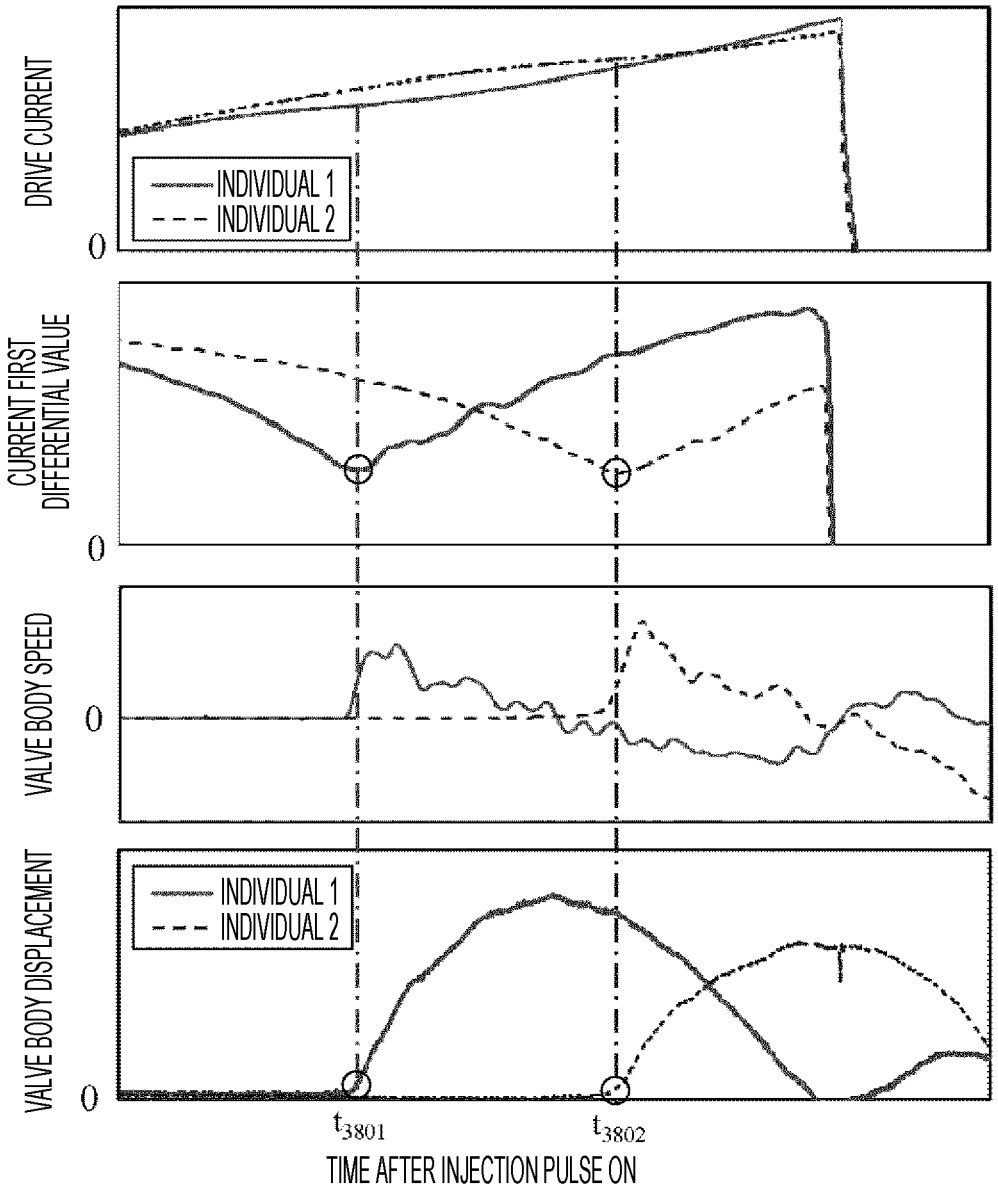
FIG. 38 is an explanatory view of a detection method of the valve opening start timing using the first differential of the current.

Next, using FIGS. 2, 14, 18, and 38, the detection method of the valve opening start timing Ta' in Example 7 will be described. FIG. 38 is a diagram showing the relationship between the drive current, the first differential value of current, the valve body speed, and the valve body displacement under the condition that the battery voltage VB is applied to the coil 105 in the drive device and the fuel injection device in Examples 1, 2 and the time after the injection pulse is turned on. From FIG. 38, when the valve body 114 or the valve body 1907 is caused to open by applying the battery voltage VB, compared with the condition of applying the step-up voltage VH, the drive current and the magnetic flux rise gradually and changes thereof over time are small and thus, the voltage generated based on the induced electromotive force of the first term on the right side of Formula (2) in Example 1 is small. Also when the battery voltage VB is applied, compared with the condition of applying the step-up voltage VH to the coil 107, the applied voltage is small and the voltage generated based on the Ohm's law in the second term on the right side is small and as a result, the drive current flowing to the coil is small. As described above, changes of the magnetic flux over time are small and thus, the influence of an eddy current is small and the valve body 114 and the valve body 1907 can start to open in timings $t_{3801}$, $t_{3802}$ when the drive current is low respectively. Because of a small drive current in the timings t3801, t3802, the magnetic flux density on the suction surface of the needle 102 and the needle 1902 in the valve opening start timing Ta'. Accordingly, in the range of a region H1 where changes of the magnetic flux density with respect to changes of the magnetic field shown in FIG. 14 are large, the valve body 114 and the valve body 1902 can be caused to start to open under the condition that, from the formulation between the magnetic field H and the magnetic flux density B shown in Formula (6), the permeability p on the suction surface of 102 and the valve body 1907 is large, and thus, changes of the induced electromotive force accompanying changes of the magnetic gap can be detected by the drive current more easily. Under the above condition, as shown in FIG. 38, the timings $t_{3801}$, $t_{3802}$ as the valve opening start timing Ta' of the valve body 114 and the valve body 1907 respectively can be detected as the minimum value of the first differential value of current and the drive device may preferably be caused to store the time after the injection pulse is turned on until the valve body 114 and the valve body 1907 start to open as the valve opening start lag time. The minimum value of the first differential value of current corresponds to changes of speed over time of the valve body 114 and the valve body 1907 and the timing when the speed rapidly changes accompanying the valve opening start of the valve body 114 and the valve body 1907 is detected as the minimum value of the first differential value of current.

$$B=\mu\cdot H \tag{6}$$

By detecting under the condition of applying the battery voltage VB and multiplying the valve opening start lag time of the fuel injection device of each cylinder the drive device is caused to store by a correction coefficient the drive device is caused to store in advance, the valve opening start lag time under the condition of applying the step-up voltage VH can be estimated. Particularly under the condition of a high fuel pressure, to displace the valve body 114 or the valve body 1907 up to the target injection period or target lift position, it is necessary to generate a large magnetic suction force in the needle 102 or the needle 1902 by applying the step-up voltage VH and cause the needle 102 or the needle 1902 to collide against the valve body 114 or the valve body 1907 in a state of large kinetic energy to cause the displacement up to the target lift position. Therefore, according to the detection technique of the valve opening start timing Ta' in Example 7, when the valve opening start timing Ta' is detected, the voltage source may preferably be switched such as applying the battery voltage VB under the condition of a low fuel pressure and applying the step-up voltage VH under the condition of actual driving. When the valve opening start lag time is detected by the battery voltage VB, the step-up voltage VH is not used and thus, the drive current is small and energy consumption can be inhibited. Because the frequency of passage/stop of current to the switching element 831 to return the step-up voltage VH to the initial voltage value can be inhibited, heating of the drive circuit can be inhibited. When the valve opening start timing Ta' and the valve opening start lag time are detected, the minimum value of the first differential value of current of a signal when the voltage value of the battery voltage VB enters a certain range after monitoring the battery voltage VB by the CPU 801 or the IC 802 may preferably be detected to cause the drive device to store the minimum value as the valve opening start lag time. Accordingly, variations of the valve opening start timing when the battery voltage VB varies can be inhibited and therefore, the valve opening start timing can be detected with precision and the injection quantity can be controlled with precision.

Example 8

Figure 39:
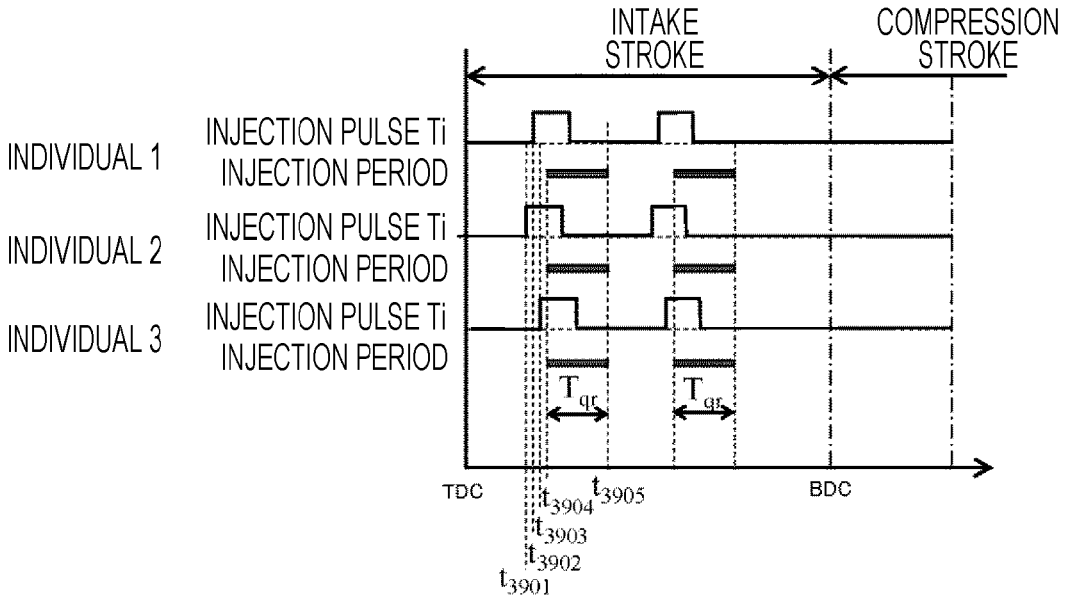
FIG. 39 is an explanatory view of the correction method of fuel injection timing.

Next, the correction method of injection timing of fuel in Example 8 will be described using FIG. 39. Example 8 is a control method of the injection timing that can be used in combination with the control method of the injection quantity in Examples 1 to 4. Incidentally, the horizontal axis of FIG. 39 shows the timing from the top dead center (TDC) to the bottom dead center (BDC) of the piston of an engine in the transition from an intake stroke to a compression stroke. FIG. 39 is a graph showing the relationship between the injection pulse and the injection period $T_{qr}$ in which fuel is injected when the divided injection is performed twice and the injection timing is controlled based on information of the valve opening start lag time detected by ECU of the individuals 1, 2, 3 having different valve opening start timings Ta'. From FIG. 39, from the viewpoint of improving the degree of homogeneity of the air fuel mixture by improving fluidity of injected fuel and the air and reducing piston adhesion of fuel, the fuel may preferably be injected in the intake stroke in the transition from TDC to BDC. If the injection pulse Ti is input into the drive circuit in the same timing based on TDC for individuals having different valve opening start timings Ta', the timing when the fuel injection starts varies from individual to individual and the distribution of the degree of homogeneity of the air fuel mixture varies and also with the injection start timing delayed, piston adhesion of fuel may increase to increase PM containing soot and the like. By matching the timing when fuel is injected in each cylinder, variation factors in a period from the injection of fuel to the formation of an air fuel mixture by mixing with the air can be inhibited and thus, variations of the degree of homogeneity of the air fuel mixture from cylinder to cylinder can be inhibited and exhaust performance and fuel consumption can be improved. While the valve opening start lag time varies accompanying variations of the valve opening start timing Ta' for each of the individuals 1, 2, 3, injection start timing t3904 of fuel can be matched for each individual by outputting the injection pulse Ti in timing $t_{3901}$ for the individual 2 having a longer valve opening start lag time with respect to the individual 1 having the standard valve opening start lag time and outputting the injection pulse Ti in timing t3903 for the individual 2 having a shorter valve opening start lag time. Particularly during divided injection in which fuel is injected a plurality of times in one intake and exhaust stroke, compared with one injection, the time in which the valve body 114 or the valve body 1907 is driven after reaching the target lift position becomes shorter and thus, transient behavior of the valve body 114 or the valve body 1907 in the intermediate lift becomes a dominant factor that determines the fuel injection quantity. In addition, the deviation of the injection start timing arises as many times as the number of times of divided injection in the divided injection and thus, an increase of fuel adhesion on the wall surface accompanying variations of the injection timing or an increase of PM containing soot may lead to degradation of exhaust performance.

According to the technique in Example 8 of the present invention, by adjusting the timing when the injection pulse width Ti is supplied for the injection start timing from cylinder to cylinder, the degree of homogeneity of the air fuel mixture in each cylinder can be brought closer to a similar state and PM can be inhibited so that exhaust performance can be improved. Further, by correcting the setting of the drive current and the width of the injection pulse Ti for each cylinder using the control technique of Examples 1, 3, 4, the injection period $T_{qr}$ in which fuel is injected can be matched. By using the above method, the injection start timing and the injection end timing $t_{3904}$ can be matched from individual to individual (from cylinder to cylinder) and thus, variations of the air fuel mixture from cylinder to cylinder can be inhibited and PN (Particulate Number) and PM (Particulate Matter) contained in an exhaust gas can significantly be inhibited.

REFERENCE SIGNS LIST

101 nozzle holder
102*a* needle
102*b* needle
103 housing
104 bobbin
105 solenoid
107 fixed core
110 spring
111 magnetic valve
112 return spring
115 rod guide
114 valve body
114*a* regulating unit
114*b* rod portion
117 fixed core
116 orifice cup
118 valve seat
119 fuel injection hole
120 ECU
121 drive circuit
124 spring clamp
201 air gap
204 end face
205 abutting surface of the valve body 114 and the needle 102*a*
206 sliding surface of needle 102*a* and the needle 102*b*
207 end face of the needle 102*b* on the valve body 114 side
210 contact surface
840 fuel injection device
801 central processing unit (CPU)
802 IC
805, 806, 807, 831 switching element
809, 810, 811, 832, 835 diode
808, 812, 813 resistor for current, voltage detection
814 step-up voltage
830 coil
815 ground potential (GND)
620 operational amplifier
841 terminal of the solenoid on the ground potential (GND) side
R81, R82, R83, R84 resistor
852, 853 resistor for VL1 voltage detection
C81, C82 capacitor
860 active low-pass filter for voltage $V_{L1}$ detection
861 active low-pass filter for voltage $V_{L2}$ detection
1501 analog differentiating circuit
1901 gap
1902 second needle
1903 first member
1904 junction
1905 vertical hole fuel passage
1906 horizontal hole fuel passage
1907 second valve body
1908 second regulating unit
1909 initial position spring
1910 first regulating unit
2101 second gap
2201 third gap
ds seat diameter
T13 back pulse application time
Ti injection pulse width (valve opening signal time)
Ta' valve opening start lag time (Ta')
Ta valve opening finish lag time (Ta)
Tb valve closing finish lag time (Tb)
Tp step-up voltage application time (Tp)
T2 drive voltage cutoff time (T2)
VH step-up voltage
VB battery voltage
$I_{Peak}$ peak current value
Ih holding current value
Tn dead zone

The invention claimed is:

1. A drive device for a fuel injection device including
a step-up circuit that steps up a battery voltage and
a first switching element that controls passage/stop of current from the step-up circuit to a solenoid of the fuel injection device,
wherein the fuel injection device includes a valve body driven by the solenoid, opened by being brought into contact with a valve seat, and closed by being separated from the valve seat,
a needle that is driven by a magnetic suction force from the solenoid and energizes the valve body in a valve opening direction when coming into contact with the valve body, and
in a valve closed state, an air gap is provided between the valve body and a contact surface of the needle and used by the needle to come into contact with the valve body after performing a free running operation by the needle due to the magnetic suction force from the solenoid
and the drive device includes
a drive unit that drives the valve body in a valve opening direction by supplying a current to the solenoid with passage of the current to the first switching element and
a valve opening start period detector that detects a valve opening start period when the valve body separates from the valve seat by detecting changes of velocity or acceleration of the needle caused by contact with the valve body by performing a free running operation in the air gap based on a current value flowing through the solenoid, wherein
the needle defines a lateral protrusion, and on a first side thereof the later protrusion defines the gap, and on a second side thereof, the lateral protrusion does not contact a spring.

2. The drive device according to claim 1, wherein the drive unit applies a negative voltage to the solenoid after the current is passed to the first switching element and the valve opening start period detector detects the valve opening start period after the negative voltage is applied.

3. The drive device according to claim 1, wherein the fuel injection device includes the needle is driven by a magnetic suction force from the solenoid and energizes the valve body in the valve opening direction when coming into contact with the valve body and the drive device includes a fuel injection device variation correction unit that varies an energization time or an energization current of the solenoid based on the valve opening start period, and the valve opening start period detector detects the valve opening start period by detecting, based on the current value flowing through the solenoid, changes of velocity or acceleration of the needle caused by contact with the valve body by performing the free running operation in the air gap after the drive signal generator drives the valve body in the valve opening direction by passing the current to the first switching element and attenuates the energization current of the solenoid by stopping the current to the first switching element.

4. The drive device according to claim 3, wherein the drive device includes a second switching element that controls the passage/stop of current from the battery to the solenoid, a third switching element that controls the passage/stop of current between a ground potential side terminal of the solenoid and a ground potential, a first diode provided between the ground potential side terminal of the solenoid and a terminal of the first switching element, and a second diode provided between a voltage source side terminal of the solenoid and the ground potential to supply the current from the side of the ground potential to the side of a voltage source and the drive signal generator applies a voltage in a negative direction from the step-up circuit to the solenoid by passing the current to the first switching element and the third switching element to supply the current to the solenoid and then stopping the current to the first switching element and the third switching element to return the current to the step-up circuit from the ground potential via the second diode, the solenoid, and the first diode and after applying the voltage in the negative direction, causes the needle to collide against the valve body.

5. The drive device according to claim 4, wherein the drive device includes a first resistor provided between the third switching element and the ground potential to detect the current flowing through the solenoid and a storage unit that stores a time from a start of voltage application from the step-up circuit to the solenoid to the valve opening start period as a valve opening start lag time, the valve opening start period detector detects changes of the acceleration of the needle caused by a collision of the needle against the valve body by detecting a time when a second differential value of the current detected by the first resistor takes a maximum value as the valve opening start period of the valve body for the fuel injection device installed in each cylinder of an internal combustion engine, and the fuel injection device variation correction unit varies the energization time or the energization current of the solenoid based on information stored in the storage unit.

6. The drive device according to claim 3, wherein the drive device includes a battery voltage detection function that detects a voltage value of the battery and the valve opening start period detector detects the valve opening start period under a condition that values of the voltage value of the battery are equal to or less than a predetermined voltage value and have a predetermined variation range or less.

7. The drive device according to claim 5, wherein a drive device includes a solenoid current detection means configured to detect a resistance value of the first resistor, a second resistor and a first operational amplifier are connected in series between a terminal of the first resistor on the side of the third switching element and the solenoid current detection means, and a third resistor and a first capacitor are connected in parallel to the first operational amplifier.

8. The drive device according to claim 5, wherein the fuel injection device variation correction unit corrects the energization time or an energization current waveform of the solenoid in injections after the injection from which the valve opening start period is detected based on the valve opening start lag time stored in the storage unit.

9. The drive device according to claim 7, wherein the needle includes a first needle driven from a valve closed state in which the valve body is in contact with the valve seat in the valve opening direction by the magnetic suction force to collide against the valve body to open the valve body and a second needle energized in the valve closing direction by a first spring in the valve closed state, a lower end face of the second needle and an upper end face of the valve body are in contact in the valve closed state of the valve body, a collar provided on an outer edge is in contact with the first needle in a valve open state in which the first needle is in contact with the fixed core, and a function to allow the first needle to separate from the second needle by a relative displacement is provided when current supply to the solenoid is stopped from a state in which the valve body is open and the valve body comes into contact with the valve seat and the drive device includes a fourth resistor and a fifth resistor in parallel with the third switching element and the first resistor, the fifth resistor is connected to the ground potential, the resistance value of the fourth resistor and the fifth resistor is set larger than a coil resistance value of the solenoid, the resistance value of the fifth resistor is set smaller than the resistance value of the fourth resistor, a sixth resistor and a second operational amplifier are connected in series between a terminal of the fifth resistor on the side of the fourth resistor and the solenoid current detection means, and a seventh resistor and a second capacitor are connected in parallel with the second operational amplifier.

10. The drive device according to claim 4, wherein the drive signal generator causes the fuel injection device to perform a plurality of divided injections in one intake and exhaust stroke of a cylinder injection type internal combustion engine and at least one injection of the divided injections finishes the injection in an intermediate lift operation in which the needle is not in contact with the fixed core, and the valve opening start period detector detects the valve opening start period in the intermediate lift operation.

11. The drive device according to claim 4, wherein the fuel injection device includes a first spring energizing the valve body in a valve closing direction, the valve body includes a first regulating that regulates a relative displacement of the needle in the valve closing direction in a state in which the valve body and the valve seat are in contact and a second regulating unit that regulates the relative displacement of the needle in the valve opening direction so as to receive an energizing force from the needle when the needle performs a valve opening operation, and the needle includes a spring seat provided on the side of the valve seat to oppose the first regulating unit and a third spring provided between the spring seat and the first regulating unit to energize the needle in the valve closing direction in a valve closed state, the needle and the first regulating unit are in contact in the valve closed state, and the air gap is formed between the needle and the second regulating unit.

12. The drive device according to claim 4, wherein when the valve body is closed from a state in which the valve body is open, a period in which a voltage signal of the solenoid is fetched is divided into a first fetch period and a second fetch period after the first fetch period, a minimum value of a first differential value of the voltage signal of the solenoid in the first fetch period is determined as valve closing finish timing when the valve body comes into contact with the valve seat, the drive device is caused to store a time after a voltage is applied to the solenoid in the second fetch period until timing when the first differential value of the voltage signal takes the minimum value as resting timing of the needle after the needle collides against the second regulating unit and when a plurality of divided injections is performed in one intake and exhaust stroke, the timing when the voltage is applied to the solenoid for a second injection or thereafter is set later than the resting timing of the needle the drive device is caused to store, and based on the resting timing of the needle, voltage application timing to the solenoid for the second injection or thereafter is controlled.

13. The drive device according to claim 5, wherein when a valve opening operation in which the valve body in a closed state is operated to a valve open state is performed, the current is passed to the first switching element and the third switching element to increase the current of the solenoid and then, when the current value supplied to the solenoid exceeds a setting value or a set period passes, the current to the first switching element and the third switching element is stopped to stop energization of the solenoid and the setting value or the set period is corrected based on detection information of a valve opening lag time of the fuel injection device of each cylinder.

14. The drive device according to claim 5, wherein when driven under a condition of an intermediate lift in which the valve body is not fully open, by detecting valve closing finish timing of the fuel injection device of each cylinder and calculating a valve closing lag time, a deviation value of an injection period in which the valve body is displaced obtained by subtracting the valve opening start time from the valve closing lag time determined from a command value of an injection quantity of the drive device for the fuel injection device of each cylinder, and the energization time or the energization current of the solenoid in subsequent injections are corrected for the fuel injection device of each cylinder such that the deviation value of the injection period becomes smaller.

15. The drive device according to claim 5, wherein when the valve body performs an intermediate lift operation, the current is passed to the first switching element and the third switching element and the time in which the voltage from the step-up circuit is applied is corrected such that an injection period obtained by subtracting the valve opening lag time from the valve closing lag time match for the fuel injection device of each cylinder.

16. The drive device according to claim 12, wherein after correcting an injection period in an intermediate lift operation for the fuel injection device of each cylinder, the current to the first switching element and the third switching element are stopped and the voltage in the negative direction is applied from the step-up circuit to the solenoid and then, the current is passed to the first switching element and the third switching element and the voltage is applied from the step-up circuit to the solenoid and when the current flowing to the solenoid reaches a certain value, the current to the first switching element is stopped and the current value flowing to the solenoid is maintained at a certain holding current value by repeating passage/stop of the current to the second switching element and the third switching element, and an injection quantity in the intermediate lift is controlled by controlling the time in which the holding current value is supplied.

17. The drive device according to claim 16, wherein after correcting the injection period in the intermediate lift operation for the fuel injection device of each cylinder, the current to the first switching element and the third switching element is stopped and the time in which the voltage in the negative direction is applied from the step-up circuit to the solenoid is corrected for the fuel injection device of each cylinder.

18. The drive device according to claim 17, wherein the holding current value is adjusted based on the valve opening finish lag time for the fuel injection device of each cylinder and at least one of the peak current value, a voltage application time from the step-up circuit, and the delay time is corrected in accordance with a fuel pressure supplied to the fuel injection device.

19. The drive device according to claim 16, wherein when, after correcting the injection period in the intermediate lift operation for the fuel injection device of each cylinder, the energization time of the holding current value is increased with an increasing injection pulse width, the timing when the second differential value of the voltage between the terminal of the solenoid on the side of the ground potential and the ground potential takes the minimum value is detected at two points or more of different injection pulse widths for the fuel injection device of each cylinder as the valve closing lag time and stored, a relation between the injection period and the injection pulse width in the intermediate lift for the fuel injection device of each cylinder is approximated as a function, and a first injection pulse width to obtain the injection period required for the fuel injection device of each cylinder by deriving coefficients of the function from information of the injection period of the fuel injection device of each cylinder to correct the injection quantity of the fuel injection device of each cylinder.

20. The drive device according to claim 19, wherein when the valve body performs a full lift operation in which the valve body comes into contact with the fixed core, an actual injection period is acquired at two points or more of different injection pulse widths for the fuel injection device of each cylinder and stored, the relation between the actual injection period and the injection pulse width is approximated as a function, a second injection pulse width to obtain the injection period required for the fuel injection device of each cylinder by deriving coefficients of the function from information of the actual injection period of the fuel injection device of each cylinder, and the injection pulse width where the injection periods of the function of the first injection pulse and the actual injection period determined for the intermediate lift and the function of the second injection pulse and the actual injection period match as the injection pulse width to switch a correction formula of the intermediate lift and a correction formula of a full lift.

21. The drive device according to claim 5, wherein after an engine is started, valve opening start timing, valve opening finish timing, and valve closing finish timing are each detected in one of periods of idling and a few cycles of an intake and exhaust stroke under engine stop conditions.

22. An fuel injection system comprising:

a fuel injection device that injects fuel into an internal combustion engine and a drive device for the fuel injection device including a step-up circuit that steps up a battery voltage and a first switching element that controls passage/stop of current from the step-up circuit to a solenoid of the fuel injection device, wherein the fuel injection device includes a valve body driven by the solenoid, closed by being brought into contact with a valve seat, and opened by being separated from the valve seat, a needle that is driven by a magnetic suction force from the solenoid and energizes the valve body in a valve opening direction when coming into contact with the valve body, and in a valve closed state, an air gap is provided between the valve body and a contact surface of the needle and used by the needle to come into contact with the valve body after performing a free running operation due to the magnetic suction force from the solenoid, the drive device includes a drive signal generator that drives the valve body in the valve opening direction by supplying a current to the solenoid with passage of current to the first switching element, a valve opening start period detector that detects a valve opening start period when the valve body separates from the valve seat based on a current value flowing through the solenoid, and a fuel injection device variation correction unit that varies an energization time or an energization current of the solenoid based on the valve opening start period, and the valve opening start period detector detects the valve opening start period by detecting, based on the current value flowing through the solenoid, changes of velocity or acceleration of the needle caused by contact with the valve body by performing the free running operation in the air gap after the drive signal generator drives the valve body in the valve opening direction by passing the current to the first switching element and attenuates the energization current of the solenoid by stopping the current to the first switching element, wherein the needle defines a lateral protrusion, and on a first side thereof the later protrusion defines the gap, and on a second side thereof, the lateral protrusion does not contact a spring.

* * * * *